US006292644B1

(12) United States Patent
Goto et al.

(10) Patent No.: US 6,292,644 B1
(45) Date of Patent: Sep. 18, 2001

(54) TONER REPLENISHING CONTAINER AND TONER REPLENISHING APPARATUS

(75) Inventors: Tatsuya Goto; Fumio Tazawa, both of Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/400,858

(22) Filed: Sep. 21, 1999

(30) Foreign Application Priority Data

Sep. 22, 1998 (JP) ..... 10-286013
Sep. 16, 1999 (JP) ..... 11-262432

(51) Int. Cl.[7] ..... G03G 15/08
(52) U.S. Cl. ..... 399/262; 399/120; 222/DIG. 1; 222/167
(58) Field of Search ..... 399/262, 258, 399/120; 222/DIG. 1, 167, 169, 172

(56) References Cited

U.S. PATENT DOCUMENTS 4,937,628 * 6/1990 Cipolla et al. .
5,812,915 * 9/1998 Farkash ..... 399/262
5,970,292 * 10/1999 Miller ..... 399/262

FOREIGN PATENT DOCUMENTS 0 631 206 12/1994 (EP) .
0 757 301 2/1997 (EP) .

OTHER PUBLICATIONS

Patent Abstract of Japan, 7–181793, vol. 1995, No. 10, Nov. 1995.
Patent Abstract of Japan 8–297399, vol. 1997, No. 3, Mar. 1997.

* cited by examiner

*Primary Examiner*—Richard Moses
(74) *Attorney, Agent, or Firm*—Fitzpatrick, Cella, Harper & Scinto

(57) ABSTRACT

A toner replenishing container which is detachably mountable to a main assembly of a toner replenishing apparatus, the toner replenishing container includes a container body, having an opening for supplying toner into the main assembly, for containing toner; an opening and closing member, slidable in a first direction, for opening and closing the opening; wherein the opening and closing member is is slidable relative to the main assembly in a second direction which is different from the first direction, and when the opening and closing member is at a closing position for closing the opening, the opening and closing member is prevented from sliding in the first direction before sliding in the second direction.

28 Claims, 47 Drawing Sheets

TONER REPLENISHING CONTAINER AND TONER REPLENISHING APPARATUS

FIELD OF THE INVENTION AND RELATED ART

The present invention relates to a toner replenishing container and a toner replenishing apparatus, which replenish an image forming apparatus, for example, a copying machine, a printer, a recorded image displaying apparatus, or a facsimile, and which form a visible image with the use of an electrophotographic system, an electrostatic recording system, or the like, with toner.

As for the developer for an image forming apparatus of the above-described type, microscopic toner powder has been used. As the developer in the main assembly of an image forming apparatus is depleted, an image forming apparatus is replenished with a fresh supply of toner with the use of a toner replenishing container (toner cartridge).

Since toner has been in the form of an extremely fine powder, there has been a problem that toner scattered and soiled an operator and the ambience during a replenishing operation was poor. Therefore, various methods for replenishing an image forming apparatus with toner have been proposed. According to one of these methods, a toner cartridge is placed within the main assembly of an image forming apparatus, and toner is discharged in small increments from the toner cartridge through its small opening. When such a method is used, it does not occur that toner is simply discharged due to natural factors, such as gravity. Therefore, such a method is provided with some kind of means for stirring and conveying toner.

Further, below the toner cartridge, a sub-hopper is provided as a toner storing portion, which not only temporarily stores toner, but also conveys toner, while stirring it, to a developing device.

In an image forming apparatus structured as described above, as the entire supply of toner in the toner cartridge is discharged into the sub-hopper, that is, as the toner cartridge becomes empty, the image forming apparatus detects this condition and instructs an operator that the current toner container should be replaced with a fresh one. The operator follows this instruction; the operator removes the current toner cartridge, which has become empty, and inserts a fresh toner cartridge in place of the current one so that the image forming apparatus can continue the current image forming operation.

Referring to FIG. 9, a toner cartridge 202 is provided with a shutter 201 for sealing the opening with which the toner container 203 is provided to discharge toner. Not only is the shutter 201 closed to prevent the supply of toner stored within the toner container 203 from leaking, but also it is closed to seal the opening after the toner cartridge is used up and removed from an image forming apparatus, so that the toner remaining within the used toner cartridge is prevented from leaking out and soiling the areas adjacent the used toner cartridge.

However, the conventional toner cartridge 202 has a problem in that it opens too easily. More specifically, it opens as its shutter is simply rotated in the direction (arrow mark C) indicated in FIG. 9. Thus, even when the conventional toner cartridge 202 is left alone outside an image forming apparatus, there is a possibility that the conventional toner cartridge will be inadvertently opened by an operator, and that the areas adjacent the cartridge will be contaminated by the toner that leaks out the cartridge.

SUMMARY OF THE INVENTION

The image object of the present invention is to provide a toner replenishing container and a toner replenishing apparatus, which prevent the opening, through which toner is replenished, from being inadvertently unsealed when the toner replenishing container is not in the toner replenishing apparatus.

Another object of the present invention is to provide a toner replenishing container and a toner replenishing apparatus, the toner opening of which can be simply opened after the toner replenishing container is installed in the toner replenishing apparatus.

These and other objects, features and advantages of the present invention will become m ore apparent upon a consideration of the following description of the preferred embodiments of the present invention taken in conjunction with the accompanying drawings.

DESCRIPTION OF THE PREFERRED EMBODIMENTS

Hereinafter, the embodiments of a toner-replenishing container in accordance with the present invention, which is removably installable in the toner-replenishing apparatus of the main assembly of an image forming apparatus will be described, along with the embodiments of a toner-replenishing apparatus in accordance with the present invention, with reference to the appended drawings.

The toner cartridge 2 in this embodiment is a so-called built-in toner cartridge, i.e., a cartridge that is installed in the cartridge installation portion of an image forming apparatus, for example, a copying machine or the like, and remains there to gradually supply developer (hereinafter, "toner") to the development chamber until the toner in the toner cartridge 2 is depleted.

Figure 7:
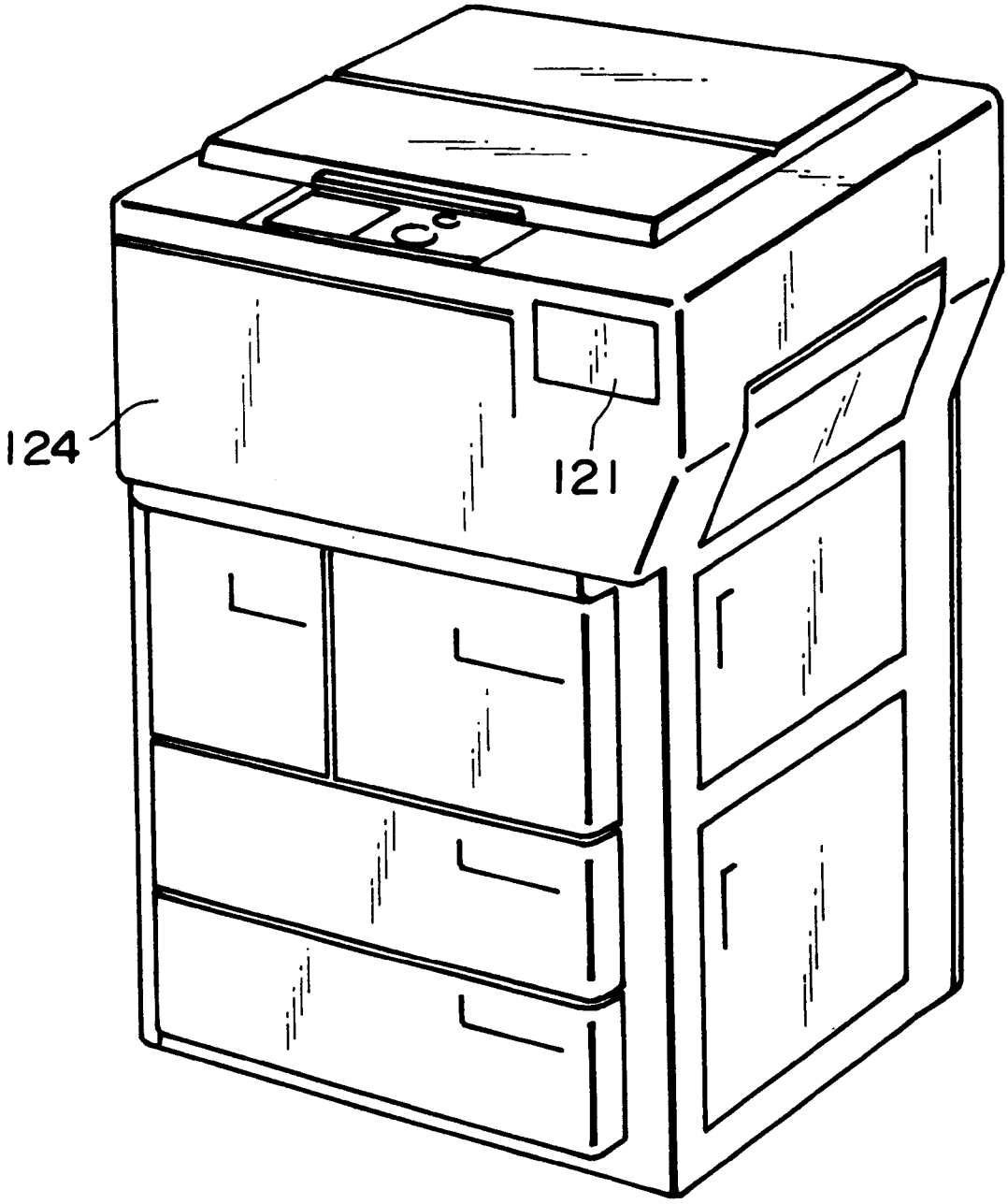
FIG. 7 is a perspective view of the main assembly of an image forming apparatus.
Figure 8:
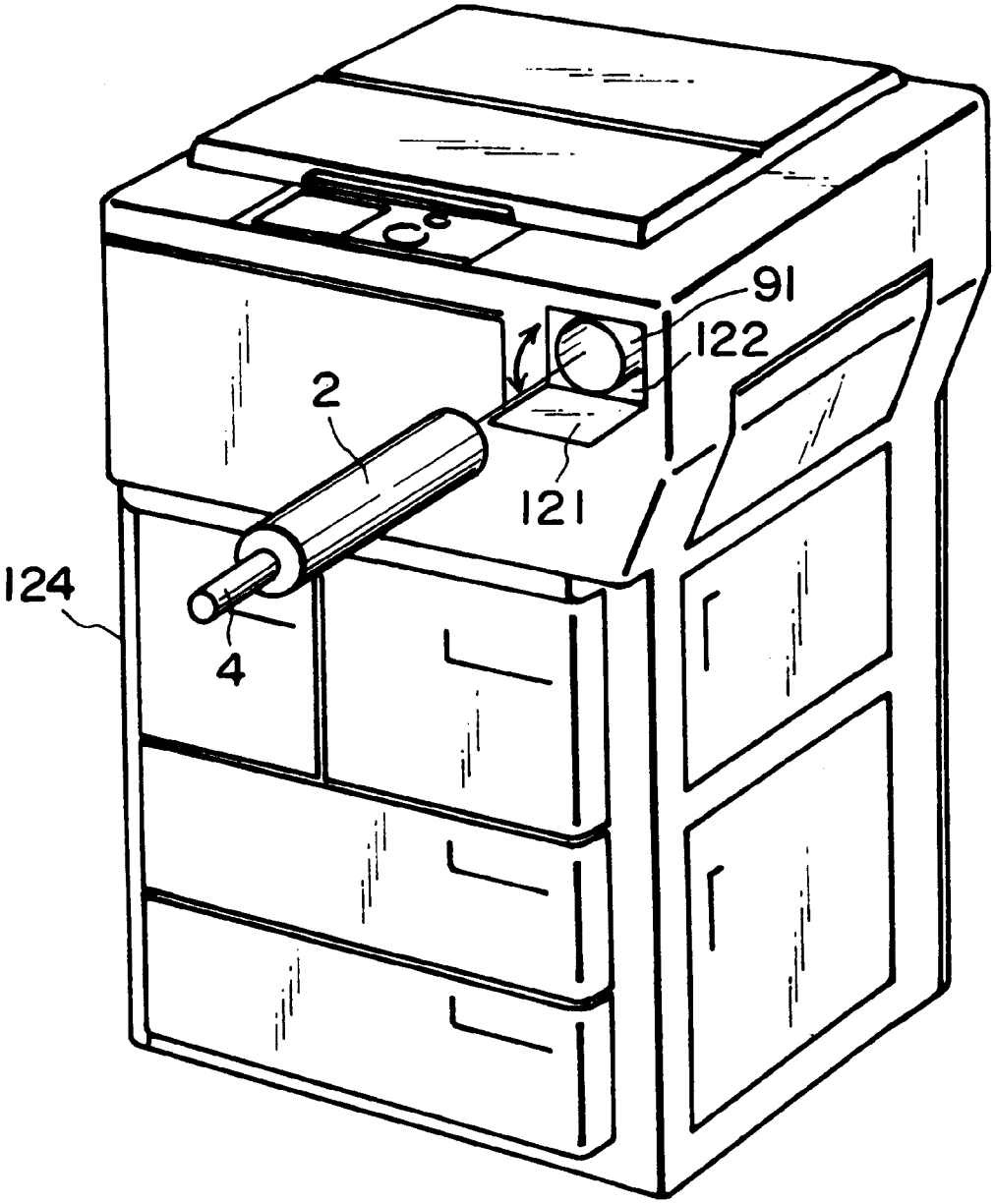
FIG. 8 is a perspective view of the main assembly of an image forming apparatus.
Figure 9:
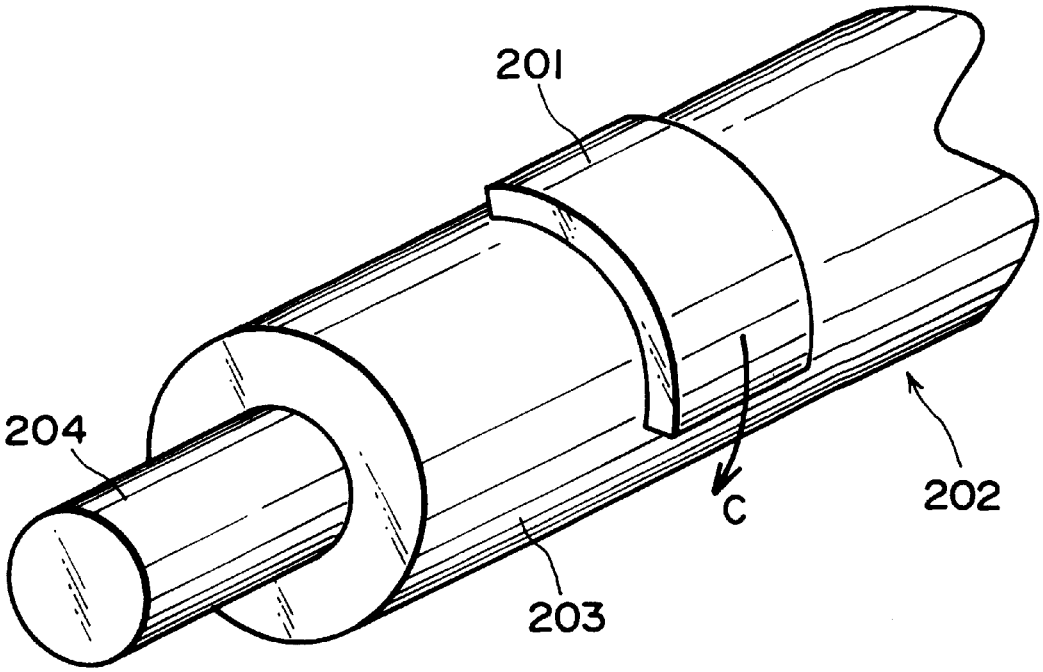
FIG. 9 is a perspective view of the shutter portion of a conventional toner cartridge.

As the toner cartridge 2 becomes empty due to the consumption of the toner therein, an operator exchanges the empty one with a fresh toner cartridge 2. Referring to FIGS. 7 and 8, in order to install a fresh toner cartridge 2, a lid 121, which is attached to the bottom edge of an opening 122 located at the top front corner of the main assembly 124 of an image forming apparatus, must be opened. As the lid 121 is opened, a holder 91 of a toner-replenishing apparatus, which is a means for removably installing the toner cartridge 2 into the main assembly 124, can be seen. As the toner cartridge 2, which is cylindrical, is inserted into the holder 91, it is guided inward of the main assembly by a guiding means, which extends in the longitudinal direction of the holder 91.

Next, the toner cartridge 2 must be turned counterclockwise. As the toner cartridge 2 is turned, a shutter 1, i.e., a movable lid, opens to allow the toner outlet 14 (FIG. 2), with which the cylindrical wall of the toner container of the toner cartridge 2 is provided, to become connected with the toner inlet 21 (FIG. 5) on the apparatus main assembly 124 side, so that the apparatus main assembly 124 side is replenished with the toner.

Next, the structures of the toner cartridge 2 and the mechanism of the shutter will be described in detail. The toner container 3 is a cylindrical sealable container, and is filled with toner. The toner within the toner container 3 is conveyed, while being stirred, and is discharged from the toner outlet 14, with which the cylindrical wall of the toner container 3 is provided, by an unillustrated stirring means and an unillustrated driving means for the stirring means. Opposing toner outlet 14, a shutter 1, as a movable member for exposing or covering the toner outlet 14, is located, and is enabled to slide on the external surface of the toner container 3. The shutter 1 prevents the toner from leaking when the toner container 3 is not within the apparatus main assembly 124. Also, the toner cartridge 2 is provided with a knob 4, which is located on the front wall of the container 3, and is gripped by an operator to handle the toner cartridge 2 during the installation of the toner cartridge 2 into the apparatus main assembly 124.

The toner cartridge 2 is provided with an elastic member 12, which is a pressure-generating member integral with the shutter 1, and is located on the front side of the shutter 1. The elastic member 12 is pressed against a projection 33, which extends in the circumferential direction of the toner container 3. With this arrangement, the shutter 1 is pressured in the direction opposite to the direction indicated by an arrow mark A by the resilient force of the elastic member 12. In other words, when the toner container 3 is not in the apparatus main assembly 124, the shutter 1 is held by the resilient force of the elastic member 12 at the position illustrated in FIG. 21. In this embodiment, the shutter 1 is formed of resin to use the elasticity of the resin to give elasticity to the elastic member 12.

The toner container 3 is entirely cylindrical. The deeper end of the holder 91 is shaped so that the deeper end of the toner container 3, in terms of the direction in which the toner container 3 is inserted into the holder 91 (the same direction as the direction X in FIG. 2), can be easily moved in contact with the holder 91 in the axial direction of the toner cartridge 2 and also can be rotationally supported by the holder 91. For example, it is cylindrical. The external force of the shutter 1 attached to the toner container 3 is provided with a curvature that matches the curvature of the cylindrical wall of the toner container 3. The shutter 1 is on the upstream side of the toner container 3 in terms of the cartridge-installation direction. The radius of a circle that corresponds to the curvature of the outwardly-facing surface of the projection 33, projection 33 being an integral part of the toner container 3 and extending in the circumferential direction of the toner container 3, is equal to the radius of a circle that corresponds to the curvature of the shutter 1.

Figure 5A:
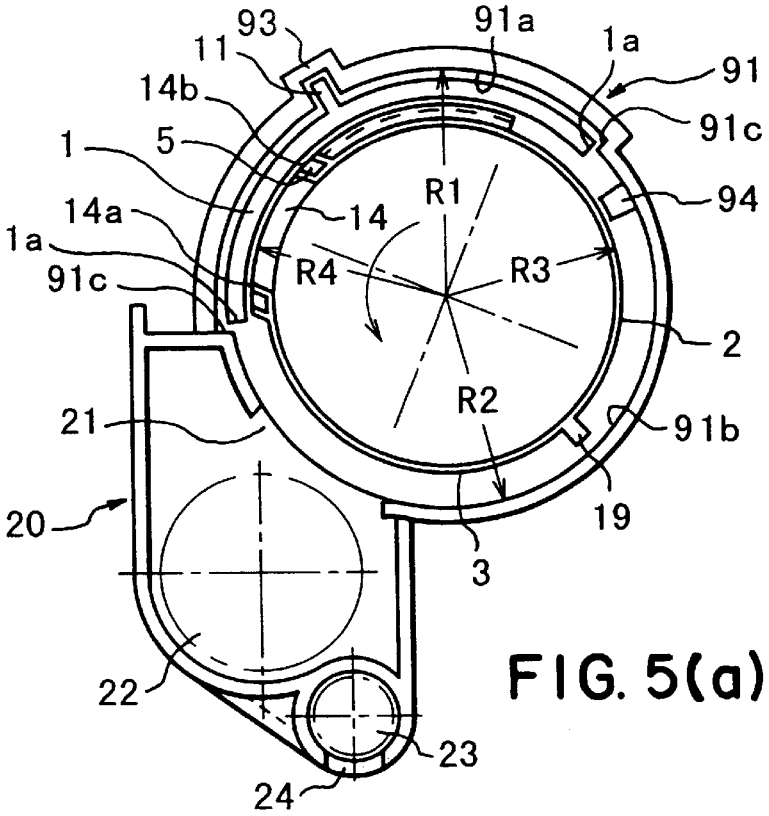
FIG. 5, (a and b) are vertical sectional views of the shutter portion and its adjacent areas, and describe the second sliding of the shutter.
Figure 5B:
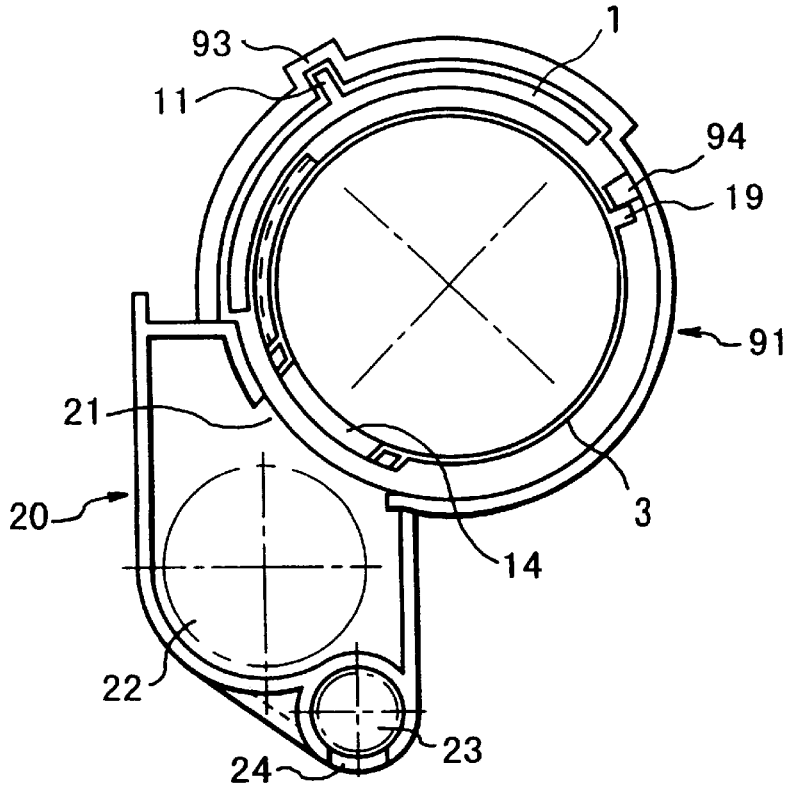
Figures 6A, 6B, 6C, 6D:
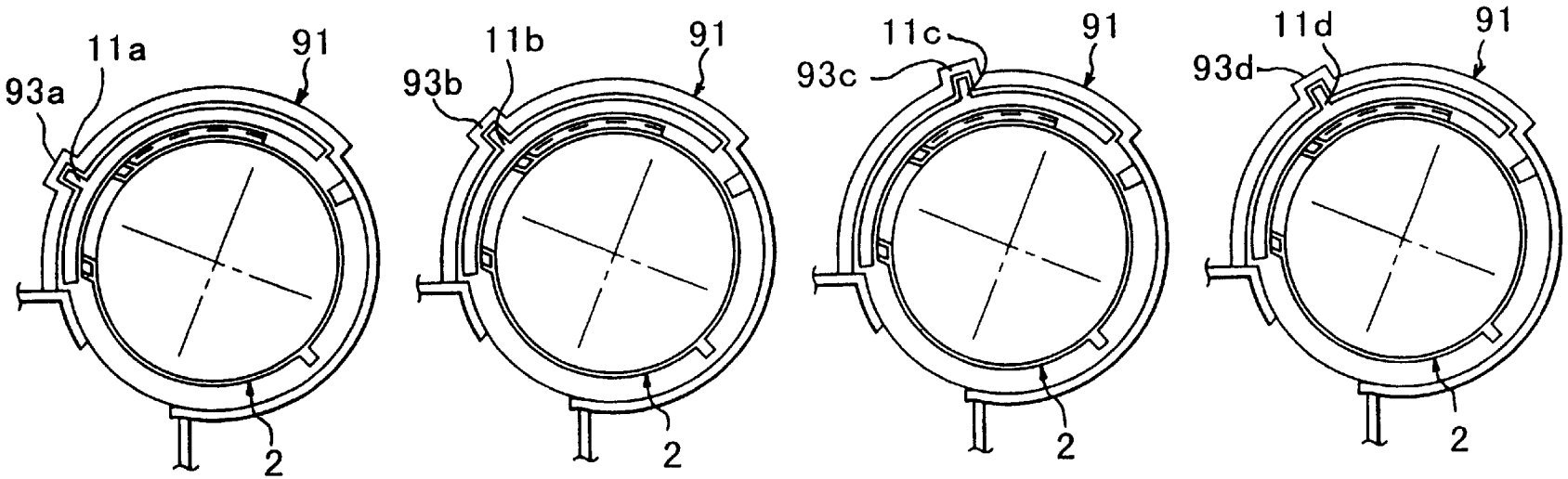
FIG. 6, (a, b, c, and d) are vertical sectional views of the toner replenishing container, and describe the uninterchangeability among the toner replenishing containers different in toner color.

Referring to FIG. 5, the wall of the entrance portion of the holder 91 of the toner-replenishing apparatus comprises two portions different in distance from the axial line of the toner container 3: a portion that accommodates the shutter 1, and a portion that does not. Referential characters R1 and R2 designate radii of the circles that correspond in curvature to the aforementioned shutter-accommodating portion and the non-shutter portion, respectively. The radius R1 is large enough to afford a slight gap between the shutter 1 and the internal surface of the holder 91. Referential characters 91*a* and 91*b* designate the internal surface of the shutter accommodating portion of the holder 91 and the non-shutter portion, respectively. The inwardly facing surface 91*a* of the shutter accommodating portion is provided with a groove 93, as a guiding member, which extends in the longitudinal direction of the holder 91, and in which a projection 11 as an engaging member of the shutter 1 slidably fits. When the gap between a surface 91*c*, which connects the two inwardly facing surfaces 91*a* and 91*b*, and the edge 1*a* of the shutter 1, is reduced to guide the shutter, the groove 93 of the holder and the projection 11 of the shutter 1 may be eliminated.

The toner outlet 14 of the toner container 3 is surrounded by a wall portion 14*a*, which projects from the outwardly-facing surface of the cylindrical wall of the toner container 3 in the radial direction of toner container 3. In terms of the radial direction of the toner container 3, the outward opening of the toner outlet 14 is located outward of the cylindrical wall of the toner container 3; in other words, the distance from the outward edge of the toner outlet 14 to the axial line of the toner container 3, which is equal to the radius R4 of a circle that is equal in curvature to the curved edge of the outward opening of the toner outlet 14, is greater than a radius R3 of the cylindrical wall (outwardly facing surface) of the toner container 3. More precisely, the wall portion 14*a* comprises two walls separated by a groove 14*b*, in which a seal 5 for sealing the gap between the shutter 1 and the cylindrical wall of the toner container 3 is fitted. The seal 5 surrounds the toner outlet 14. Therefore, when the shutter 1 is closed, the toner within the toner container 3 does not leak. The radius R4 corresponding to the outward edge of the wall 14*a* is smaller than a radius R2 of a circle that is equal in curvature to the inwardly-facing surface of the non-shutter portion 91*b* of the holder 91. A projection 19, with which the toner container 3 is provided, extends on the outwardly-facing surface of the toner container 3 in the longitudinal direction of the toner container 3 and slidably contacts the inwardly-facing surface of the non-shutter portion 91*b* of the holder 91, with its outwardly facing surface. The projection 19 is located at a point opposite to approximately the mid point between guide rails 31 and 32 as the rails on the toner container 3 side (FIG. 2), across the toner container 3.

The seal 6 may be attached to the shutter 1 as will be described later. In that case, the height of the wall 14*a* of the toner outlet 14 is reduced as depicted in FIG. 2.

Figure 2A:
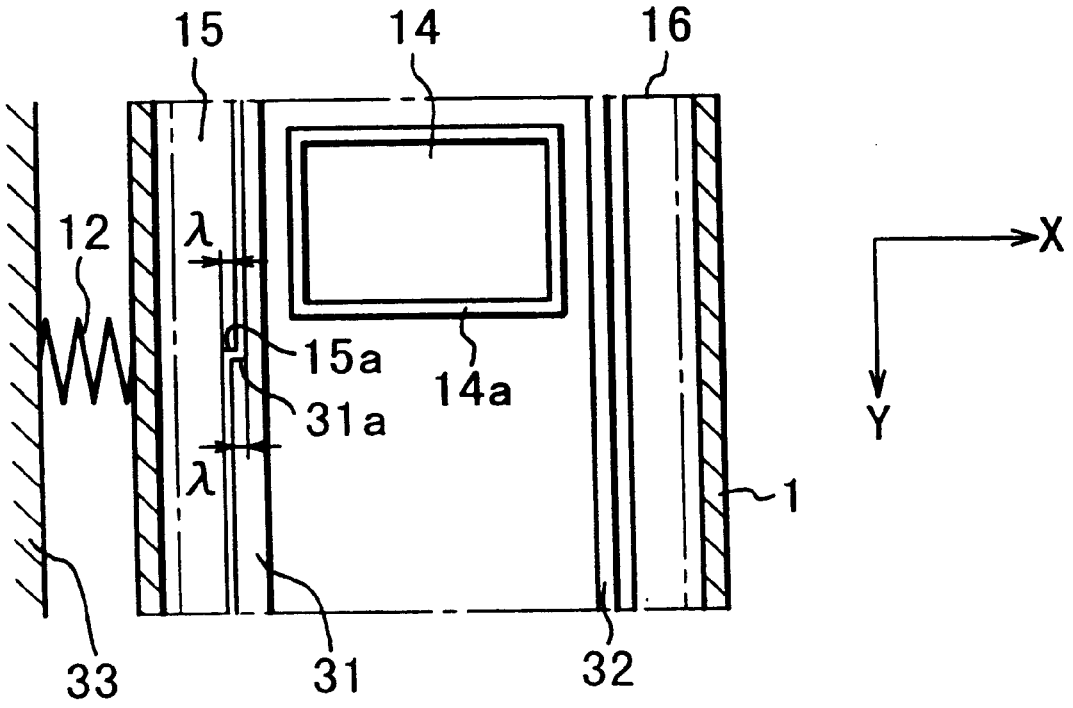
FIG. 2, (a) is a top view of the shutter portion developed in the circumferential direction of a toner replenishing container, and FIG. 2, (b) is a vertical sectional view of the shutter portion.
Figure 2B:
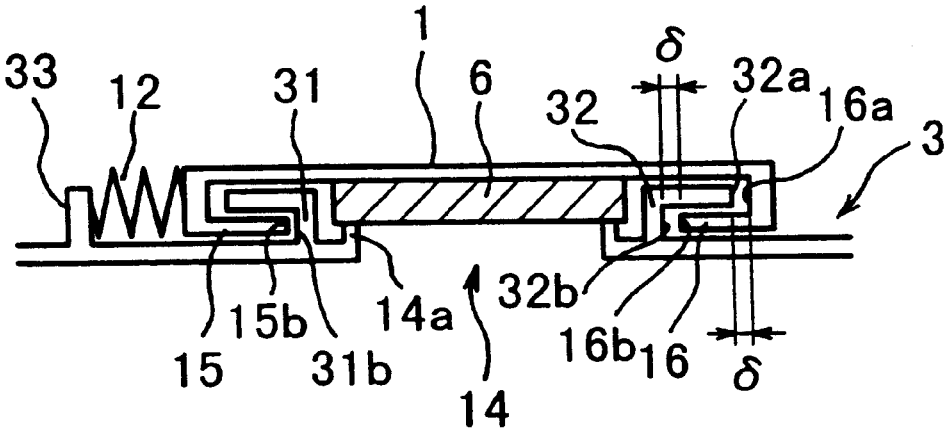

Also referring to FIG. 2, the toner container 3 is provided with guide rails 31 and 32 that extend in the circumferential direction of the toner container 3. The shutter 1 is structured so that it slides along the guide rails 31 and 32. FIG. 2 is a drawing for describing these guide rails and a pair of seals that engage the guide rails. FIG. 2, (b) is a vertical sectional view of the areas adjacent the toner outlet 14 of the toner container 3, at a plane which includes the axial line of the toner container 3 and extends in the longitudinal direction (direction X) of the toner container 3, and FIG. 2, (a) is a top plan view of the same adjacent areas as those depicted in the FIG. 2, (b), developed in the circumferential direction (direction Y) of the toner container. In FIG. 2, (a), the shutter 1 is shown in cross section.

Referring to FIG. 2, (b), the guide rails 31 and 32 are shaped like a key, in cross section; they project straight up from the cylindrical wall of the toner container 3, and bend away from the opening of the toner outlet 14 at a right angle, forming horizontal portions, one for one, which engage with the rail portion 15 and 16 with which the shutter 1 is provided. The rail portions 15 and 16 are also shaped like a key, in cross section, and engage with the corresponding horizontal portions of the guide rails 31 and 32 in a manner to loosely clasp the horizontal portions from the outward side relative to the opening. As described before, the shutter 1 is provided with the seal 6, which is formed of a material such as foamed urethane, and is pasted to the inwardly facing surface of the shutter 1. The seal 6 is placed in contact with the outward edge of the wall 14*a* of the toner outlet 14 to reliably seal the toner container 3. Referring again to FIG. 2, since the shutter 1 is pressured in the direction X in the drawing by the elastic member 12, the inwardly facing surface 15*b*, relative to the toner outlet 14, of the horizontal portion of the rail 15 of the shutter 1 remains in contact with the guide rail 31 (for descriptive convenience, the drawing is made with a slight gap between the tip and guide rail).

There are provided a gap δ between the outwardly facing surface 32*a,* relative to the toner outlet 14, of the horizontal portion of the guide rail 32 and the inwardly-facing surface 16*a* of the upright portion of the rail 16, and a gap δ between the inward-facing surface 16*b* of the horizontal portion of the rail 16 and the outwardly-facing surface 32*b* of the upright portion of the guide rail 32, so that the shutter 1 is allowed to move in the leftward direction in FIG. 2.

When there is the gap δ between the guide rail 32 and guide 16, the base portion 31*b* of the guide rail 31, i.e., the other guide rail, and the inward facing surface 15*b* of horizontal portion of the rail 15 are in contact with each other (for descriptive convenience, FIG. 2 is drawn with a slight gap between corresponding members). Referring to FIG. 2, (a), the opposing surfaces 31*b* and 15*b,* i.e., the outwardly facing surface of the upright portion of the guide rail 31 and the inward facing surface of the horizontal portion of the rail 15 have stepped portions 31*a* and 15*a,* respectively. The dimension λ of these stepped portions 31*a* and 15*a* are equal to the value δ of the aforementioned gap.

Next, referring to FIG. 3, the opening movement of the shutter 1 will be described in detail.

Figures 3A, 3B, 3C:
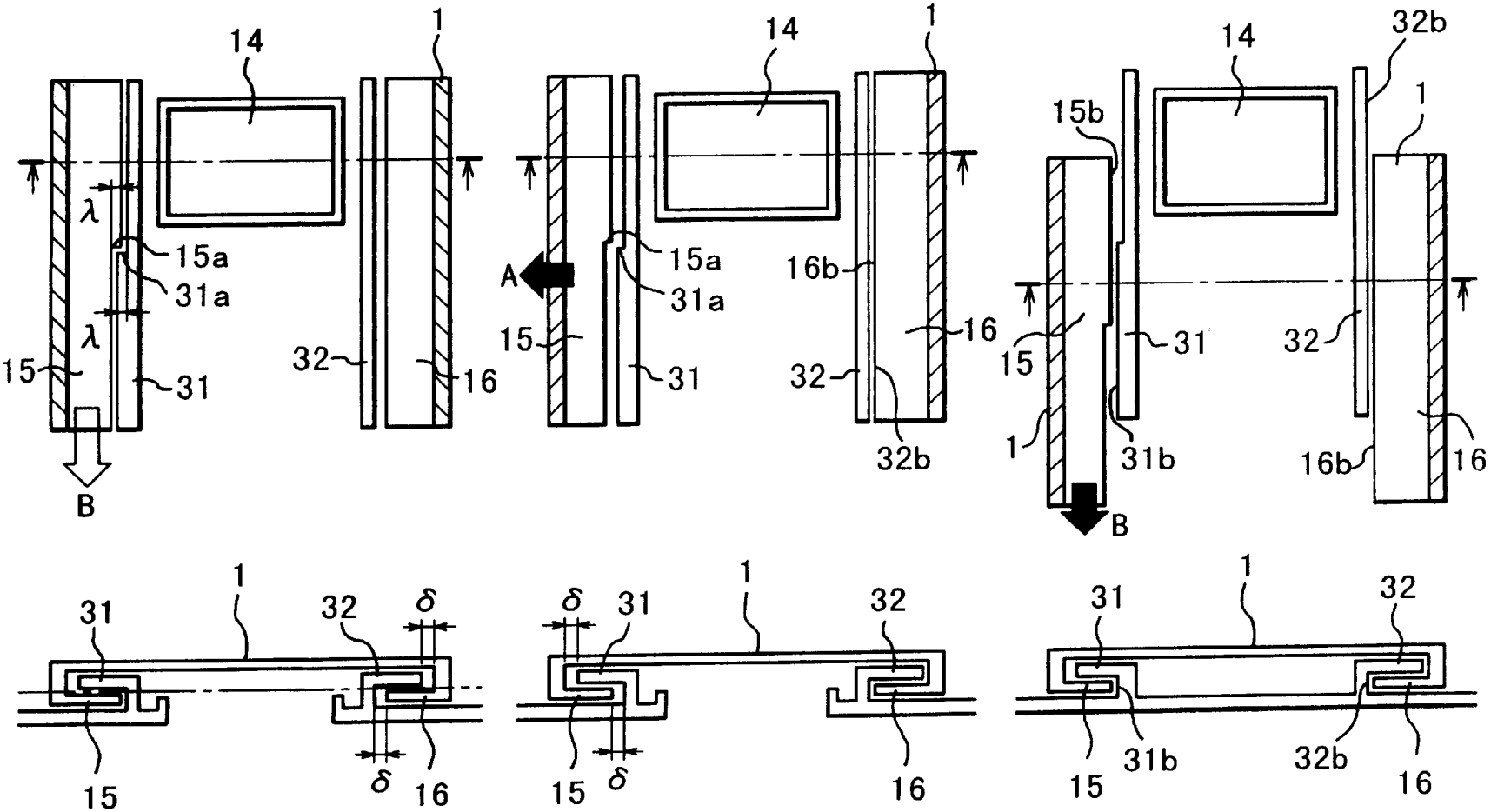
FIG. 3, (a, b and c) are combinations of a developed view of the shutter portion and a vertical sectional view of the shutter portion, and describe the shutter operation.
Figure 4A:
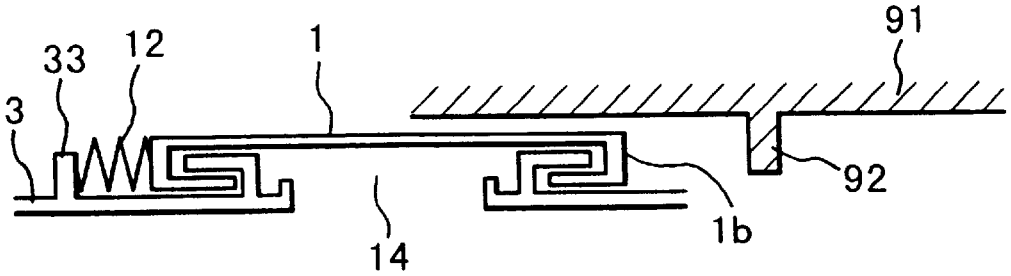
FIG. 4, (a, b, c and d) are vertical sectional views of the shutter portion, and describe the first sliding of the shutter.
Figure 4B:
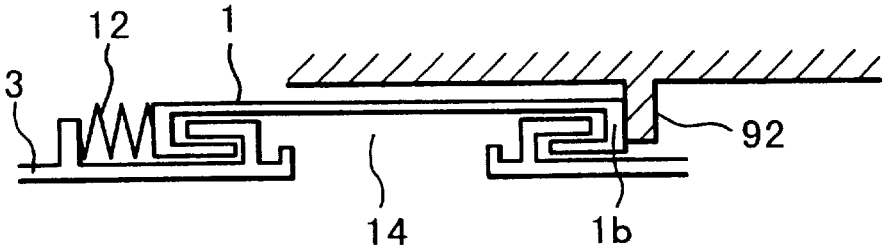
Figure 4C:
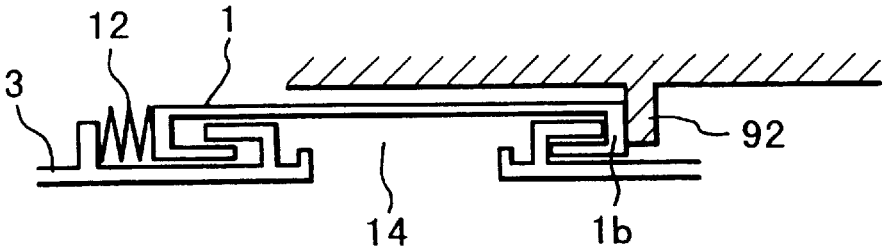
Figure 4D:
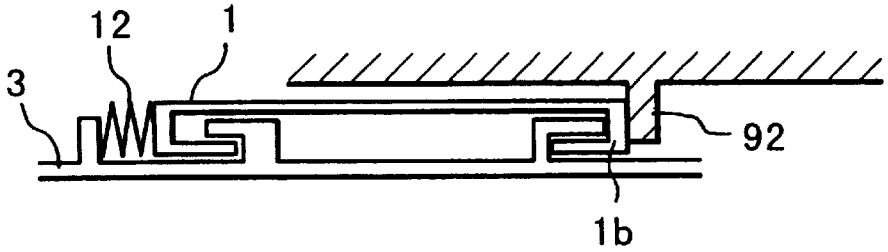

FIG. 3 shows the various states of the shutter 1. In FIG. 3, (a), the shutter 1 is closed as it is in FIG. 2, and the toner container 3 is not in the apparatus main assembly 124. FIG. 3, (b), shows the state of the shutter 1 after the first sliding step has been completed (toner container 3 has been placed at a predetermined position in the apparatus main assembly). FIG. 3, (c) shows the state of the shutter 1 during the second sliding step. In each drawing, the drawing at the top is a sectional view of the shutter 1 and its adjacent areas, developed in the circumferential direction (direction Y) as in FIG. 2, (a), at the single dot chain line in the drawing at the bottom (top drawings in FIG. 3, (a) and (b), are also sectional views at a line equivalent to the single dot chain line in the bottom drawing in FIG. 3, (a)). Also in each drawing, the drawing at the bottom is a sectional view of the shutter 1 and its adjacent areas, at a plane (indicated by the single dot chain line in the drawing at the top) that is perpendicular to the longitudinal direction X of the toner container 3.

The shutter 1 in this embodiment is structured so that unless the first sliding step (direction of an arrow mark A) is completed, the second sliding step (direction of an arrow mark B) cannot be carried out. When the shutter 1 is in the closed state as illustrated in FIG. 3, (a), stepped portions 31*a* of the guide rail 31, which has the size of λ (=δ), and the stepped portion 15*a* of the rail 15, are engaged with each other. Therefore, even if an attempt is made to move the shutter 1 in the direction B, the shutter 1 does not move. However, if the shutter 1 is slid in the direction of the arrow mark A against the elastic member 12 as shown in FIG. 3, (b), the outward-facing surface 32*b* of the upright portion of the guide rail 32 comes in contact with the inward-facing surface 16*b* of the horizontal portion of the rail 16, and at the same time, the engagement between the stepped portion 31*a* and 15*a* is broken, allowing the shutter 1 to be slid in the direction of the arrow mark B. At this moment, the gap δ on the guide rail 16 side has disappeared, and has reappeared between the guide rail 31 and rail 15 as shown in FIG. 3, (b), allowing the stepped-up edge of the rail 31 with the stepped portion 31*a* and the stepped-up edge of the rail 15 with the stepped portion 15*a* to slide against each other without any gap between them. Thus, as the shutter 1 is slid in the direction B in this state, the outward facing surfaces 31*b* and 32*b* of the upright portions of the guide rail 31 and 32 slide against the inward facing surfaces 15*b* and 16*b* of the horizontal portions of the rails 15 and 16. As a result, the toner outlet 14 appears as illustrated in FIG. 3, (c).

In the preceding paragraphs, for descriptive convenience, the opening movement of the shutter 1 was described as if the shutter 1 was opened by sliding the shutter 1 in the two different directions, on the external surface of the stationary toner container 3. However, in reality, when the toner cartridge 2 is installed into the apparatus main assembly 124, the toner container 3 moves relative to the stationary shutter 1. This movement of the toner container 3 will be next described with reference to FIGS. 4 and 5.

FIG. 4 is a sectional view of the shutter 1 and its adjacent areas, at a plane parallel to the longitudinal direction of the toner container 3, and depicts how the toner container 3 moves, relative to the shutter 1, in its longitudinal direction, i.e., the direction of the first sliding step. FIG. 5 is a sectional view of the toner cartridge 2 in the holder 91, at a plane that extends across the shutter 1, perpendicular to the axial line of the toner container 3. It depicts how the toner container 3 rotates relative to the shutter 1 in the circumferential direction of the toner container 3, i.e., the direction of the second sliding step.

In FIG. 4, the holder 91, a guiding member for guiding the toner cartridge 2, is provided with a stopper 92, which is rectangular in cross section and projects from the inwardly-facing surface of the holder 91. As the toner cartridge 2 is inserted a predetermined distance into the holder 91 (FIG. 4, (a)), the lateral surface 1*b* of the shutter 1 comes in contact with the stopper 92 (FIG. 4, (b)). Then, as the toner cartridge 2 is pushed farther into the holder 91, the shutter 1 remains stationary in contact with the stopper 92, whereas the toner container 3 moves in the first sliding step direction relative to the shutter 1 against the elastic member 12 (FIG. 4, (c)). This state, that is, the state in which the toner container 3 has slid in the first sliding step direction, corresponds to the state depicted in FIG. 3, (b). Thus, in this state, the engagement between the stepped portions 31*a* and 15*a* has been broken, allowing the toner container 3 to rotate in the second sliding step direction. Then, as the toner container 3 is rotated counterclockwise in this state, the toner outlet 14 is exposed from behind the shutter 1 (FIG. 4, (d)).

Next, referring to FIG. 5, how the toner container 3 is rotated in the second sliding step direction will be described.

Figure 1:
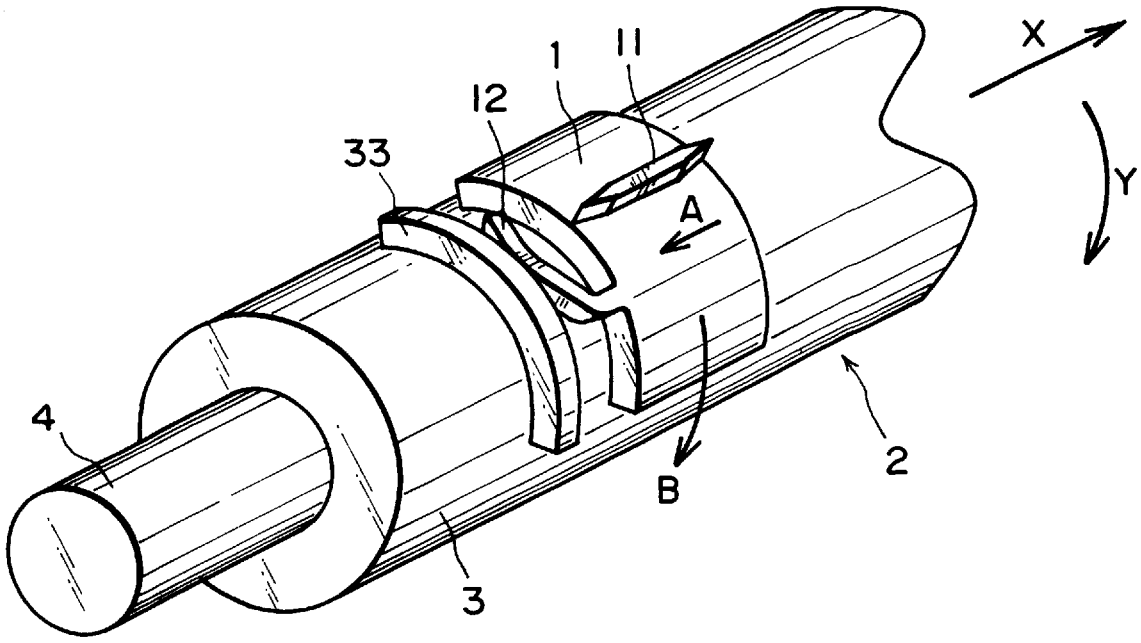
FIG. 1 is a perspective view of the shutter potion of one toner cartridge in accordance with the present invention.

The holder 91 is provided with the aforementioned groove 93 as a guiding member that extends in the longitudinal direction of the holder 91. When the toner cartridge 2 is inserted into the holder 91, the projection 11, which extends on the outwardly-facing surface of the shutter 1 in the longitudinal direction of the toner cartridge 2, fits in this groove 93. The projection 11 is tapered at its longitudinal ends as shown in FIG. 1, so that when the toner cartridge 2 is inserted into, or removed from, the holder 91, the projection 11 smoothly fits into the groove 93, which extends on the inwardly-facing surface of the holder 91 in the longitudinal direction of the holder 91. During the period from the beginning of the insertion of the toner cartridge 2 to the completion of the movement of the toner container 3 in the first sliding direction, that is, until the state of the toner cartridge 2 becomes as shown in FIG. 4, (c), the positional relationship between the shutter 1 and toner container 3 in terms of the rotational direction of the toner container 3 is as shown in FIG. 5, (a); the toner outlet 14 remains covered with the shutter 1.

In this state, as an attempt is made to rotate the toner cartridge 2 by the knob 4 in the second sliding direction, i.e., counterclockwise direction, the shutter does not move since the projection 11 remains engaged in the groove 93. Therefore, only the toner container 3 rotates in the counterclockwise direction, causing the toner outlet 14 to oppose the aforementioned toner inlet 21 opening of the sub-hopper 20 as shown in FIG. 5, (b). Also when the toner cartridge 2 is at this position, the projection 19 provided on the outwardly-facing surface of the toner container 3 is in contact with a stopper 94 provided on the inwardly-facing surface of the holder 91, preventing the toner container 3 from rotating further.

Since the projection 11 engages the groove 93 in the direction perpendicular to the circumferential direction of the toner container 3, which is the same as the second sliding direction, not only does it guide the toner cartridge 2, but also it is effective to minimize the amount of the wobbling of the toner container 3 that occurs as the guide rails 31 and 32 slide against the rails 15 and 16 in the second sliding direction., When the toner cartridge 2 is in the state depicted by FIG. 5, (b), the toner is supplied, while being stirred, to the sub-hopper 20, i.e., a toner storing portion, through the toner outlet 14 and toner inlet 21, by the stirring member 22, and then, is conveyed further by a screw 23 as a conveying means, through a toner outlet 24, to an unillustrated developing apparatus.

As described above, when a toner cartridge 2 is handled by itself, outside the apparatus, the shutter 1 cannot be slid in the direction of the arrow mark B unless it is first slid in the direction of the arrow mark A. Therefore, it is possible to prevent an accident in which the shutter 1 inadvertently opens to allow the toner to leak and contaminate the surrounding area. On the other hand, when the toner cartridge 2 is inserted into the apparatus main assembly 124, the operation to move the shutter 1 in the first sliding direction is automatically completed by an operator as the operator inserts the toner cartridge 2, leaving one more simple step, i.e., the counterclockwise rotation of the toner container 3 by the knob 4, to be carried out to finish the installation.

In order to pull out the toner cartridge from the apparatus main assembly 124, the above-described installation steps must be reversely carried out. That is, first, the toner container 3 must be rotated clockwise by the knob 4, and pulled toward the front of the apparatus. As the toner container 3 is pulled toward the front, the shutter 1 and toner container 3 move relative to each other in the first sliding direction due to the resiliency of the elastic member 12, causing the shutter 1 return to its original place.

In the case of an apparatus that employs multiple toners with different color, the toner cartridges, which are different in toner color, can be prevented from being installed into the wrong spots, by making the toner cartridges different in the positions of the projection (11*a*–11*d*) and groove (93*a*–93*d*) in terms of the circumferential direction of the toner cartridges.

In this embodiment, the first sliding direction is the same as the direction in which the toner cartridge 2 is inserted into the apparatus main assembly 124. However, the seal may be formed of compressible elastic material, and the rail pairs may be provided with a stepped portion that allows the rail pairs to be disengaged by pressing down the shutter in the radial direction of the toner cartridge 2. In this case, it is feasible to configure the apparatus main assembly 124 so that as the toner cartridge 2 is pushed into the apparatus main assembly 124, the shutter is pressed down by a projection, for example, a directly acting cam or the like, provided on the apparatus main assembly side.

In this embodiment, the toner container is entirely cylindrical, and there is no stepped portion across its entire length. However, a toner cartridge may be in any shape as long as it can be inserted into the holder of a toner-replenishing apparatus, and can be slid in both the first and second directions in the holder. For example, an image forming apparatus may be configured so that a toner container comprises two cylindrical portions: a leading end portion, in terms of the inserting direction of the toner container, and a trailing end portion, the former being smaller in diameter than the latter. A holder comprises supporting portions which support one for one the leading and trailing cylindrical portions of the toner container in a manner to allow the toner container to move in its circumferential direction as well as its longitudinal direction (no illustration).

Next, another embodiment of the present invention, a combination of a toner-replenishing container, and a toner-replenishing apparatus, which is disposed in the main assembly of an image forming apparatus, and in which a toner-replenishing container is removably installable, will be described. In the preceding embodiment, in order to slide the shutter, relative to the toner container, in the circumferential direction of the toner container, the toner container was rotated without moving the shutter. In this embodiment, however, the toner container is not moved, and instead, the shutter is rotated.

(Electrophotographic Image Forming Apparatus)

Figure 37:
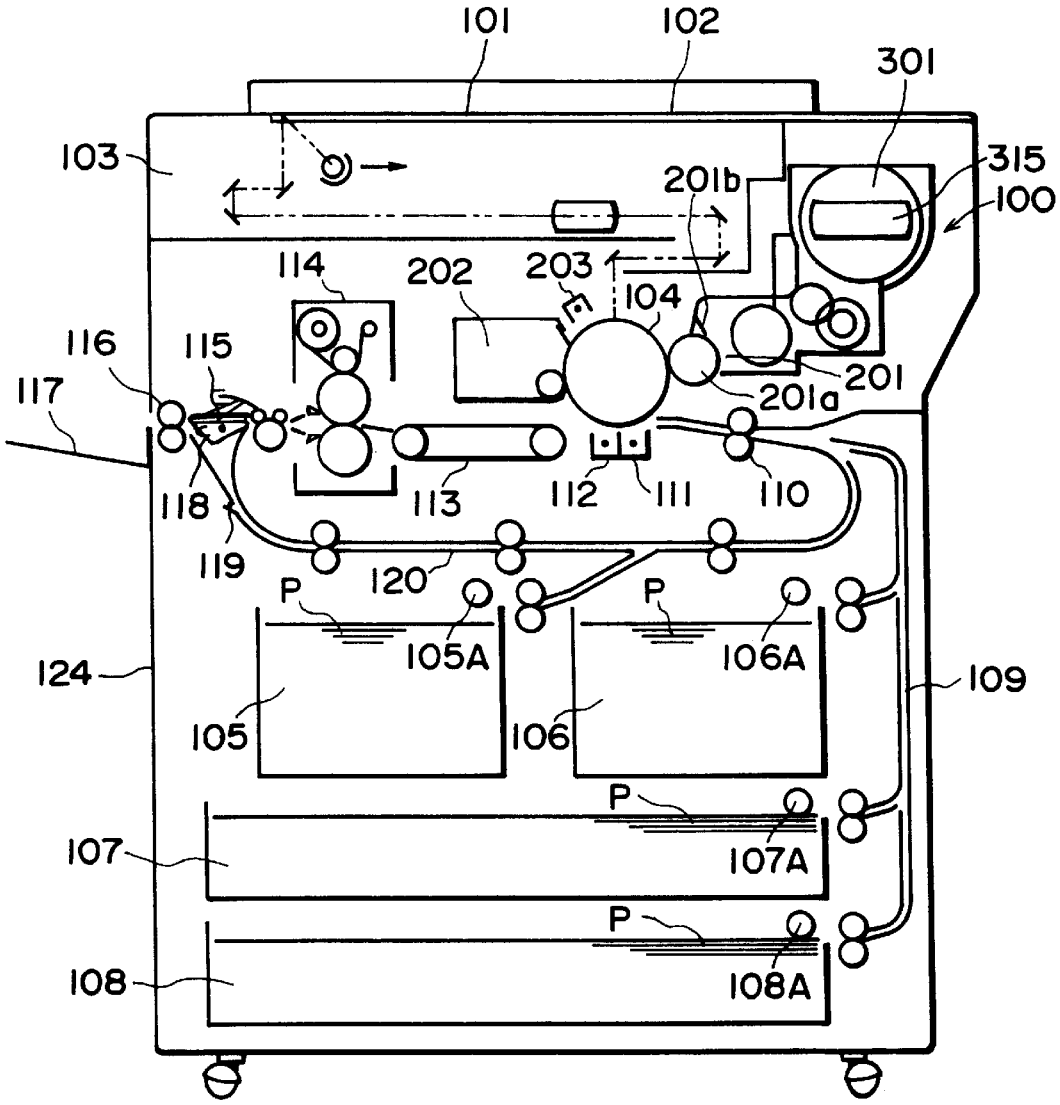
FIG. 37 is a vertical section of an electrophotographic image forming apparatus.

FIG. 37 is a vertical sectional view of an electrophotographic image forming apparatus in which a toner-replenishing container in accordance with the present invention has been installed.

An original 101 is placed on a glass plate 102 for an original, by an operator. As a result, an optical image that reflects the original 101 is formed on a photosensitive drum 104 as an image bearing member by the plurality of mirrors and lenses which an optical portion 103 comprises. Meanwhile, one of the feeder cassettes 105–108 in which recording media P are stored in layers is selected on the basis of the sheet-size information inputted through a control panel (unillustrated) by the operator. Then, among the feeder rollers 105A–108A, the roller of the selected feeder cassette is rotated to feed out a single sheet of recording medium P. After being fed out of the feeder cassette, the recording sheet P is conveyed to a registration roller 110 through a conveyance path 109. The registration roller 110 conveys the recording sheet P to the photosensitive drum 104 in synchronism with the rotational timing for the photosensitive drum 104 and the scanning timing for the optical portion 103. To this recording sheet P, the toner image on the photosensitive drum 104 is transferred by a transferring means 111. Thereafter, the recording sheet P is separated from the photosensitive drum 104 by a separating means 112. Then, the recording sheet P is conveyed to a fixing portion 114 by a conveying portion 113. In the fixing portion 114, the toner image on the recording sheet P is fixed to the recording sheet P with the application of heat and pressure.

Next,

1) In the single side copy mode, the recording sheet P is discharged into a delivery tray 117 by a discharge roller pair 16 through a reversing path 115.
2) In the multiple-layer mode, the recoding sheet P is directed toward conveying portions 119 and 120 by a flapper 118 of the reversing path 115, and is conveyed to the registration roller 110. Thereafter, the recording sheet P is passed through the image forming portion, the conveying portion, and the fixing portion as it was in the immediately preceding image formation cycle, and then, is discharged into the delivery tray 117.

3) In the two-sided copy mode, the recording sheet P is passed through the reversing path 115, and is partially extended outward of the apparatus by the discharge roller pair 16 until its trailing edge passes the flapper 118. Then, as soon as the trailing edge of the recording sheet P passes, the discharge roller pair 116 is rotated in reverse to convey the recording sheet P back into the apparatus. Thereafter, the recording sheet P is conveyed to the conveying portions 119 and 120, and to the registration roller 110. Then, it is passed through the image forming portion, the conveying portion, and the fixing portion as it was in the immediately preceding image forming cycle, and is discharged into the delivery tray 117.

In an electrophotographic image forming apparatus structured as described above, a developing apparatus 201, a cleaning means 202, and a primary charging means 203 are disposed around the photosensitive drum 104. The developing apparatus 201 develops, with the use of toner, an electrostatic latent image formed on the photosensitive drum 104. A toner replenishing device 1 for replenishing the developing apparatus 201 with toner is removably installed in the apparatus main assembly 124.

The developing apparatus 201 comprises a development roller 201*a* that maintains a microscopic gap (approximately 300 $\mu$m) from the photosensitive drum 104. During development, a thin layer of toner is formed on the peripheral surface of the development roller 201*a* by the development blade 201*b*. Then, as development bias is applied to the development roller 201*a*, and the electrostatic latent image, which has been formed on the photosensitive drum 104, is developed.

The charging means 203 is a means for charging the photosensitive drum 104. The cleaning means 202 is a means for removing the toner that remains on the photosensitive drum 104. The reduction in the amount of toner in the developing apparatus 201 caused by development is compensated for by a fresh supply of toner gradually delivered by a toner-replenishing apparatus 100.

Here, the exchanging of the toner-replenishing container 301 will be described.

Figure 38:
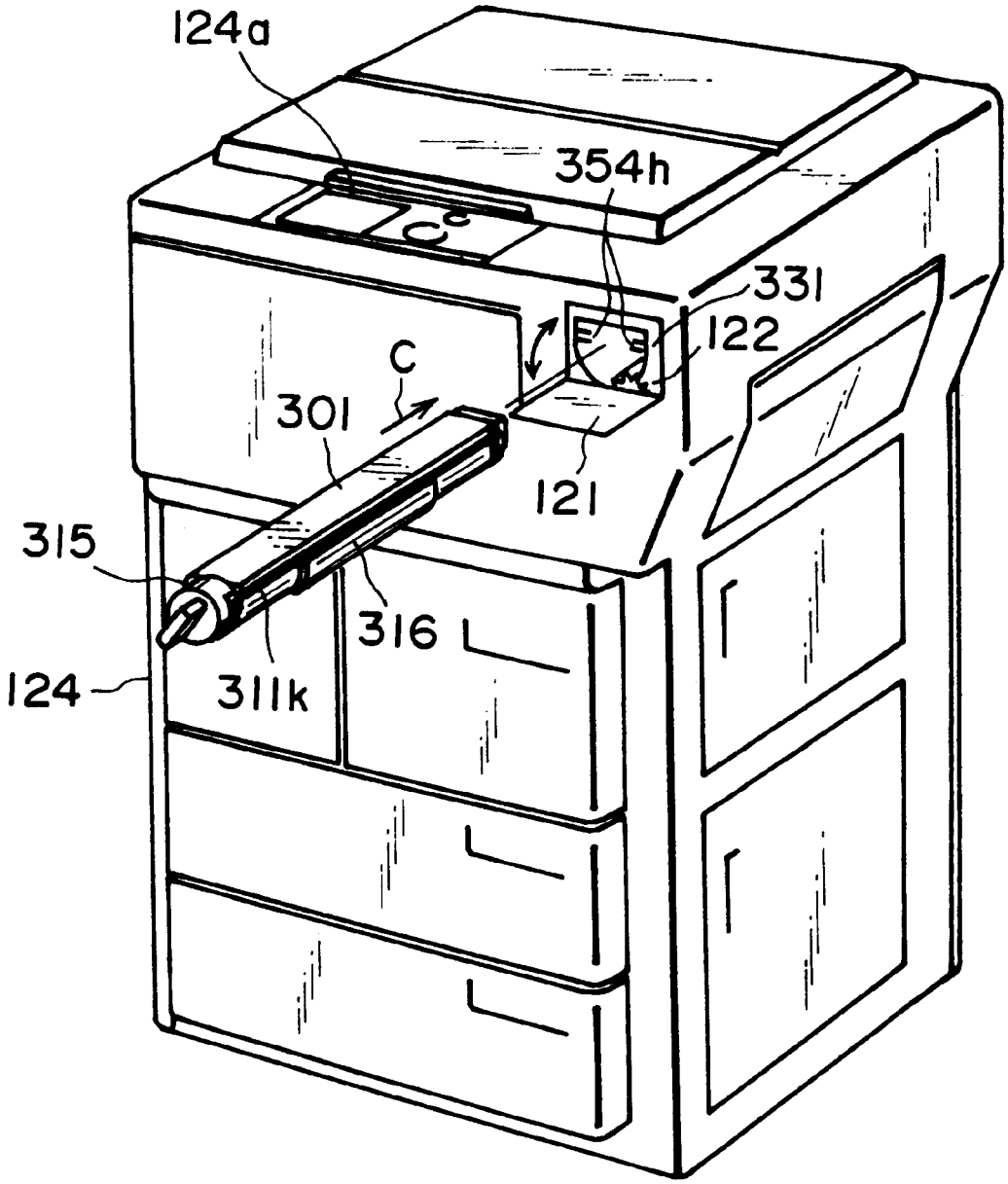
FIG. 38 is a perspective view of an electrophotographic image forming apparatus.
Figure 39:
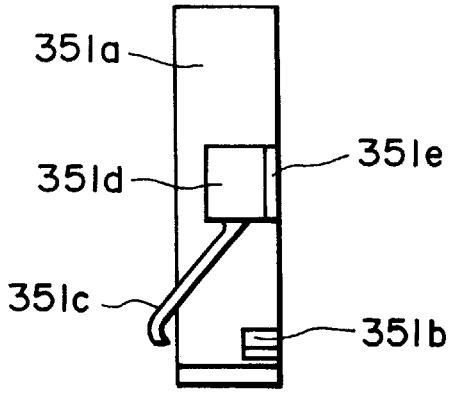
FIG. 39 is a side view of a handle-locking member.
Figure 40:
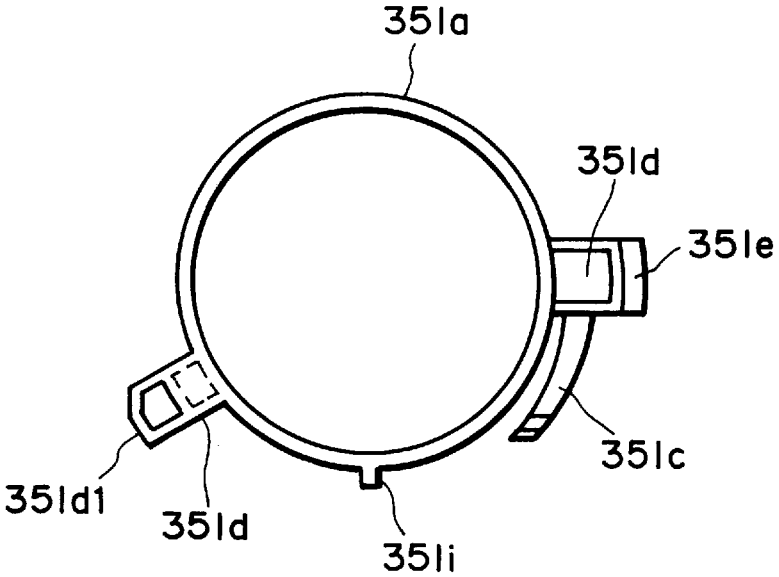
FIG. 40 is a front view of the handle-locking member.
Figure 41:
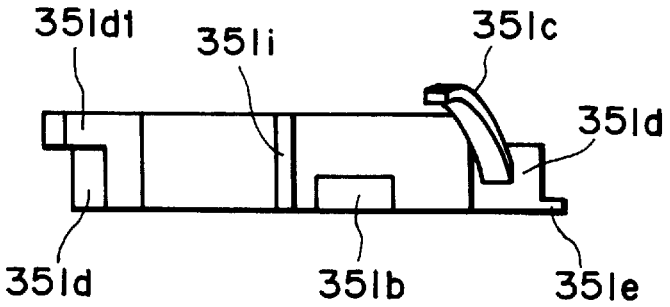
FIG. 41 is a bottom view of the handle-locking member.

As the toner within the toner-replenishing apparatus 100 is depleted, the exhaustion of the toner is reported to a warning section 124*a*. Then, an operator opens the lid 121, which covers the opening 122 with which the main assembly 124 is provided, as shown in FIG. 38. Inside the opening 122, a holder 331 (installing means, more specifically, main assembly 354 of the toner replenishing apparatus) in which the toner-replenishing container 1 is removably installable is provided. Into this holder 331, the toner-replenishing container 301 is inserted in its longitudinal direction. During this operation, the toner-replenishing container 301 is guided in its longitudinal direction by a guide, with which the holder 331 is provided, and which extends in the longitudinal direction of the holder 331, until the leading end of the toner-replenishing container 301 reaches a predetermined point. Then, as the operator rotates the handle 315 of the toner-replenishing container 301 after the leading end of the toner-replenishing container 301 reaches the predetermined point, the toner within the toner-replenishing container 301 is supplied to the developing apparatus 201. Then, as the operator closes the lid 121, the power switch is turned on, readying the image forming apparatus for image formation.

Figure 21:
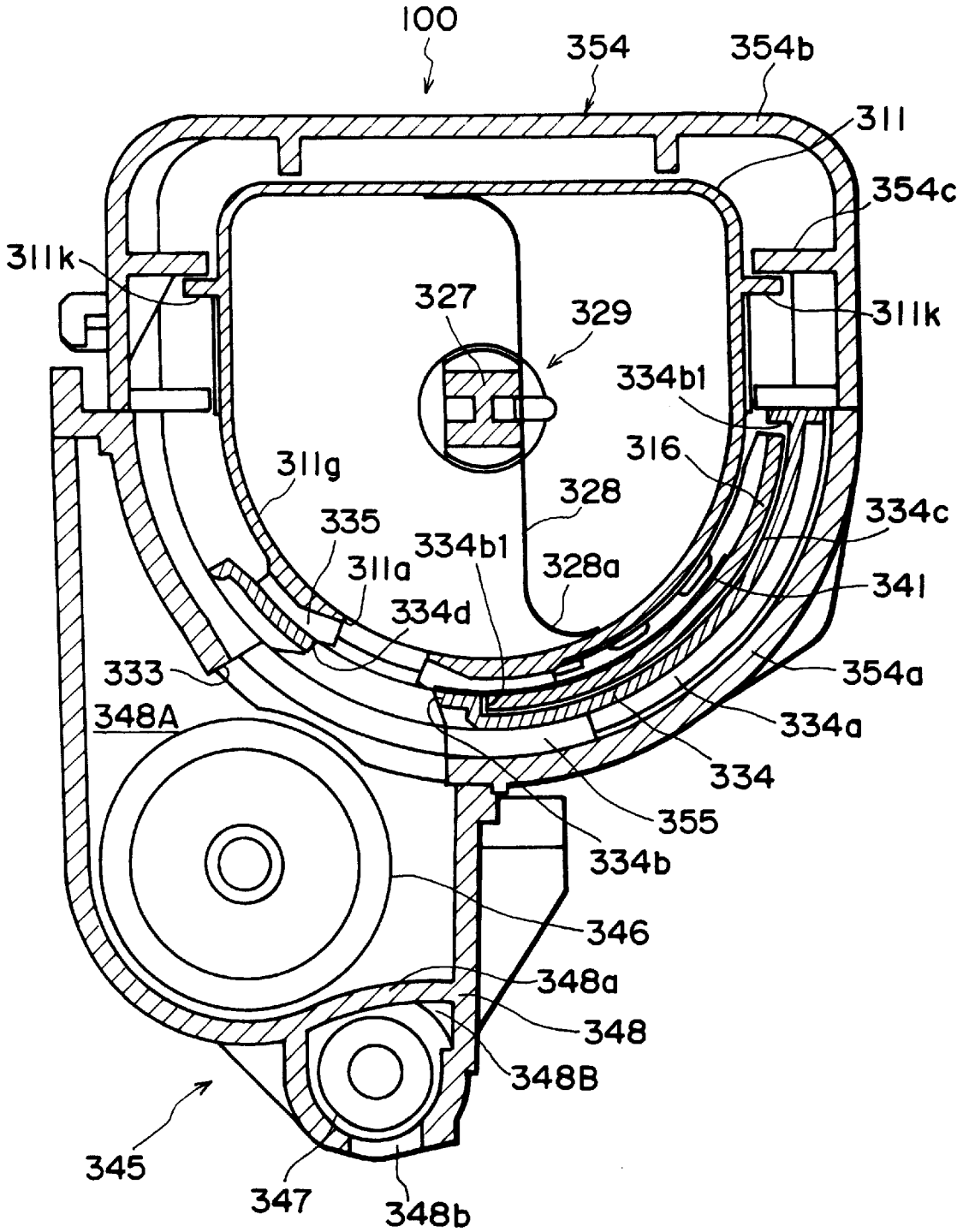
FIG. 21 is a sectional view of the front portion of the toner-replenishing container (shutter is closed).

More specifically, as a signal which indicates that the amount of the toner in the developing apparatus 201 has become too small is sent out by a sensor (unillustrated) in the developing apparatus 201, toner-conveying screws 346 and 347, illustrated in FIG. 21, rotate. As a result, the toner within a case 348 is gradually supplied to the developing apparatus 201. Then, as the amount of the toner within the developing apparatus 201 reaches a predetermined level, the toner-conveying screws 346 and 347 stop. This process is repeated. Eventually, the amount of the toner within the case 348 becomes too small. Then, a signal that indicates that the amount of the toner within the case 348 has become too small is sent out by a sensor (unillustrated) within the case 348. As a result, a conveying member 329 (which will be described later) within the toner replenishing container 301 rotates to send the toner into the case 348. Then, as the amount of the toner within the case 348 reaches a predetermined level, the conveying member 329 stops. The process is repeated. If the toner is not supplied even though the sensor within the case 348 sends out the aforementioned signal, a message that suggests the exchange of the toner-replenishing container 301 is displayed by the warning section 124*a*.

(Toner Replenishing Container)

Figure 10:
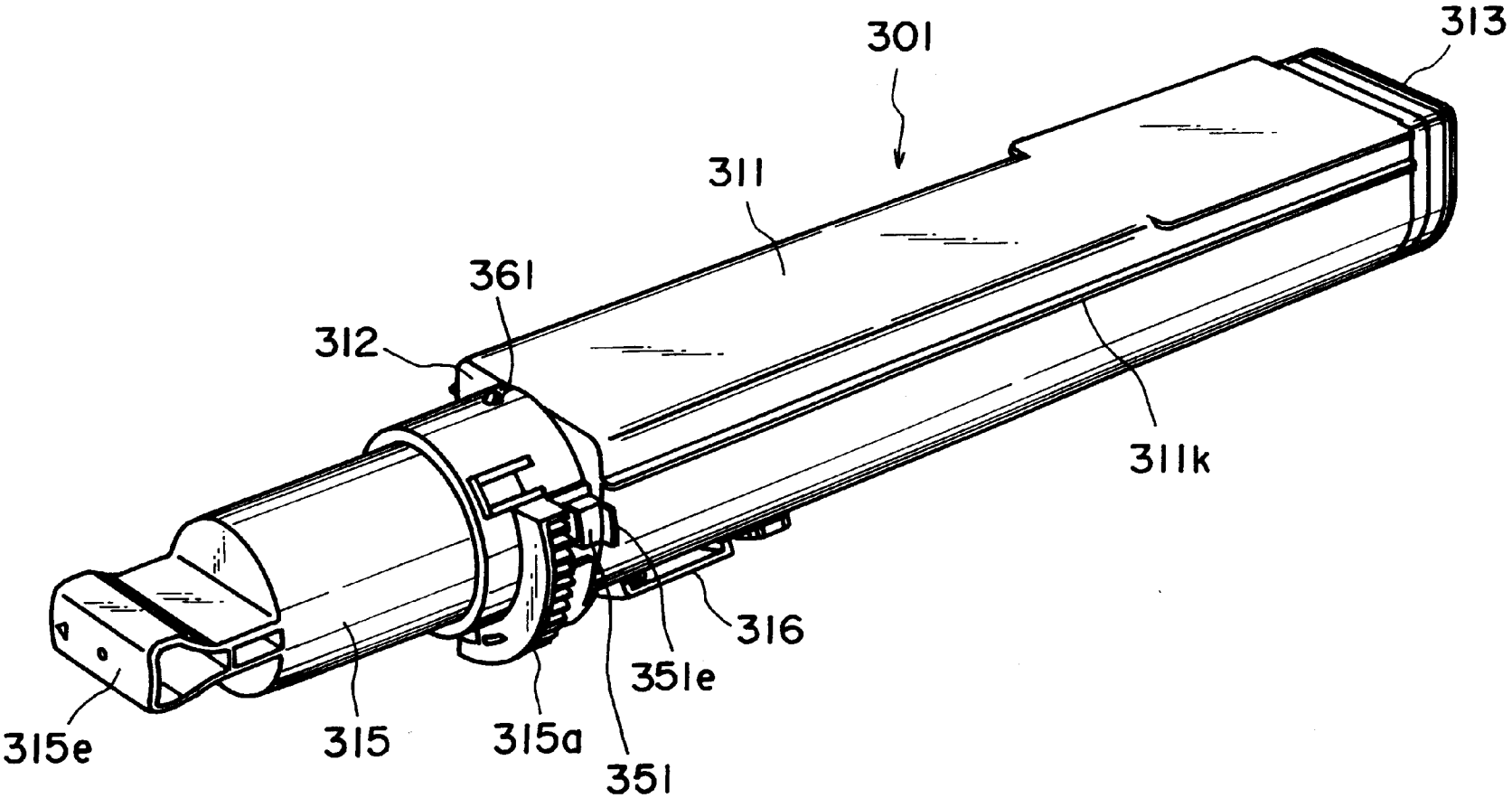
FIG. 10 is a perspective view of the toner replenishing container as seen from the upstream side in terms of the inserting direction.
Figure 11:
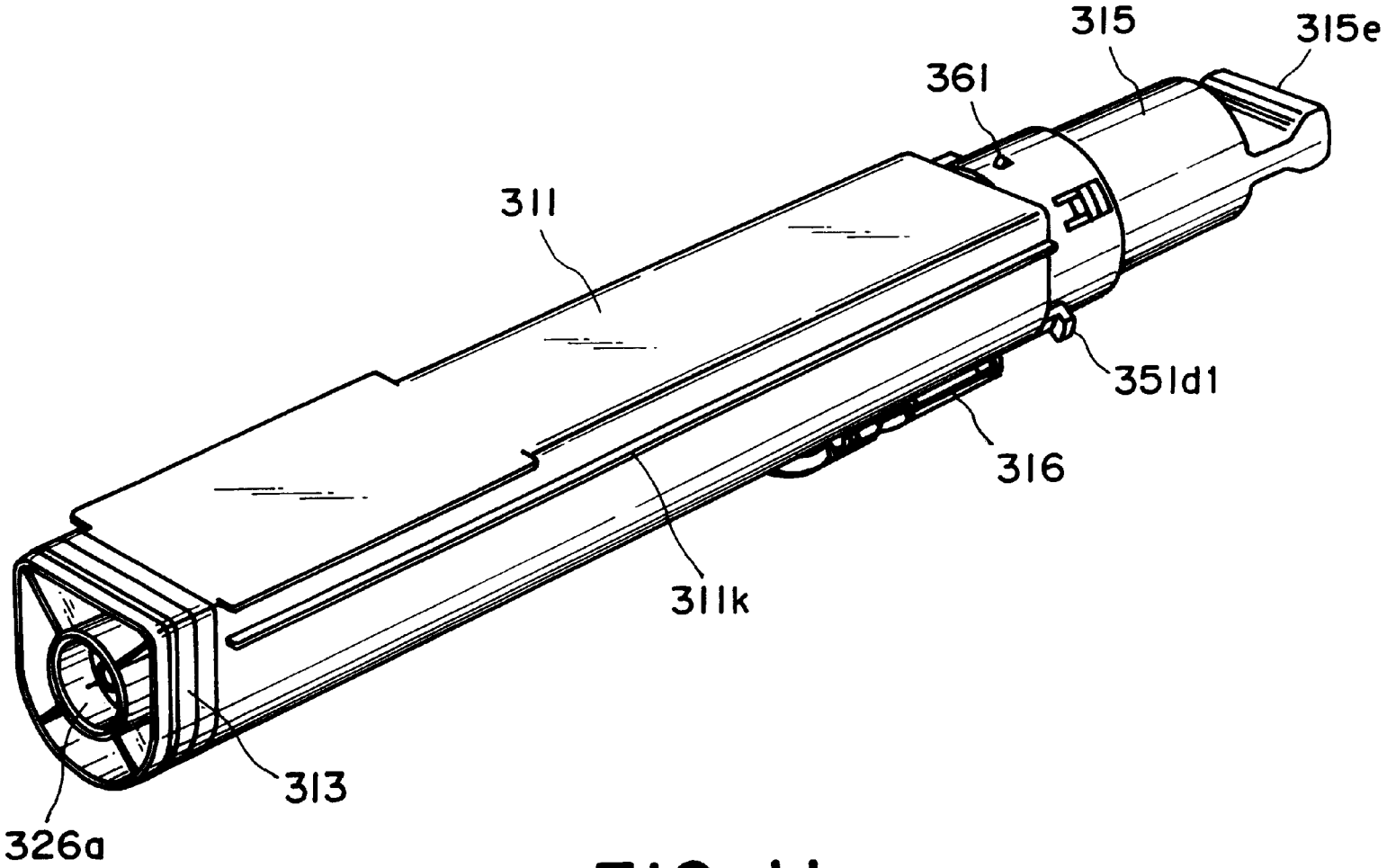
FIG. 11 is a perspective view of the toner replenishing container as seen from the downstream side in terms of the inserting direction.

The toner-replenishing container 301 in this embodiment (FIGS. 10–12) is installed in the toner replenishing apparatus 100 in an image forming apparatus, and is left there so that the toner within the toner-replenishing container 301 is gradually supplied to the development station until the toner within the toner replenishing container 301 is depleted. In other words, it is of the so-called built-in type. However, the present invention does not require that the type of the toner-replenishing container 301 is limited to the one described above; the present invention is also applicable to, for example, a toner-replenishing container of the so-called integral type, which not only holds toner but also supplies it to the development station.

Figure 13:
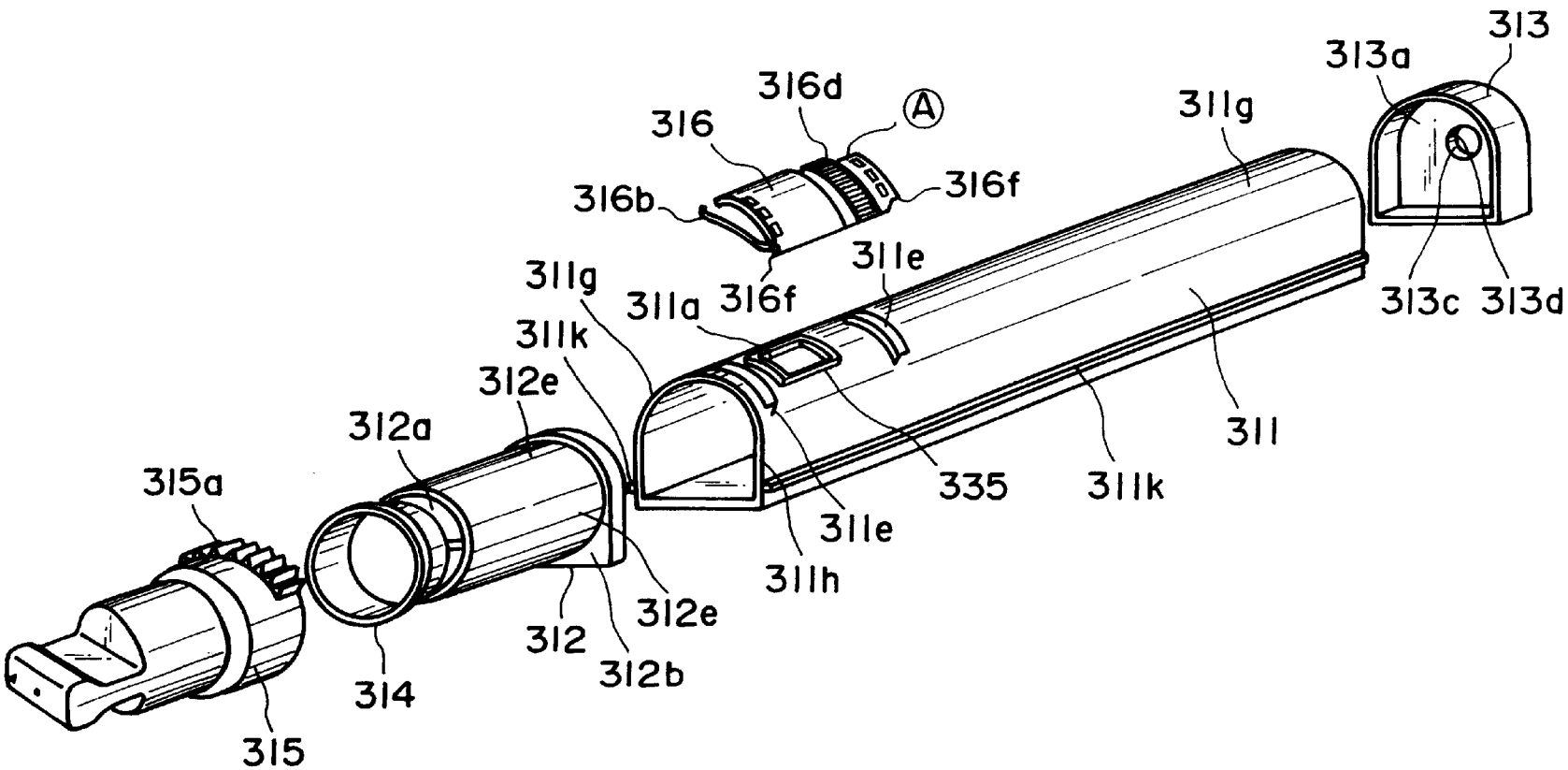
FIG. 13 is a schematic exploded perspective view of the toner replenishing container.
Figure 14:
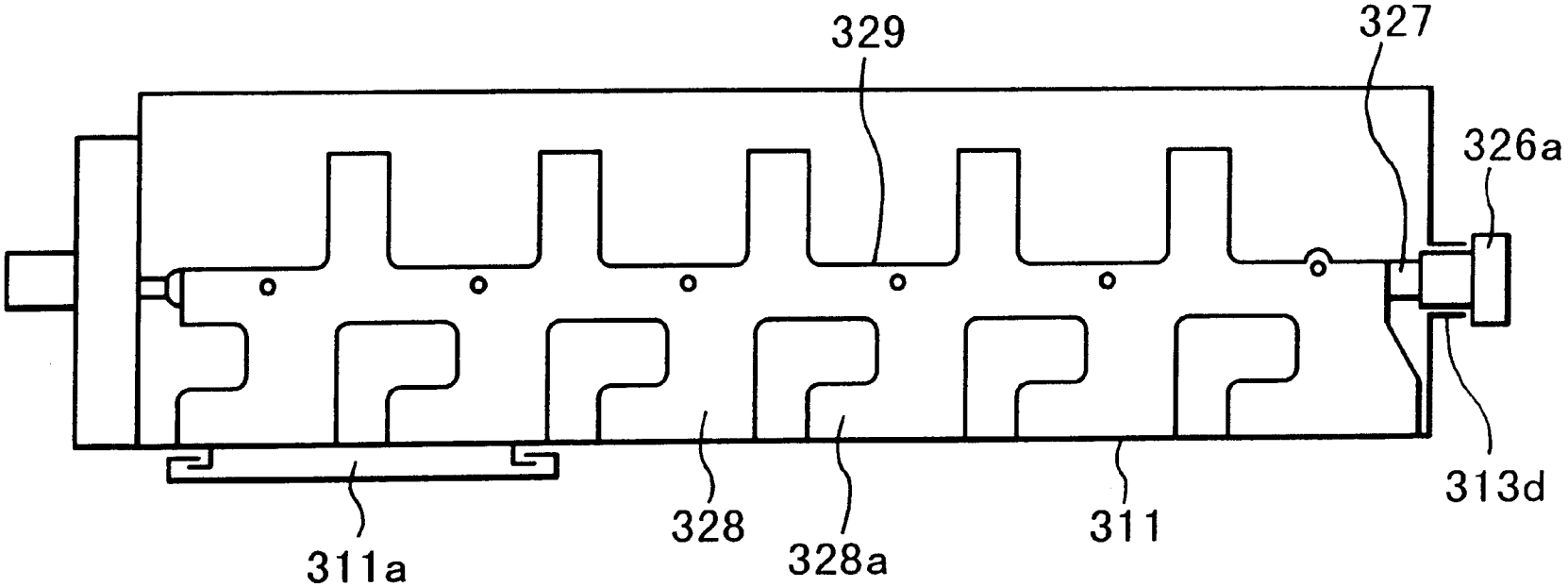
FIG. 14 is a schematic vertical section of the toner replenishing container.

Referring to FIG. 13, a schematic exploded view of the aforementioned toner-replenishing container 301, the toner-replenishing container 301 has a toner container 311, which is a toner storing portion, and first and second flanges 312 and 313, respectively, which are attached to the corresponding longitudinal ends of the toner container 311. It also has a cap 314 that is inserted into the first flange 312, and a handle 315, which is rotationally fitted around the next flange 312. Further, it has a container shutter 316 that exposes or covers the toner outlet 311*a* of the toner container 311. Within the toner container 311, a toner-conveying member 329 is disposed as a toner-conveying means (FIG. 14).

(Toner Container)

Referring to FIG. 13, the toner container 311 is shaped so that its cross section perpendicular to its longitudinal direction becomes a combination of an approximately semicircular portion 311*g* and a rectangular portion 311*h*. It is in the form of a hollow tube with the above-described cross section, and the toner is stored within this toner container 311. The toner container 311 is provided with a toner outlet 311*a*, which is in the curved wall portion of the toner container 311. The toner container is also provided with a pair of shutter-supporting members 311*e*, which are located on the curved-wall portion of the toner container 311, one on the front side of the toner outlet 311*a* and the other on the rear side, in terms of the longitudinal direction of the toner container 311, and extend in the circumferential direction of the toner container 311. The container shutter 316 is supported by the supporting members 311*e* so that the container shutter 316 can take a closing position (FIG. 20) at which the container shutter 316 seals the toner outlet 311*a,* or an exposing position (FIG. 21) to which the container shutter 311 retreats to expose the toner outlet 311*a.*

Further, the toner container 311 is provided with a pair of guiding portions 311*k,* which run in the longitudinal direction of the toner container 311 along the lateral longitudinal edges of the toner container 311. These guiding portions 311*k* are members that regulate the toner-replenishing container 301 so that the toner-replenishing container 301 moves in a straight line when the toner-replenishing container 301 is installed into, or removed from, the toner-replenishing apparatus 100.

As described above, in this embodiment, the toner container 311 is in the form of a tube, the cross section of which is such that its top half is semicircular and its bottom half is rectangular. However, the shape of the toner container 311 does not need to be limited to the above-described one. For example, the toner container 311 may be shaped so that its cross section perpendicular to its longitudinal direction is circular, elliptical, or square. Further, there is no specific restriction regarding the structure and component count of the toner container 311.

The toner container 311 is filled with toner in the powder form (hereinafter, all toners are in the powder form). There are various classifications of toner: black toner, color toner, single component magnetic toner, single component non-magnetic toner, and the like. From among these various classifications of toners, toner is selected as appropriate.

(Structures of First and Second Flanges 312 and 313)

The first and second flanges 312 and 313 are in the form of a hollow tube, which exactly fits into the corresponding longitudinal ends of the toner container 311. After being exactly fitted into the corresponding longitudinal ends of the toner container 311, they are fixed to the toner container 311 with the use of adhesive to seal the toner container 311. The first flange 312 comprises an end plate 312*b* and a cylindrical portion 312*e.* The axial line of the cylindrical portion 312*e* coincides with the longitudinal center line of the cylindrical portion 311*g* of the toner container 311. The first flange 312 comprises a toner inlet 312*a,* which runes within the cylindrical portion 312*e.* The second flange 313 comprises an end plate 313*a.*

The first and second flanges 312 and 313 may be integral with the toner container 311, or a part of the toner container 311. In other words, the main section of the toner container 311 may be a single piece component.

Figure 45:
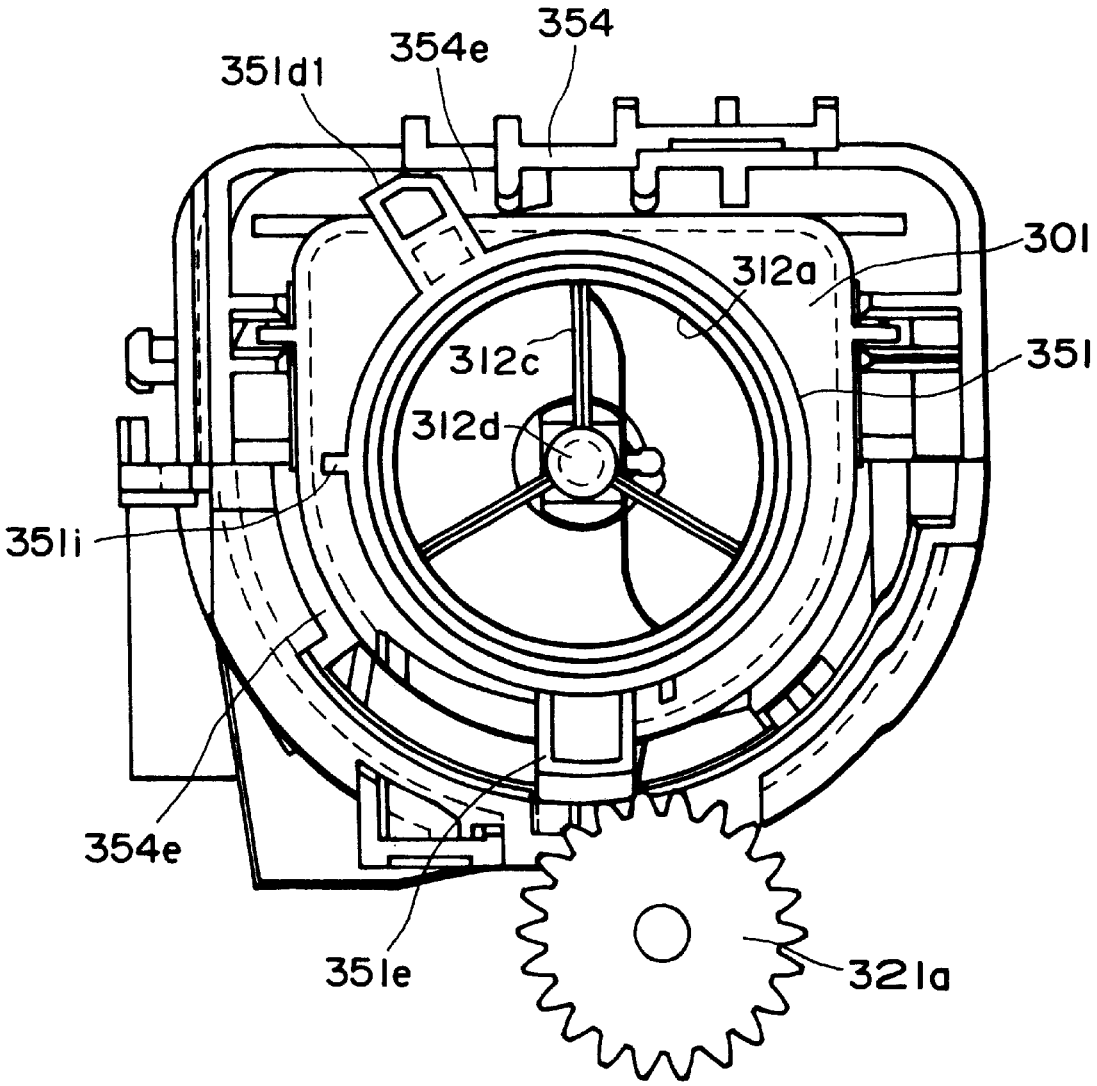
FIG. 45 is a sectional view of the toner-replenishing apparatus in which the toner-replenishing container, the handle of which has been removed, has been installed.
Figure 46:
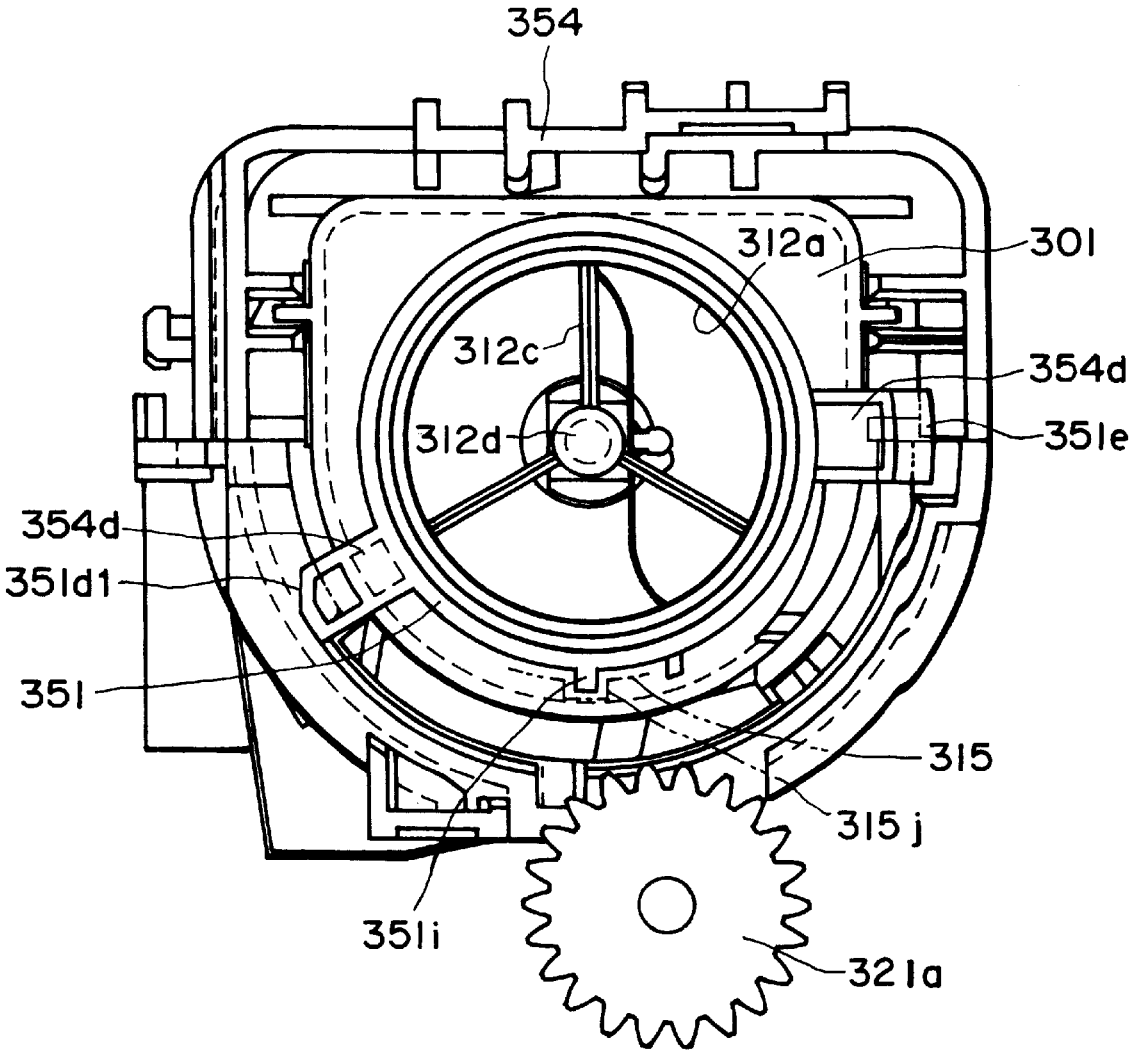
FIG. 46 is a sectional view of the toner-replenishing apparatus in which the toner-replenishing container, the handle of which has been removed, has been installed.

As described above, the first flange 312 is provided with the toner inlet 312*a,* the opening of which is located at the longitudinal end, on the upstream side in terms of the direction in which the toner container 311 is inserted. The toner inlet 312*a* is provided with internal ribs 312*c,* which readily fit within the toner inlet 312*a* (FIGS. 45 and 46). Also, the toner inlet 312*a* is provided with a cylindrical hollow shaft, the axial line of which coincides with that of the toner inlet 312*a,* and which supports the axle of the toner conveying member which will be described later. Around the cylindrical portion 312*a,* i.e., the cylindrical wall of the toner outlet 312*a,* a handle 315, which will be described later, is fitted. After the toner is filled, the toner inlet 312*a* is sealed by fitting a cap 314 into the toner inlet 312*a.* Then, the first flange 312 is unitized with the toner container 311 by an appropriate joining means.

The end plate 313*a* of the second flange 313 is provided with a hole 313*c,* into which a drive-force transmitting bearing (for example, coupling) for bearing the axle of the toner conveying member 329 and also transmitting the driving force, is fitted from outside the toner container 311. Further, the end plate 313*a* is provided with a cylindrical portion 313*d* (FIGS. 13 and 14), which projects outward from the outer edge of the hole 313*c* and supports the peripheral surface of the aforementioned coupling.

(Handle)

Figure 16:
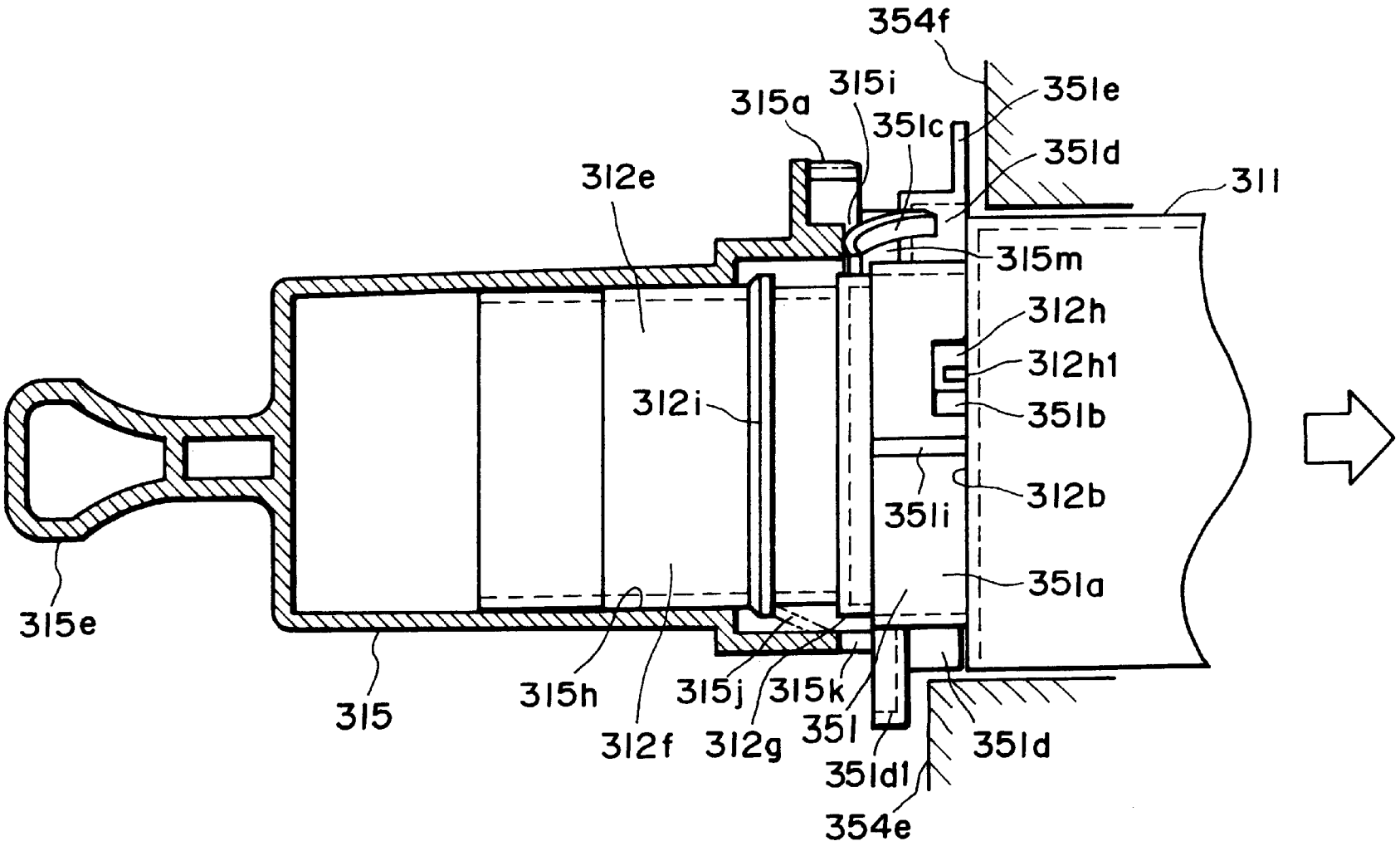
FIG. 16 is a schematic side view of the handle lock (in the locked state).
Figure 17:
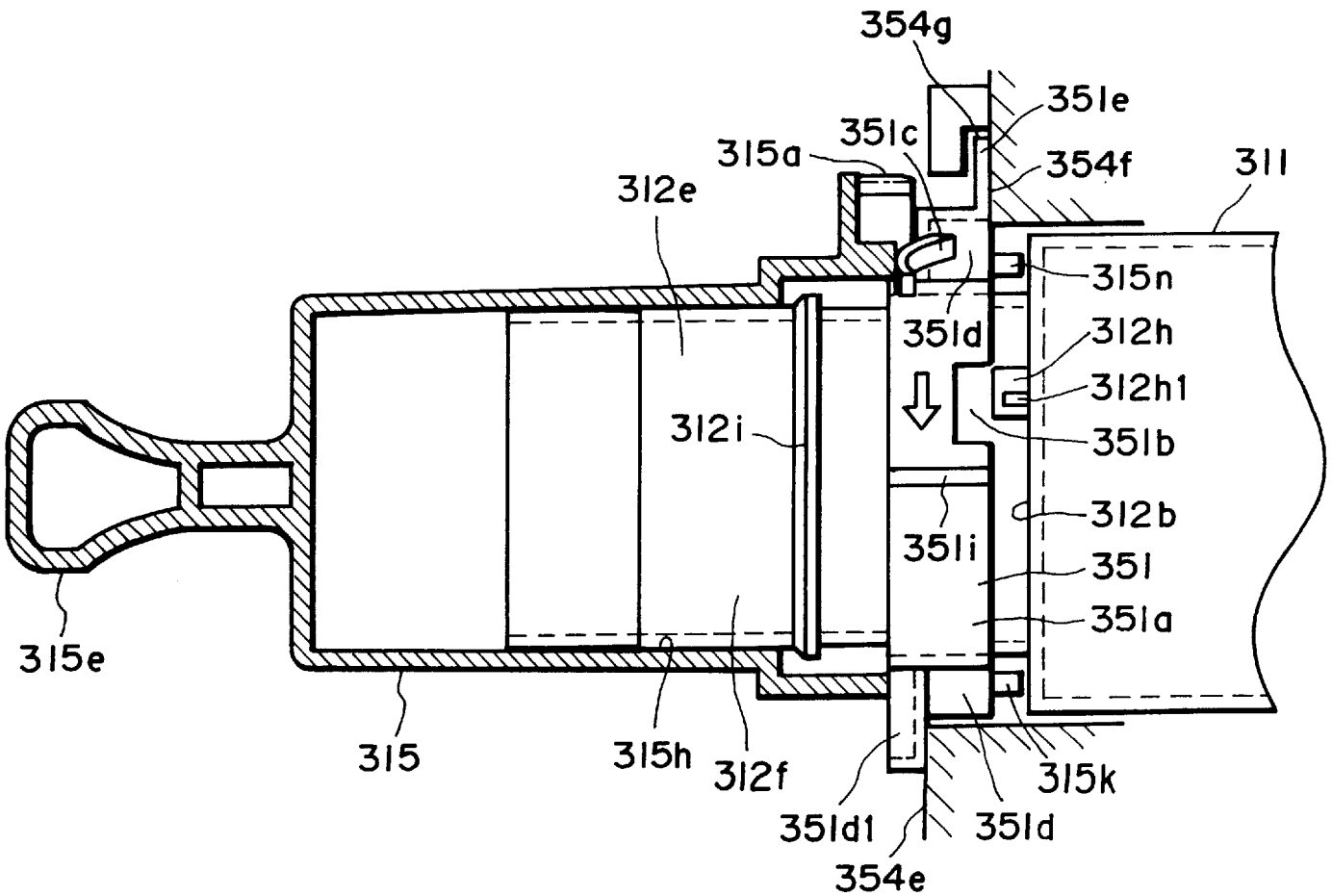
FIG. 17 is a schematic side view of the handle lock (in the unlocked state).

The handle 315 basically comprises three sections: a knob section 315*e,* a cylindrical hollow 315*h* (middle section) with a smaller diameter, and a cylindrical hollow section with a larger diameter. The knob section 315*e* is the outward end of the handle 315, and is in the form of a thick plate with a thicker end. The cylindrical hollow section with a larger diameter is the inward end of the handle 315, and is open on the inward side. The handle 315 is rotationally attached to the toner container 311 by manually fitting the middle section 315*h* around a handle supporting portion 312*f,* which is a part of the cylindrical portion 312*c* located at one of the longitudinal end of the toner container 311 (FIGS. 16 and 17). The handle 315 also comprises an engaging portion 315*a* for transmitting the driving force. The engaging portion 315*a* is on the outwardly facing surface of the handle 315.

Figure 15:
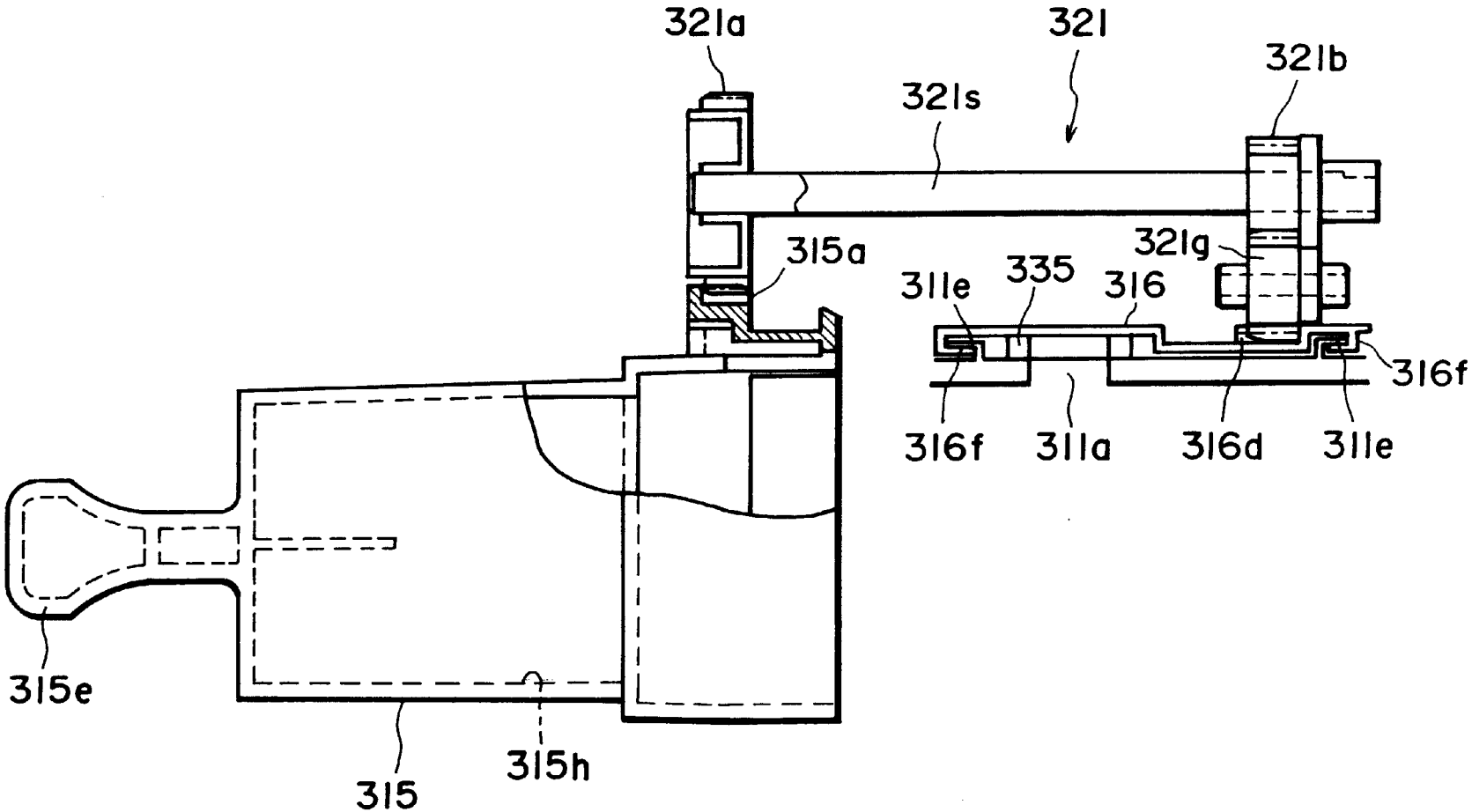
FIG. 15 is a schematic view of the driving system for driving the container shutter, developed in the circumferential direction of the toner replenishing container.
Figure 19:
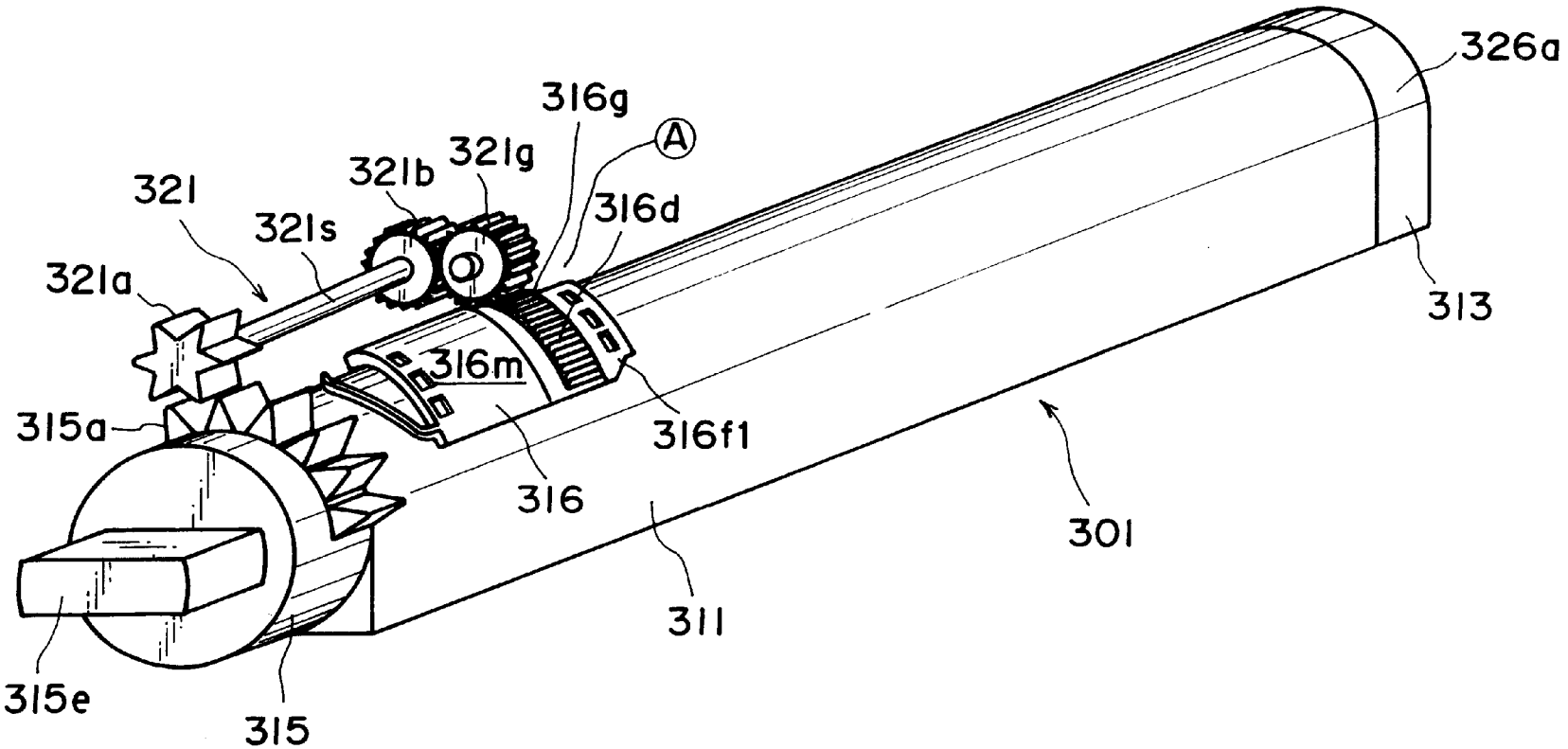
FIG. 19 is a perspective view of the driving-force transmitting member of the toner replenishing container.

Referring to FIGS. 15 and 19, the engaging portion 315*a* is in the form of a segment gear so that when the toner-replenishing container 301 is inserted into the toner-replenishing apparatus 100, the engaging portion 315*a* can engage with the engaging portion 321*a* of a driving-force transmitting member 321 with which the main assembly of the toner replenishing apparatus 100 is provided. The engaging portion 315*a* is engageable with the engaging portion 321*a* through a sequential operation for inserting the toner-replenishing container 301.

Also referring to FIGS. 15 and 19, the driving-force transmitting member 321 comprises a shaft 321*s,* the engaging portion 321*a* for receiving the driving force, and an engaging portion 321*b* for transmitting the driving force. The shaft 321*s* is fitted with the engaging portions 321*a* and 321*b,* one for one at its longitudinal ends, and is rotationally supported by the toner-replenishing apparatus 100. The engaging portions 321*a* and 32*b* comprise gears with multiple teeth. The engaging portion 321*a* on the driving-force reception side in this embodiment comprises a single gear. However, there is no specific restriction regarding the structure or gear count of the engaging portion 321*a* as long as it is structured to function as a mechanism for receiving the driving force. The engaging portion 321*b* on the driving-force transmission side is meshed with the engaging portion 321*g* on the driving-force transmission side as an idler gear, which is meshed with the engaging portion 316*d,* a segment gear, on the driving-force reception side. In this embodiment, the driving-force transmitting member 321, a member comprising the shaft 321*s,* and engaging portions 321*a,* 321*b* and 32*ag,* is provided on the apparatus main assembly 124 side.

(Toner Conveying Member)

Referring to FIG. 14, one end of a shaft 327 for supporting the toner-conveying member 327 is rotationally borne by the hole 312*d* (FIG. 46), and the other end of the shaft is borne by the bearing 313*d* fitted in the shaft hole 312*d* so that the rotational-driving force is transmitted through the coupling 326*a* fixed to this end of the shaft 327. Further, the toner-conveying member 329 comprises a toner-conveying wing 328, which is a flexible member fixed to the shaft 27. The coupling 326*a* is rotationally supported by the toner container 311.

The toner-conveying wing 328 rubs against the inward surface of the toner container 311. The toner conveying wing

328 comprises a plurality of segments with a winglet 328*a*. The toner outlet 311*a* side of the winglet 328*a* is bent away from the rotational direction of the toner conveying wing 328 so that the toner in the toner container 311 can be conveyed toward the toner outlet 311*a*. The toner outlet 311*a* is located on the upstream side in terms of the direction in which the toner-replenishing container 301 is inserted into the apparatus main assembly 124. Thus, all winglets 328*a* extend in the same direction. However, it is not mandatory that all winglets 328*a* extend in the same direction; the winglets 328*a* may be different in their extending direction, depending on the positioning of the toner outlet 311*a*. After the toner-replenishing container 301 is inserted into the toner-replenishing apparatus 100, the aforementioned coupling 326*a* receives the driving force by meshing with the coupling 344 (FIG. 28) provided on the toner-replenishing apparatus 100 side, and rotates the toner-conveying member 329.

As long as the toner within the toner container 311 can be conveyed to the toner outlet 311*a*, the provision of the toner-conveying member 329 is not mandatory. However, the provision of the toner-conveying member 329 assures a reliable supply of the toner.

Figure 18:
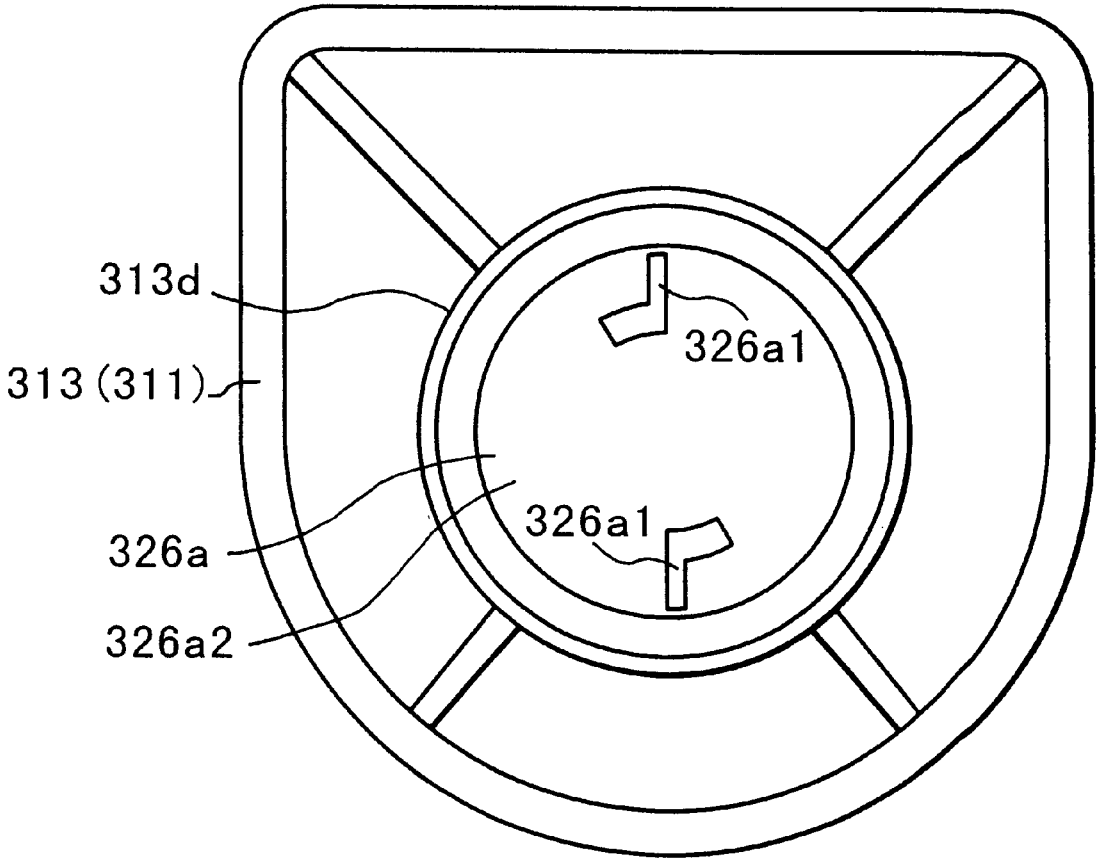
FIG. 18 is a schematic view of the toner replenishing container as seen from the downstream side in terms of the inserting direction.

Next, referring to FIG. 18 which depicts the driving-force-receiving-end portion of the toner-replenishing container 301, a coupling 326*a* as a driving-force receiving member is rotationally supported by the end plate of the toner container 311. Both ends of the coupling 326*a* in the axial direction are in the form of a shaft coupler. One end of the coupling 326*a* is positioned within the toner container 311, and is coupled with one end of the shaft 327 of the toner-conveying member 329, whereas the other end of the coupling 326*a*, which is positioned outside the toner container 311, is provided with a rotational-force receiving portion. As the toner-replenishing container 301 is installed into the apparatus main assembly 124, this rotational-force receiving portion couples with the coupling 344 provided on the toner-replenishing apparatus 100 side to transmit the rotational force. Referring to FIG. 18, the rotational-force receiving portion is in the form of a projection 326*a*1, a part of which extends in the radial direction the coupling 326*a*. The couplings 326 and 344 couple with each other as the projection 344*a* of the coupling 344 fit into the two spaces 326*a*2 between the two projections 326*a*1 one for one.

(Container Shutter)

Referring to FIG. 13, the container shutter 316 is provided with a pair of sliding portions 316*f*, which are located at the longitudinal ends, in terms of the inserting direction of the toner-replenishing container 301, of the container shutter 1, one for one. The sliding portions 316*f* engage, one for one, with a pair of shutter-supporting members 311*e* as guiding members that extend on the toner container 311 in the circumferential direction of the toner container 311 along the curved edges of the toner outlet 311*a*, one on the front side and the other on the back side of the outlet 311*a*, in terms of the inserting direction of the container 301. The container shutter 316 slides in the circumferential direction of the toner container 311 to expose or seal the toner outlet 311*a*. More specifically, the cross section of the container shutter 316 perpendicular to the longitudinal direction of the toner replenishing container 301 is in the form of an arc, the curvature of which is such that the container shutter 316 perfectly fits along the outer surface of the cylindrical portion 311*g* of the toner container 311. As for the sliding portion 316*f* and shutter supporting members 311*e*, their cross section at a plane which includes the axial line of the theoretical hollow cylinder to which the container shutter 316 belongs, are in the form of an interlocking hook (FIG. 15). The shape of the cross section shutter supporting member 311*e*, i.e., the interlocking hook, is the same across the entire length of the member.

Figure 53:
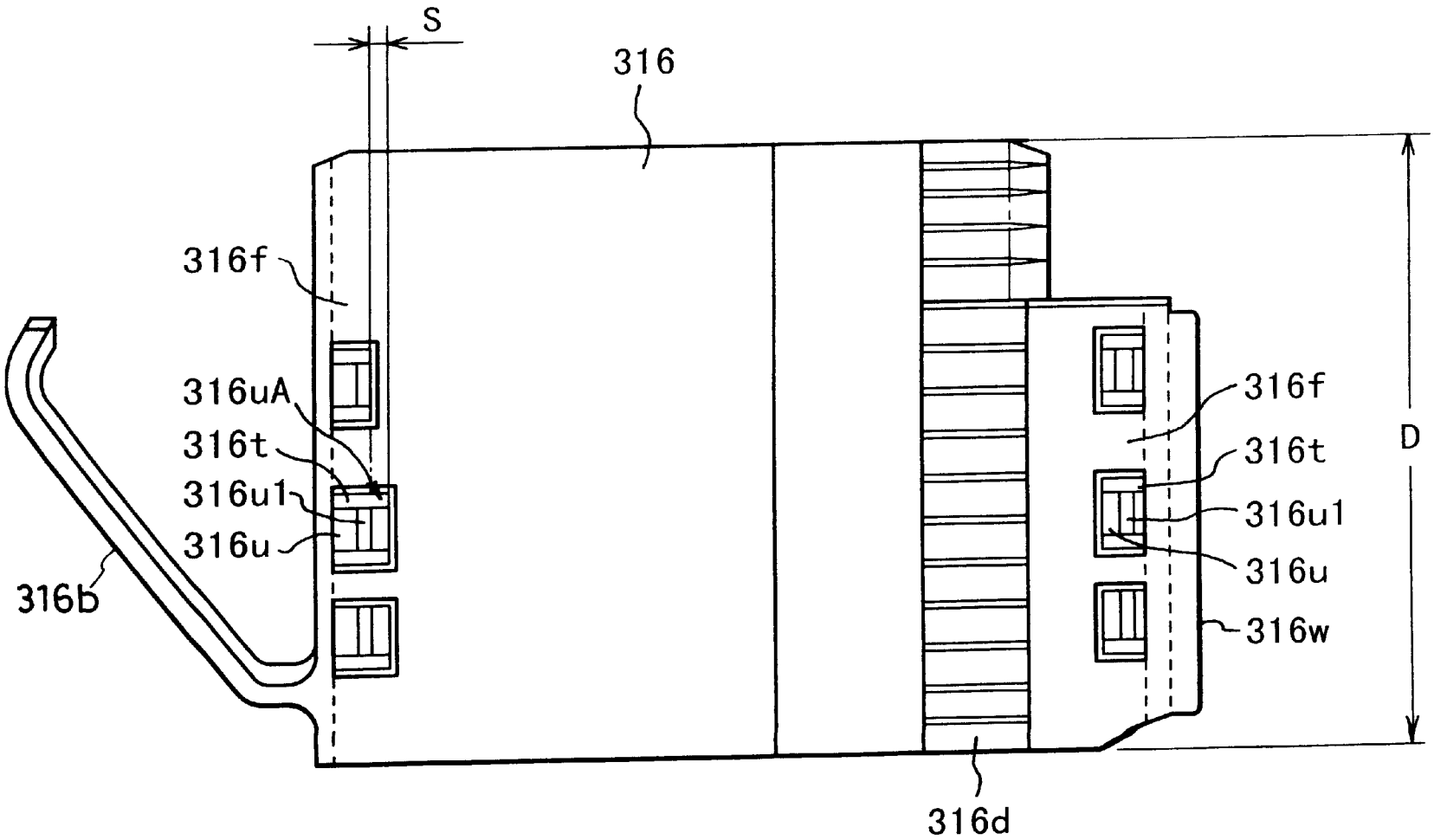
FIG. 53 is a top view of a container shutter.

The sliding portion 316*f* is provided with a plurality of small hook-like horizontal projections 316*u* which extend inward, relative to the toner outlet 311*a*, from the upright base portion of the sliding portion 316*f*. The locations of these hook-like horizontal projections 316*u* correspond one for one with the locations of the plurality of through holes cut through the container shutter 316 along its curved edges. Referring to FIG. 53, each of these horizontal hook-like projections 316*u* is provided with a tiny projection 316*u*1 (projects toward the reader side of this page), which is located on the surface of the projection 316*u*, and which faces the shutter supporting member 311*e*. The presence of the tiny projection 316*u*1 reduces the frictional resistance between the sliding portions 316*f* and the shutter supporting member 311*e* by reducing the size of the contact surface area between the hook-like horizontal projection 316*e* and the inwardly facing surface, relative to the toner container 311, of the shutter supporting portion 311*e*. The top edges of the horizontal hook-like projection, which are perpendicular to the sliding direction of the container 311, are provided with a slanted surface 316*t* so that the container shutter 316 slides smoothly.

Referring to FIG. 19, the container shutter 316 is provided with the aforementioned driving-force receiving engaging portion 316*d* as a member for receiving the rotational force that is enabled to engage with a gear as the aforementioned driving-force transmitting engaging portion 321*g* as the toner-replenishing container 301 is installed into the toner-replenishing apparatus 100. This engaging portion 316*d* is provided with a plurality of teeth, and is enabled to engage with the driving-force transmitting engaging portion 321*g* through a sequence of operations for inserting the toner-replenishing container 311 into the toner-replenishing apparatus 100. The driving-force receiving engaging portion 316*d* is cut in the outer surface 316*m* of the container shutter 316. In other words, the diameter of the theoretical circle that includes the tooth tips of the segment gear, and the diameter of the theoretical circle which includes the outer surface of the container shutter 316 are rendered practically the same so that space can be saved in terms of the radial direction of the toner container 301. Since the engaging portion 316*d* must be engaged, or disengaged, with the driving-force transmitting engaging portion 321*g*, it is cut in the outer surface of the container shutter 316, close to the curved edge on the coupling 36*a* side. With this arrangement, the engaging portion 316*d* engages with, or disengages from, the driving-force transmitting engaging portion 321*g* when the container shutter 316 is in the closed size. As described before, the driving-force transmitting engaging portion 321*g* with which the toner-replenishing apparatus 100 is provided, and the driving-force receiving portion 316*d* with which the container shutter 316 is provided, are engaged through a sequence of operations for inserting the toner-replenishing container 301 into the toner-replenishing apparatus 100. Therefore, the sliding portion 316*f* (316*f*1 ) of the container shutter 316, on the side where the coupling 326*a* is provided, is made shorter than the driving-force receiving engaging portion 316*d* (portion designated by a referential character A in FIGS. 13, 19 and 53). In other words, the sliding portion 316*f*1 is desired to be configured so that the plane of the edge surface 316*h* of the container shutter 316, on the downstream side in terms of the longitudinal direction of the toner container 311, which squarely faces the driving-force transmitting engaging portion 321*g* when the toner-replenishing container 301 is inserted into the toner-replenishing apparatus 100, coincides with the plane of the surfaces of the teeth of the driving-force receiving engaging portion 316*d,* on the downstream side in terms of the inserting direction of the toner-replenishing container 301. Therefore, in this embodiment, a portion 316*g* is removed to shorten the sliding portion 316*f*1. Of the two surfaces created by removing the portion 316*g,* the one perpendicular to the longitudinal direction of the toner container 311 is the aforementioned edge surface 316*h*. With this arrangement, the driving force transmitting engaging portion 321*g* and the container shutter 316 do not interfere with each other.

When the container shutter 316 is thick, the sliding portion 316*f*1 is extended across the entire curved edge of the container shutter 316, and in order to prevent the driving-force transmitting engaging portion 321*g* from colliding with the sliding portion 316*f*l, the sliding portion 316*f*1 is provided with an indentation as an equivalent of the aforementioned missing portion 316*g* to allow the driving-force transmitting engaging portion 321*g* to pass.

Referring to FIG. 15, the driving-force transmitting engaging portions 321*b* and 321*g* with which the apparatus main assembly 124 is provided comprise two pieces of gears. However, there is no restriction regarding the structure of the engaging portion and the number of gears as long as the engaging portions have a driving-force transmitting mechanism.

Figure 54:
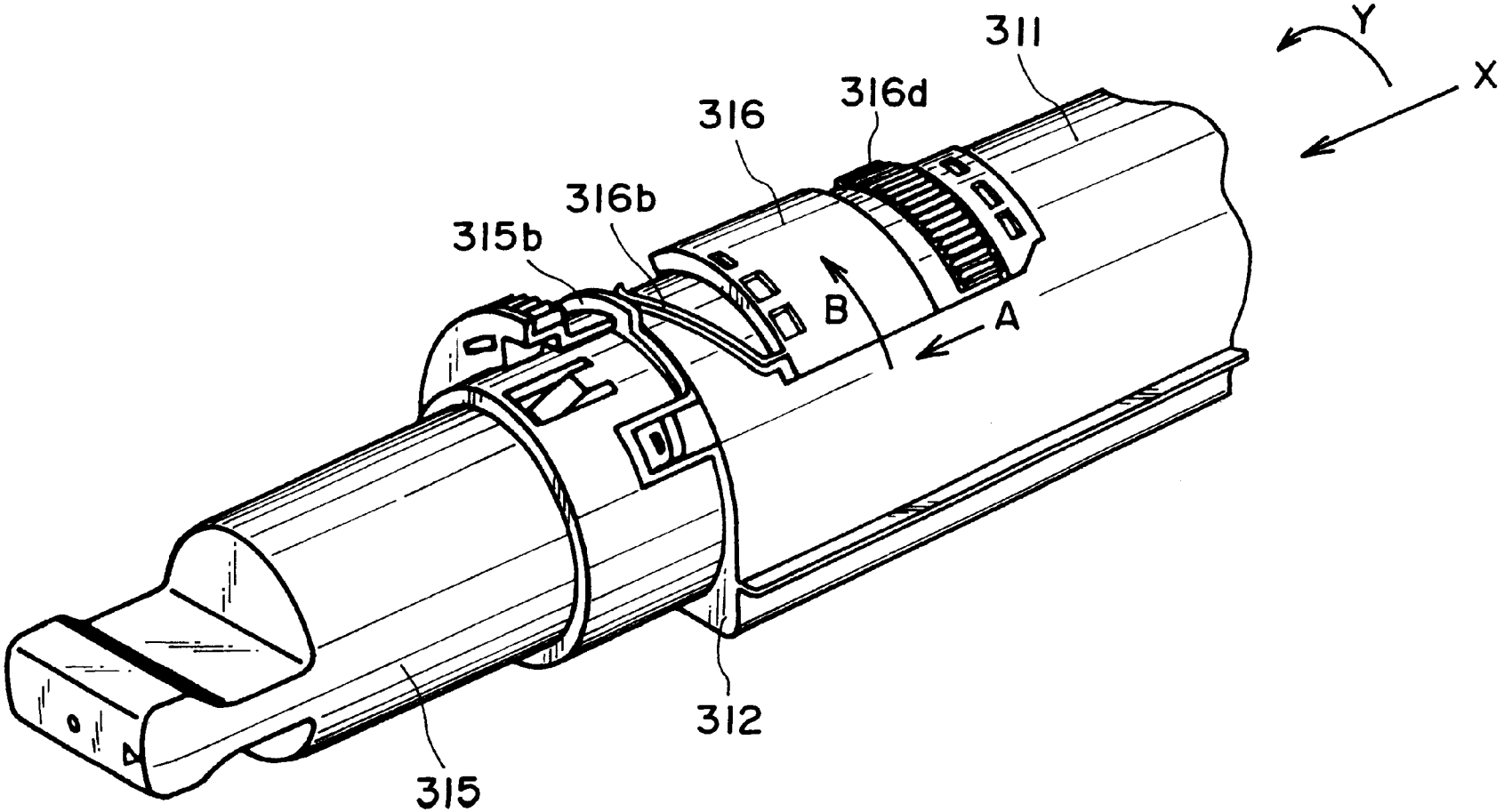
FIG. 54 is a perspective view of the shutter portion of the toner-replenishing container in accordance with the present invention.
Figure 55A:
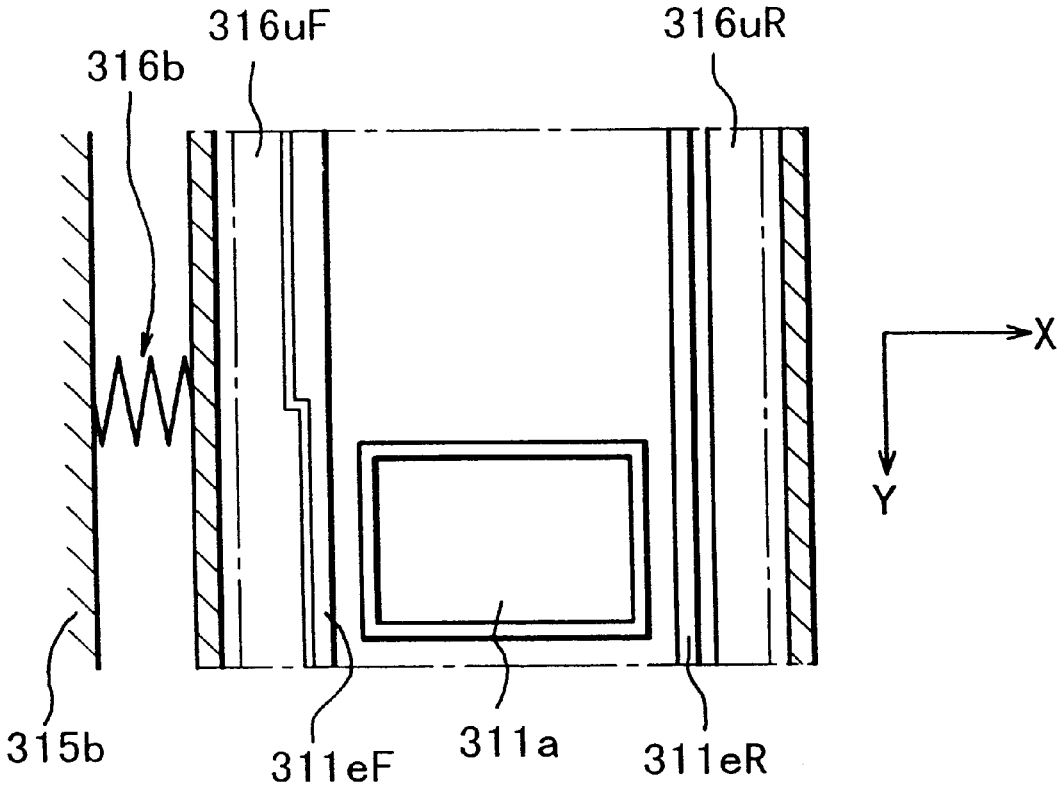
FIG. 55, (a and b) are a top view of the shutter portion, developed in the circumferential direction of the toner-replenishing container, and a vertical sectional view of the shutter portion, respectively.
Figure 55B:
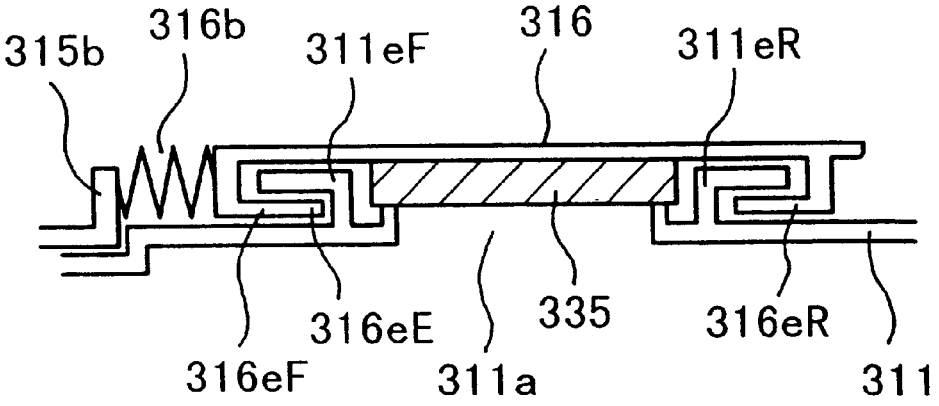
Figure 56C:
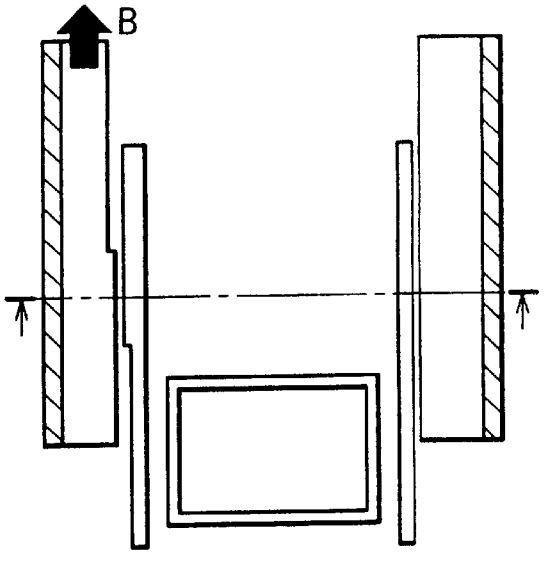
FIG. 56, (a,b and c) are sectional drawings that describes the shutter operation.
Figure 56C:
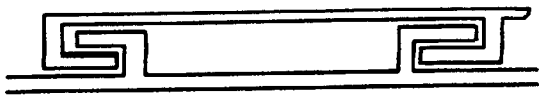
Figure 56B:
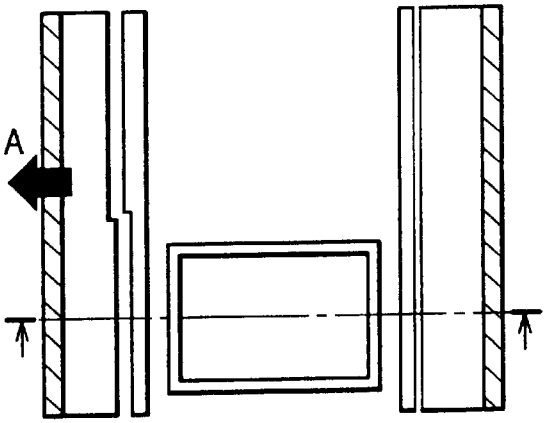
Figure 56B:
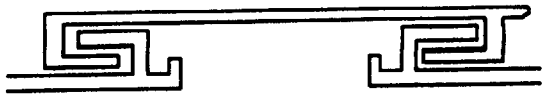
Figure 56A:
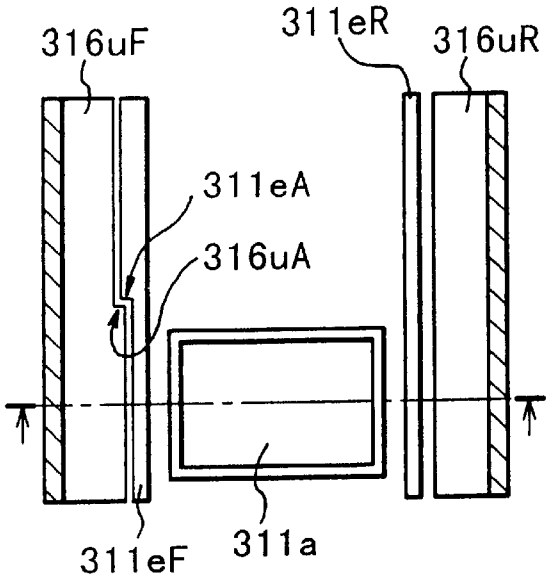
Figure 56A:
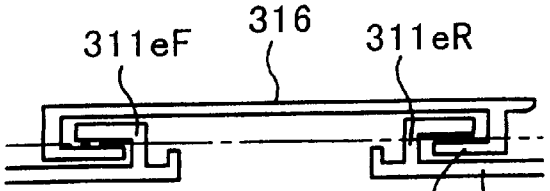
Figure 57A:
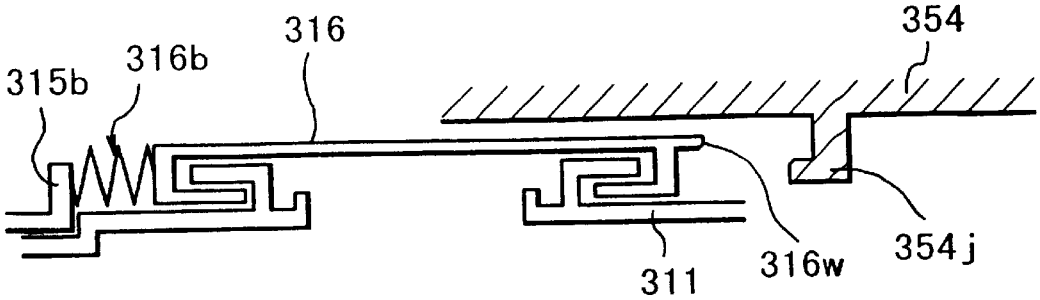
FIG. 57, (a,b,c and d) are sectional drawings that describes the first sliding of the shutter.
Figure 57B:
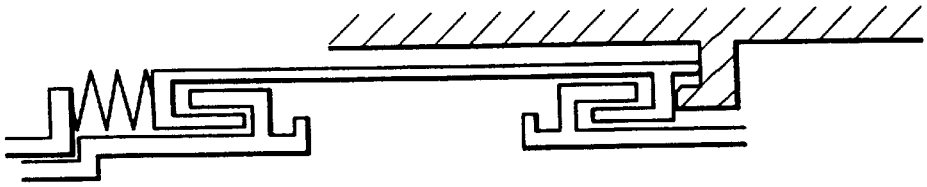
Figure 57C:
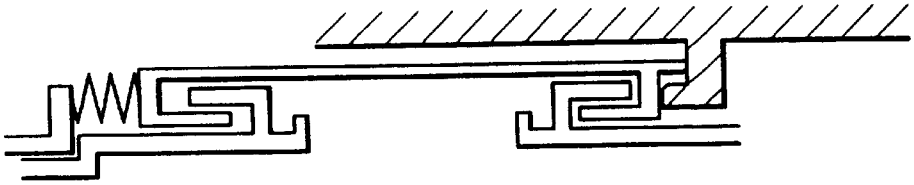
Figure 57D:
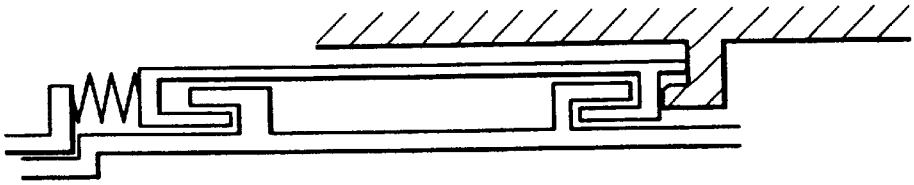

Referring to FIGS. 53–55, the container shutter 316 is provided with an elastic member 316*b,* which is integrally formed with the container shutter 316, and is located on the operator side of the container shutter 316. The elastic member 316*b* is directed pressed by the projection 315*b* provided on the outer surface of the cylindrical portion of the handle 315, generating pressure which continuously presses the container shutter 316 in the direction opposite to the direction of the arrow mark A. In this embodiment, the container shutter 316 is formed of resin, so that the elasticity of the elastic member 16*b* is provided by the elastic deformation of the resin.

FIG. 55 is a drawing for depicting the shutter supporting member 311*e* (guide rail), in which FIG. 55, (b) is a longitudinal (X direction) sectional view of the toner outlet 311*a* and its adjacencies, and FIG. 55, (a) is a horizontal sectional view of the toner outlet 311*a* and its adjacencies, developed in the circumferential direction (Y direction) of the toner container 311, as seen from the top.

The guide rails 311*e*F and 311*e*R have a hook-like cross section, and their horizontal portions extend outward relative to the toner outlet 311*a*. The rails 316*u*F and 316*u*R provided on the container shutter 316 side also have a hook-like cross section, and are in engagement with the guide rails 311*e*F and 311*e*R in a manner of loosely grasping them. The container shutter 316 is provided with a packing member 335 pasted to the inwardly-facing surface of the container shutter 316. The packing member 335 is formed of a material such as foamed urethane, and is placed in contact with the toner outlet 311*a* to assure that the toner outlet 311*a* is airtightly sealed by the container shutter 316. As described before, the container shutter 316 is under the pressure generated in the rightward direction of the drawing by the elastic member 316*b* symbolically depicted in the drawing. Therefore, the tip 316*u*E of the rail 316*u*F is in contact with the guide rail 311*e*F (drawings, however, are made with the provision of a slight gap between the rails, for descriptive convenience).

Next, referring to FIG. 56, the opening movement of the container shutter 316 will be described in detail. As in FIG. 3, FIG. 56, (a) shows the container shutter 316 in the closed state, and FIG. 56, (b) shows the container shutter 316 immediately after the first sliding step was completed. FIG. 56, (c) shows the container shutter 316 during the second sliding step. In each drawing, the drawing at the top is a sectional view (at the single dot line in the drawing at the bottom) of the toner outlet 311*a* and its adjacent areas, developed in the circumferential direction (Y direction) as in FIG. 55, (a), as seen from the 20 top side, whereas the drawing at the bottom is a longitudinal (X direction) sectional view (at the single dot line in the drawing at the top) of the toner outlet 311*a* and its adjacencies, as in FIG. 55, (b).

The container shutter 316 in this embodiment is structured so that unless the first sliding step (direction of an arrow mark A) is completed, the second sliding step (direction of an arrow mark B) cannot be carried out. When the container shutter 316 is in the closed state as illustrated in FIG. 56, (a), the stepped portions 311*e*A of the guide rail 316*e*F, and the stepped portion 316*u*A of the rail 316*u*F, are engaged with each other. Therefore, even if an attempt is made to move the container shutter 316 in the direction of the arrow mark B, the container shutter 316 will not move. However, if the container shutter 316 is slid in the direction of the arrow mark A against the resiliency of the elastic member 12 as shown in FIG. 56, (b), the engagement between the stepped portions 311*e*A and 316*u*A is broken, allowing the container shutter 316 to be slid in the direction of the arrow mark B. Then, as the container shutter 316 is slid in the direction of the arrow mark B, the toner outlet 311*a* appears and the state of the container shutter 311 becomes as illustrated in FIG. 56, (c).

In FIG. 57, the main assembly 354 of the toner replenishing apparatus 100 of the image forming apparatus is provided with a stopper 354*j,* which is rectangular in cross section and projects from the inwardly-facing surface of the main assembly. As the toner-replenishing container 301 is inserted a predetermined distance into the toner replenishing apparatus main assembly 354 (FIG. 57, (a)), the end surface (striking surface 316*w*) of the container shutter 316 comes into contact with the stopper 354*j* (FIG. 57, (b)). Then, as the toner container 311 is pushed farther into the toner-replenishing apparatus main assembly 354, the container shutter 316 remains stationary in contact with the stopper 354*j,* whereas the toner container 311 moves in the first sliding step direction relative to the container shutter 316 against the elastic member 316*b* (FIG. 57, (c)). This state corresponds to the state depicted in FIG. 56, (b). Thus, in this state, the engagement between the stopped portions 311*e*A and 316*u*A has been broken, allowing the toner container 311 to rotate in the second sliding direction. Then, as the toner container 311 is rotated in the direction of the arrow mark B in FIG. 56, (d), the toner outlet 311*a* is exposed (FIG. 57, (d)).

In the aforementioned drawings, the stepped portions 316*u*A with which the rail 316*u*F is provided are represented by a single combination of the stepped portions, for the sake of descriptive convenience. In reality, however, a plurality of hook-like projections 316*u* are provided with a stepped portion s, and function together as the virtually single stepped portion 316*u*A.

Figure 20:
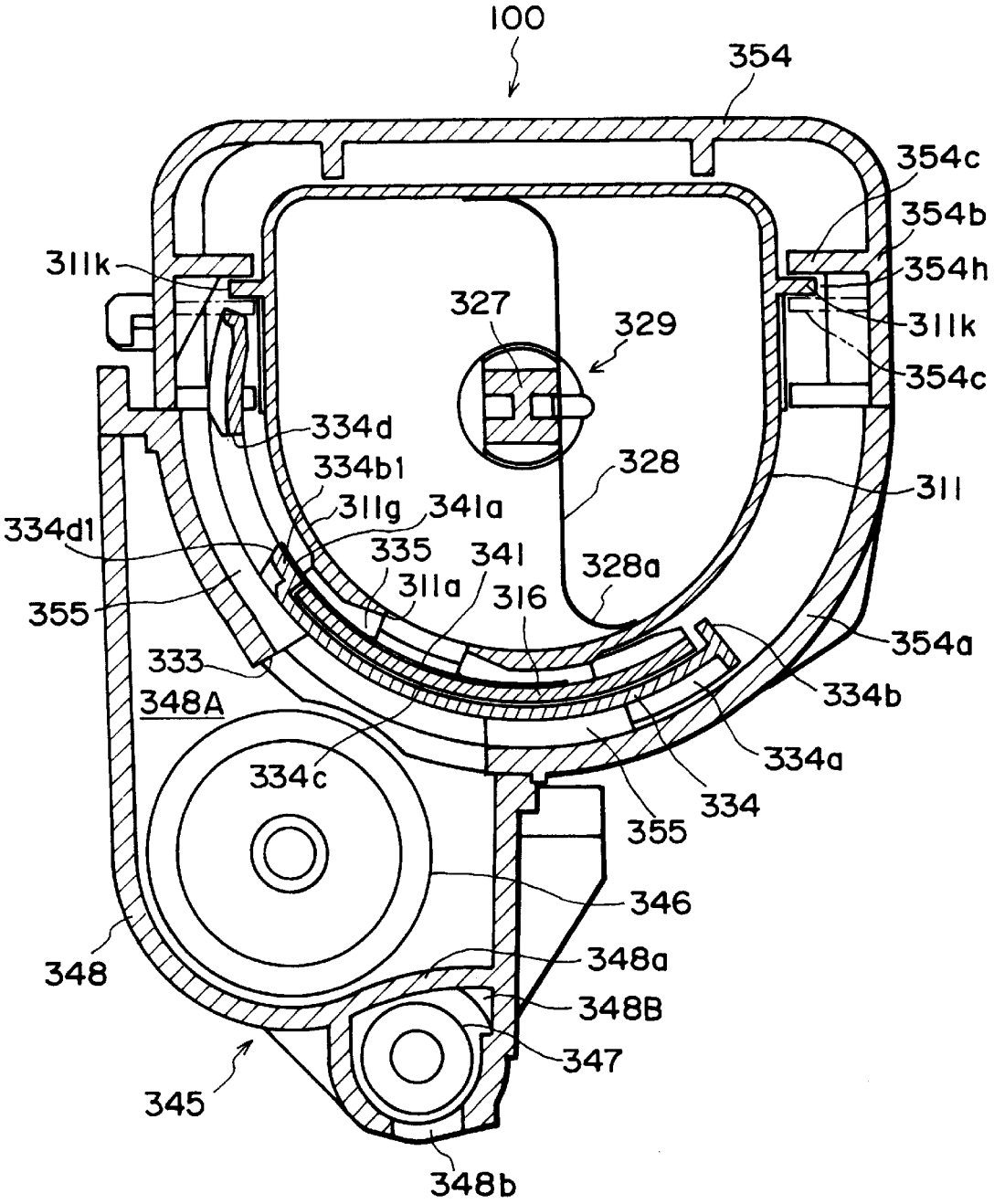
FIG. 20 is a sectional view of the front portion of the toner-replenishing container (shutter is open).

Referring to FIG. 20, referential characters 333 and 334 designate the toner-supply inlet with which the main assembly of the toner-replenishing apparatus 100 is provided, and the main-assembly shutter which exposes or seals the toner supply inlet 333, respectively. The container shutter 316 fits into the space 334*c* between the mutually facing surface of a pair of projections 334*b* of the main assembly shutter 334. As the toner-replenishing container 311 is inserted into the main assembly of the toner-replenishing apparatus 100, the container shutter 316 with a width of D (FIG. 33) slides into the space 334*c* in parallel to the first sliding direction. As a result, the container shutter 316 is locked with the main assembly shutter 334 in terms of the movement in the second sliding direction. Therefore, as the container shutter 316 slides in the second sliding direction, the main assembly shutter 344 also slides in the second sliding direction, allowing the toner-supply inlet 333 to be connected with the toner outlet 311*a* of the toner container 311.

Further, the engagement between the two shutters causes the container shutter 316 to be restricted in its movement. In effect, the engagement controls the wobbling of the container shutter 316 during the sliding of the container shutter 316 in the second sliding direction, making it possible for the container shutter 316 to be smoothly opened or closed.

The stopper 354*j* also functions as a guiding member when the container shutter 316 slides in the second sliding direction. More specifically, the container shutter 316 is slid in the second sliding direction, with the striking surface 316*w*, i.e., the end surface of the container shutter 316 on the downstream side in terms of the inserting direction of the toner replenishing container, always remaining in contact with the stopper 354*j*. This function of the stopper 354*j* is effected by the resiliency of the elastic member 316*b*. In effect, the stopper 354*j* controls the wobbling of the container shutter 316 during the sliding of the container shutter 316 in the second sliding direction, making it possible for the container shutter 316 to be smoothly opened or closed.

In particular, in this embodiment, the container shutter is slid in the second sliding direction by transmitting the driving force from the driving-force transmitting engaging portion 321*g* to the driving-force receiving engaging portion 316*h*. Therefore, the yawing of the container shutter 316 is liable to occur. However, the above-described structural arrangement is very effective to prevent such an occurrence. In addition, the provision of the elastic member 316*b* assures that even if there is a certain amount of error in the longitudinal dimension of the toner replenishing container 311, the stopper 354*j* and the striking surface 316*w* come in contact with each other, and cause the container shutter 316 to move in the first sliding direction, to compensate for the error.

Further, the stopper 354*j* has a hook-like cross section, and the container shutter 316 engages with the stopper 354*j* in such a manner that the striking surface 316*w* is caught by the stopper 354*j*. Therefore, not only is the container shutter 316 reliably guided, but also it is prevented that the driving force fails to be transmitted due to the deformation of the container shutter 316 that occurs when the driving force is transmitted to the driving force receiving engaging portion 316*h*.

As is evident from the above description, when the toner-replenishing container 301 is handled by itself, outside the apparatus, the container shutter 316 cannot be slid in the direction of the arrow mark B unless it is first slid in the direction of the arrow mark A. Therefore, it is possible to prevent an accident in which the container shutter 316 is inadvertently opened, and the areas adjacent the toner replenishing container 311 are contaminated by the leaked toner. On the other hand, when the toner-replenishing container 301 is inserted into the apparatus main assembly, the operation to move the container shutter 316 in the first sliding direction is automatically completed by an operator as the operator pushes the toner-replenishing container 301 into the apparatus main assembly in the proper direction, leaving one more simple step, i.e., the counterclockwise rotation of the toner container 3 by the knob 4, to be carried out to finish the installation.

In order to pull out the toner-replenishing container 301 from the apparatus main assembly, the above-described installation steps must be reversely carried out. That is, first the handle 315 must be rotated clockwise, and the toner-replenishing container 301 must be pulled toward the front of the apparatus. As the toner-replenishing container 301 is pulled frontward, the container shutter 316 and container shutter 316 move relative to each other in the first sliding direction due to the resiliency of the elastic member 12, returning the container shutter 316 to its original position.

(Toner Replenishing Apparatus)

Figure 22:
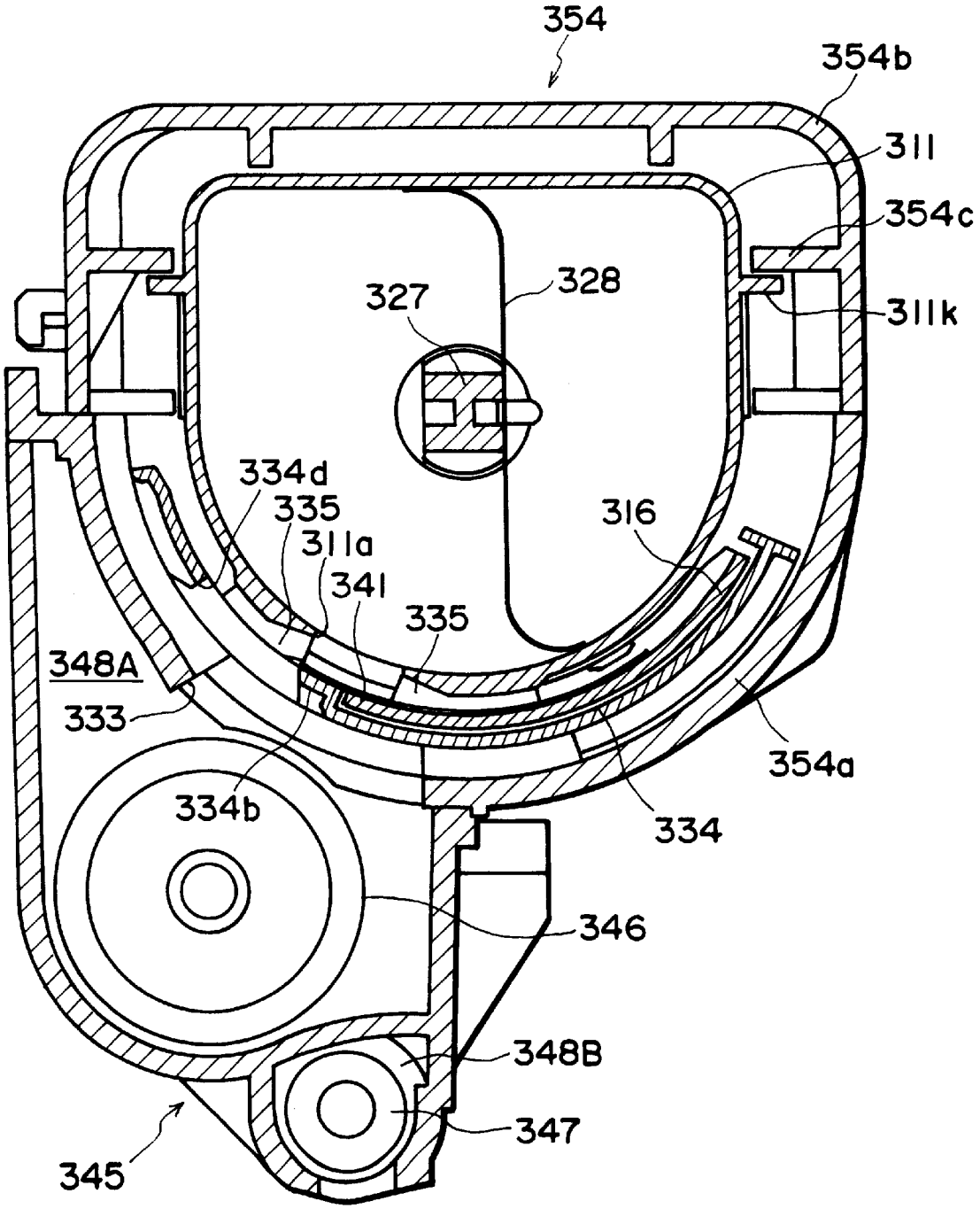
FIG. 22 is a sectional view of the front portion of the toner-replenishing container (shutter is in the middle of being opened, or closed).

Referring to FIGS. 20–22, the toner-replenishing apparatus 100 is provided with a toner-replenishing apparatus main assembly 354, a cartridge-receiving portion, which comprises a bottom portion 354*a* and a top portion 354*b*, the cross sections of which in the direction perpendicular to their lengthwise directions are semicircular and rectangular, respectively, to accommodate the toner container 311. The top portion 354*b* is provided with a plurality of projections 354*c* for guiding a pair of guide portions 311*k* of the toner replenishing container 301. The projections 354*c* are on the inner surface of the top portion 354*b*. One pair of the projections 354*c* are at the entrance of the toner replenishing apparatus main assembly 354, one for each side, and the other pairs are aligned inward of the toner-replenishing-apparatus main assembly 354, one half the pairs being above the line corresponding to the position of the guide portion 311*k* and the other half being below the same line. The bottom portion 354*a* is provided with a pair of parallel guide rails 355, which are in the inwardly-facing surface of the bottom portion 354*a* and extend in the circumferential direction of the bottom portion 354*a*. The guides 334*a* of the main assembly shutter 334 are engaged one for one in these guide rails 355. The guide rails 355 and the guide 334*a* are hook-like in their cross section, and interlock with each other. As is evident from the above description, there are two guide rails 355 and two guides 334*a*, which are parallel to each other. In other words, the main assembly shutter 334 is supported by the toner-replenishing apparatus main assembly 254. The radius of the inwardly-facing surface of the projection 334*b* of the main assembly shutter 334 is exactly or approximately the same as that of the inwardly facing surface of the container shutter 316. The main assembly shutter 334 is provided with a pair of projections 334*b*, which are located at both edges, one for one, perpendicular to the moving direction of the main assembly shutter 334. The main assembly shutter 334 is provided with a main assembly shutter opening 334*d*. This opening 334*d* has only to be able to expose the toner supply inlet 333; there may be only one cross section, i.e., a section 334*d*1. The width of inwardly facing surface of the main assembly shutter 334, between the two projections 334*b*, in the circumferential direction of the main assembly 354, is approximately the same as the width of the inwardly-facing surface of the container shutter 316 in the circumferential direction of the main assembly 354. Therefore, as the toner-replenishing container 301 is inserted into the toner-replenishing apparatus 100, it perfectly fits into the space 334*c* between the two projections 334*b* of the main assembly shutter 334, which project inward in the radial direction of the toner replenishing container 301; the two edges of the container shutter 316, which extend in the longitudinal direction of the main assembly 354, come virtually in contact with the corresponding inwardly-facing surfaces 334*b*1 of the projections 334*b*. Therefore, as the container shutter 316 is opened or closed, the main-assembly shutter 334 moves with the container shutter 316. Thus, if the two shutters 316 and 334 are designed so that the toner outlet 311*a* and the toner supply inlet 333 align with each other, as the container shutter 316 is opened, the toner can be supplied into the developing device 204 by a toner stirring-conveying apparatus 345. The main assembly shutter opening 334*d* and the space 334*c* are immediately adjacent to each other in the circumferential direction of the main assembly shutter 334, being bordened by the projection 334*b*.

(Packing Member)

The packing member 335 as a sealing member is an elastic member (FIGS. 13, and 20–26). It assures that the toner outlet 311*a* is airtightly sealed by the container shutter 316. For example, it prevents the toner within the toner container 311 from leaking due to the impact caused the falling or the like of the toner replenishing container. For effectiveness, the packing member 335 is pasted to the outwardly-facing surface of the toner container 311 in a manner of surrounding the toner outlet 311*a*. More specifically, the material for the packing member 335 is rubbery material, such as silicon rubber, urethane rubber, foamed polyethylene rubber, or the like, or sponge made of these rubbers. Preferably, it is slightly foamed polyurethane which is 20–70 deg. in harness, no more than 10% in permanent compressive deformation, 60–300 $\mu$m in cell size, 0.15–0.50 g/in density, and 5–50% in compression ratio.

The packing member 335 is shaped so that the top surface of the portion next to the longitudinal edges of the toner outlet 311*a* is slanted downward toward the toner outlet 311*a*.

The packing member 335 shaped as described above is fixed to the surfaces adjacent to the toner outlet 311*a* with the use of adhesive or the like.

(Sealing Member)

As the toner-replenishing container 301 is installed into the toner-replenishing apparatus 100, the container shutter 316 fits into the indentation 334*c* (space between the two projections 334*b*) of the main assembly shutter 334. The indentation 334*c* extends across the main assembly shutter 334 in the longitudinal direction, and the surface 334*b*1 functions as the guide for the container shutter 316. After the container shutter 316 is fitted in the indentation 334*c* of the main-assembly shutter 334, the plane of the inwardly facing surface of the projection 334*b*, i.e., the brim of the main-assembly shutter opening 334*d*, and the plane of the inwardly-facing surface of the container shutter 316 are at approximately the same level. Referring to FIGS. 20–26, the container shutter 316 is provided with a sealing member 341, which is on the surface on the container side. In order to cover the inwardly-facing surface of the projection 334*b* next to the toner inlet 333 of the main-assembly shutter 334, the sealing member 341 is extended downstream, in terms of the closing direction of the container shutter 316, beyond the container shutter 316. The sealing member 341 is a member for preventing the toner from entering the gap g between the container shutter 316 and the main assembly shutter 334. As long as this objective is accomplished, the material, shape, size, and method of attachment, of the sealing member 341 are optional.

Figure 29A:
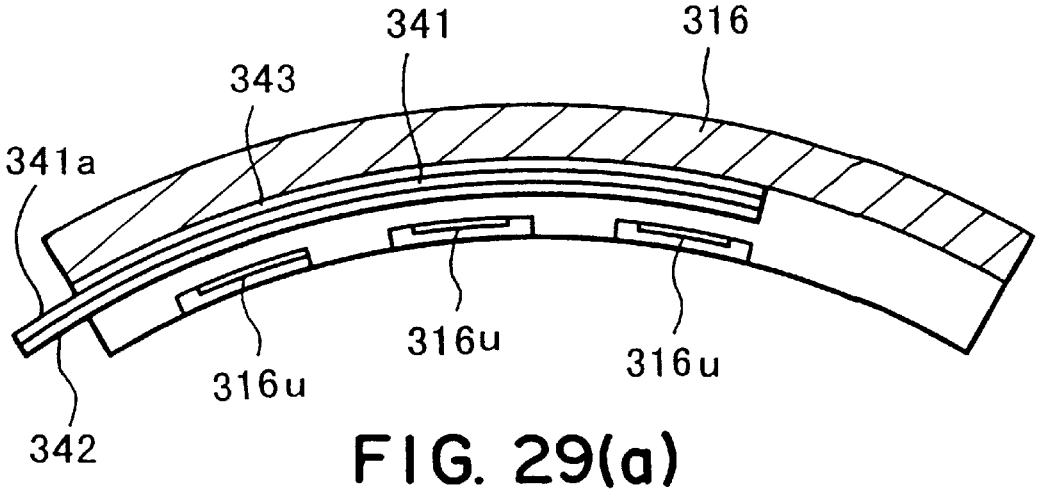
FIG. 29, (a and b) are both sectional views of the container shutter.
Figure 29B:
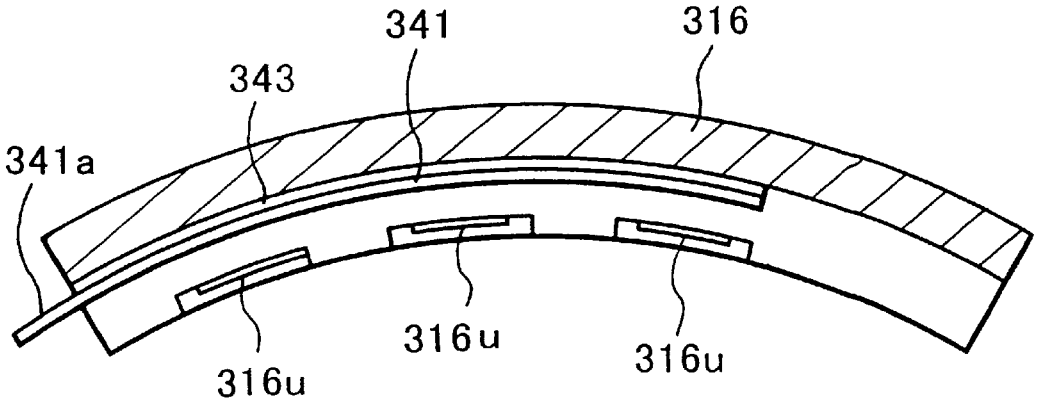
Figure 30:
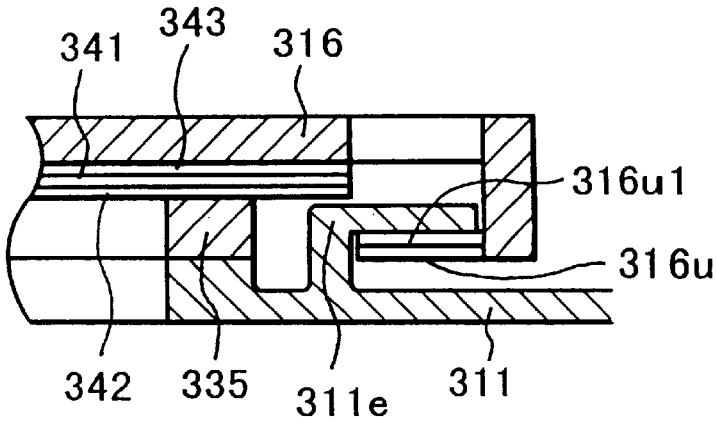
FIG. 30 is a sectional view of the toner shutter, perpendicular to the plane of FIG. 29, (a).

As for the preferable structure for the sealing member 341 in this embodiment a piece of 125 $\mu$m thick polyester sheet is pasted, as a sealing member, to the container shutter 316 with the use of double-side adhesive tape (#5000NC: Nitto Denko Co., Ltd.) (FIG. 29).

More specifically, since the sealing member 341 is structured to cover the projection 334*b* of the main-assembly shutter 334 as described before, it is desired not to interfere with the installation or removal of the toner-replenishing container 311 by hanging up or colliding. The main-assembly shutter 334 is not necessarily smooth on the container facing surface. But, the sealing member 341 is required to perfectly conform to the container-facing surface of the main assembly shutter 334. Because of requirements such as the above, the sealing member 341 is desired to be formed of a flexible sheet or a sheet formed of elastic material.

As for the method for attaching the sealing member 341, any of various known attaching means may be employed in addition to the aforementioned double-side adhesive tape as long as it satisfies the requirement that the sealing member 341 does not peel off in spite of repetitive opening and closing of the container shutter 316 that occurs as the toner-replenishing container 301 is repeatedly installed or removed.

It is most preferable that elastomer be used as the material for the sealing member 341, and the sealing member 341 be integrally formed with the container shutter 316 by two color injection molding. In such a case, it is desired that the elastomer for the sealing member 341 and the material for the container shutter 316 are compatibly selected. Also, the sealing member 341 and container shutter 316 may be formed of the same material. In such a case, they can be integrally formed with the use of a simple method.

(Function of Sealing Member)

Next, the function of the sealing member 341 will be described.

Figure 28:
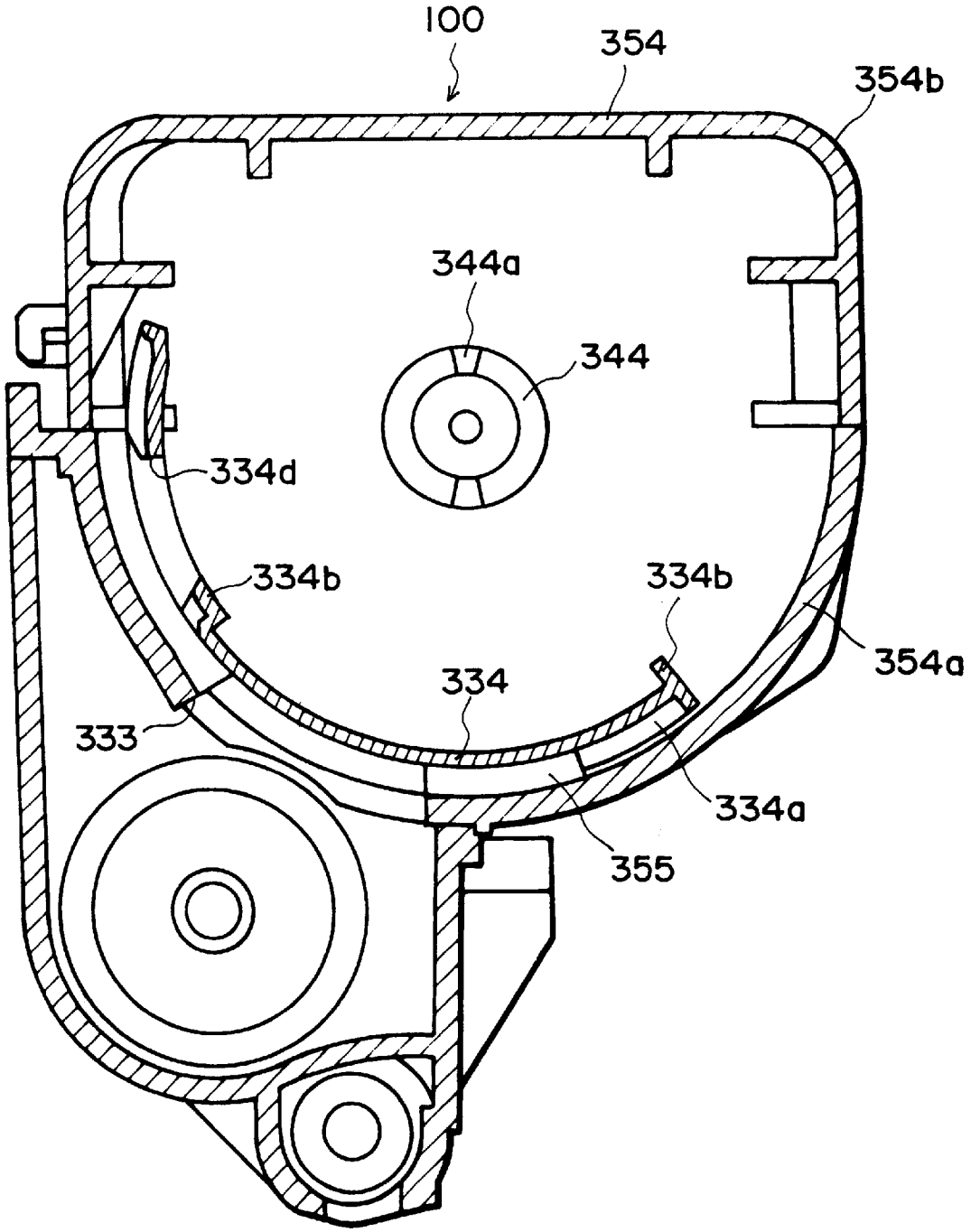
FIG. 28 is a sectional view of the shutter portion and its adjacent areas of a toner-replenishing apparatus in which a toner-replenishing container has not been installed.

The state of the main assembly of the toner-replenishing apparatus 100 when the toner-replenishing container 301 has been removed, that is, when the container shutter 316 is not in engagement with the main-assembly shutter 334 as shown in FIG. 28. In this state, the main-assembly shutter 334 is positioned to seal the toner outlet 333 to prevent foreign substances, such as dust, from entering the toner-replenishing container 301 through the toner outlet 333.

FIG. 21 shows the state in which the toner-replenishing container 301 has been installed, and the toner is being replenished. In this state, the container shutter 316 has retreated from the toner outlet 311*a*, allowing a passage to be formed through the toner outlet 311*a*, main-assembly shutter opening 334*d*, and toner inlet 333. Also in this state, the plane of the container-facing surface of the container shutter 316 and the plane of the container-facing surface of the projection 334*b* next to the opening 334*d* of the main assembly shutter 334 is at approximately the same level. Therefore, the sealing member 342 is in contact with the projection 334*b* of the main-assembly shutter 334, keeping the toner passage airtight, and at the same time, preventing the toner from adhering to the surface of the projection 334*b* of the main assembly shutter 334. Also in this state, the toner having been stored in the toner-replenishing container 301 is conveyed toward the toner stirring-conveying apparatus 345, i.e., a toner-receiving apparatus, by the function of the toner-conveying member 329 container in the toner-replenishing container 301 through the toner outlet 311*a*, opening 334*d*, and toner inlet 333 through which the toner passage has been established.

Figure 23:
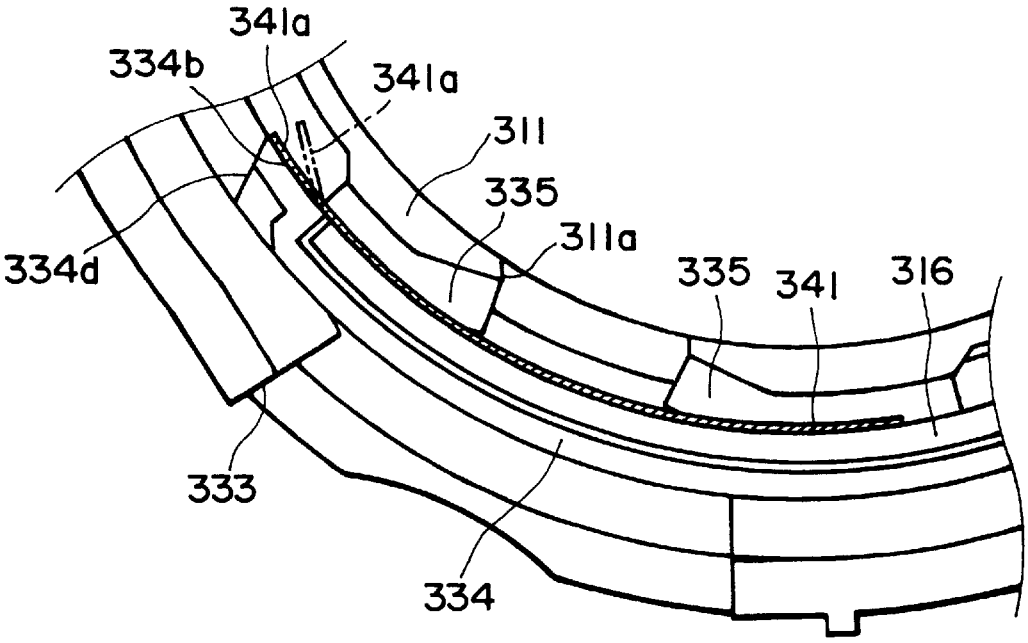
FIG. 23 is an enlarged view of a portion of FIG. 20.
Figure 24:
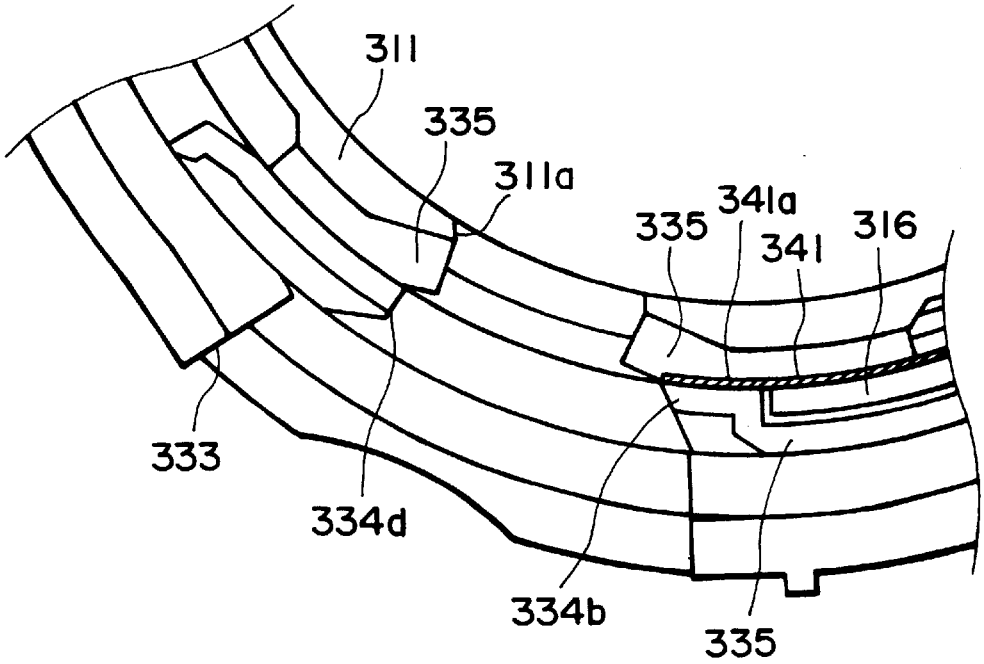
FIG. 24 is an enlarged view of a portion of FIG. 21.

Referring to FIGS. 20, 21 (enlarged drawing of a part of FIG. 1), 23, and 24 even if the end portion of the sealing member 341 is pinched between the projection 334*b* of the main assembly shutter 334 and the packing member 335 while the shutters 36 and 334 are moved in the opening direction from the positions in FIG. 23 to the positions in FIG. 24, the airtightness of the toner passage at this location is not broken, because the sealing member 341 is formed of a thin PET sheet. For assurance, the thickness of the sealing member 341 is desired to be no less than 50 μm and no more than 300 μm, preferably, no less than 70 μm and no more than 200 μm, and ideally, 125 μm. If the sealing member is excessively thick, it fails to properly seal the gap between the main assembly shutter 334 and toner replenishing container 301. On the other hand, if it is excessively thin, it fails to properly perform its primary function, that is, the function to prevent the toner from entering between the container shutter 316 and main assembly shutter 334. As a result, various problems occur while the toner replenishing container 301 is handled, in particular, while the toner replenishing container 301 is installed into, or removed from, the toner-replenishing apparatus 100. For example, the sealing member 41 is peeled back or wrinkled.

The requirement regarding the thickness of the sealing member 341 can be eliminated by the provision of the structure in which the sealing member 341 is retracted to a point where the sealing member 341 does not contact the packing member 335. However, such a structure makes the shutter stroke substantially longer, making it difficult to give a toner-replenishing apparatus and a toner-supplying container a compact design.

Figure 25:
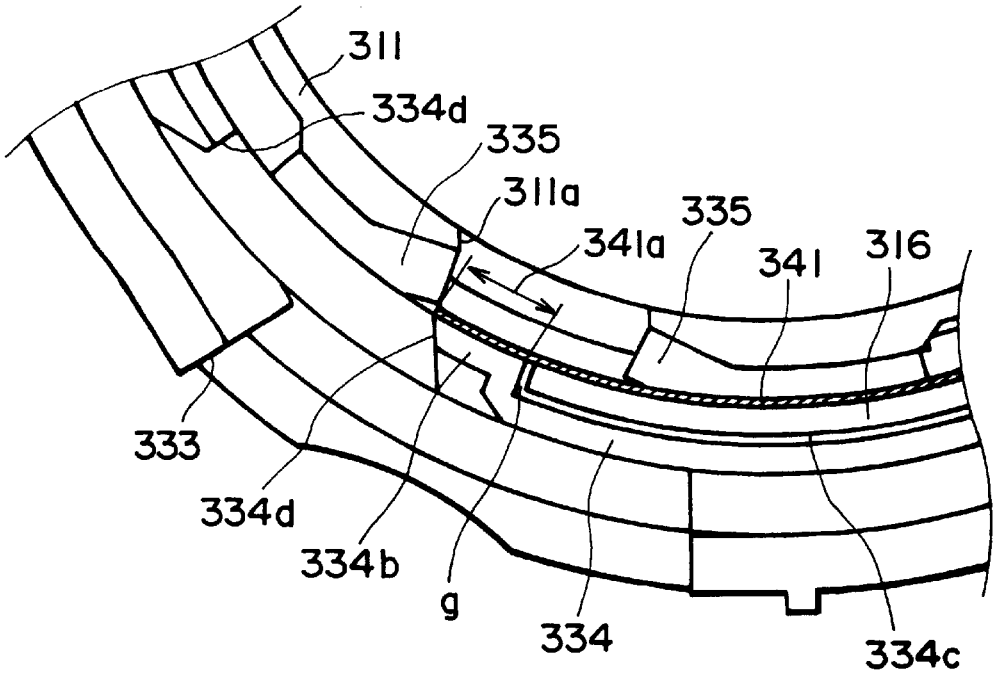
FIG. 25 is an enlarged view of a portion of FIG. 22.
Figure 26:
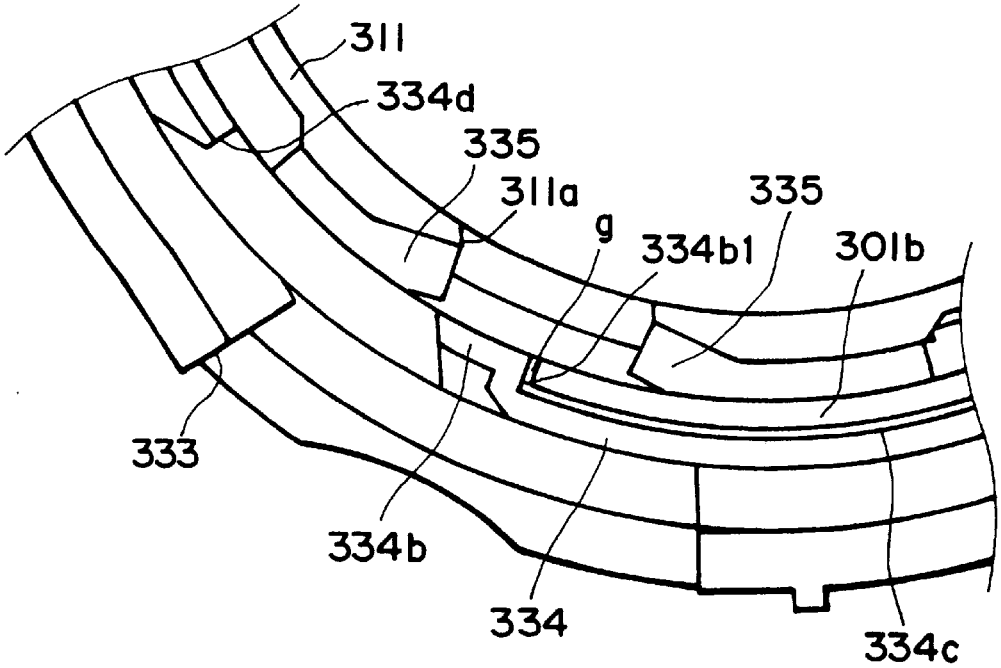
FIG. 26 is a sectional view of the shutter portion and its adjacent areas of a comparative example of a toner-replenishing container, which corresponds to the FIG. 25.
Figure 27:
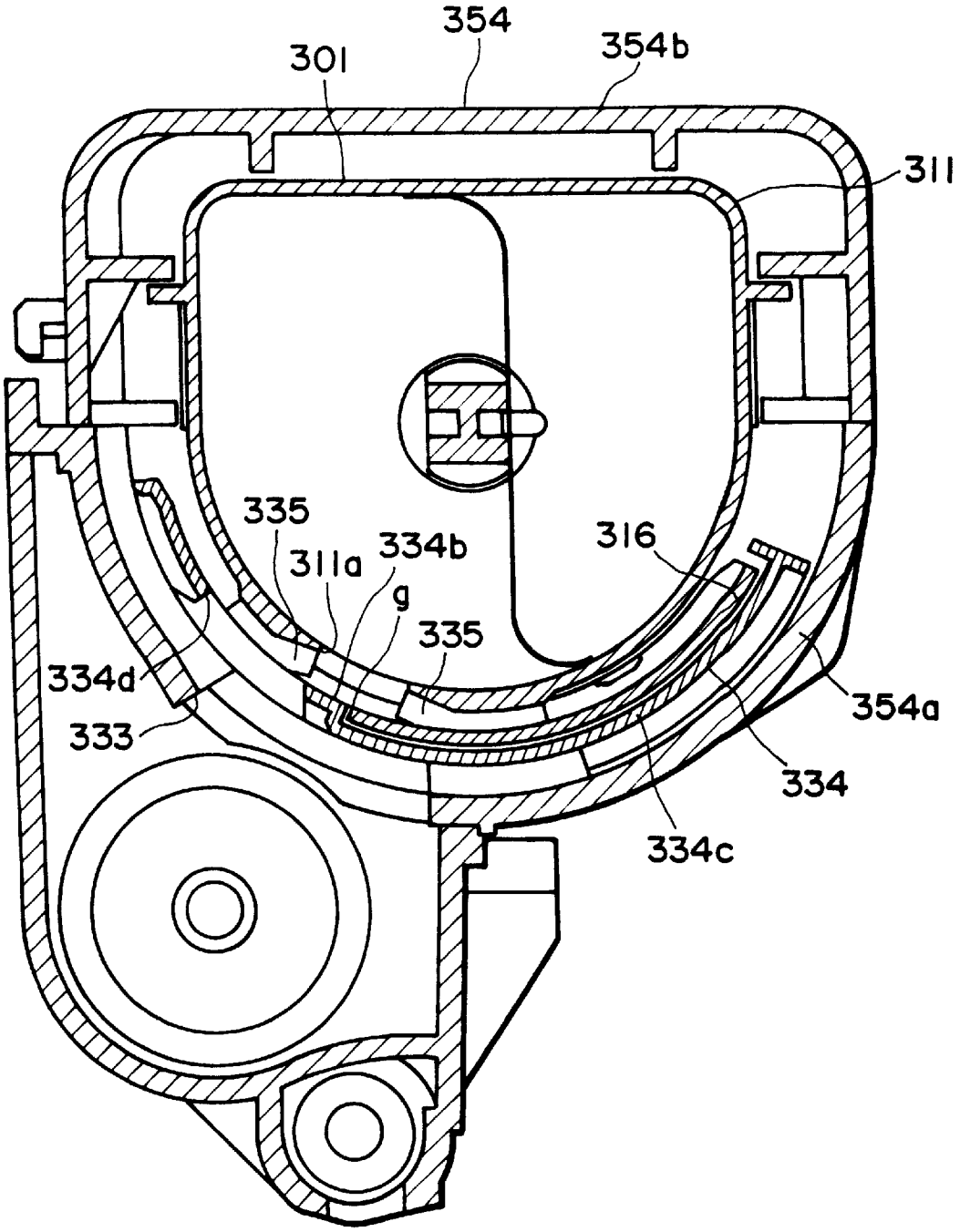
FIG. 27 is a sectional view of the shutter portion and its adjacent areas of another comparative example of a toner-replenishing container which corresponds to the FIG. 22.

Next, a state in which the toner-replenishing container 301 is removed before a "no toner" light in the warning panel 124*a* is lit, and the function of the sealing member 341 in such a state, will be described. In this state, a substantial amount of toner is still stored in the toner-replenishing container 301. In other words, any of the toner outlets 311*a* of the toner-replenishing container 301, the main-assembly shutter opening 334*d,* and the toner-supply inlet 333, is filled with the toner. The first step to be taken to remove the toner-replenishing container 301 in this state is to seal the open portions. As the container shutter 316 is moved in the closing direction, the main assembly shutter 334, which is in engagement with the container shutter 316, moves with the container shutter 316 in the direction to close the toner-replenishing container 301. The toner at the main-assembly shutter opening 334*d* moves undisturbed in the closing direction, and becomes separated from the toner in the toner-replenishing container 301 and the toner in the toner stirring-conveying apparatus 345, as shown in FIG. 25. During this closing step, the gap g between the main-assembly shutter 334 and container shutter 316 passes directly below the toner outlet 311*a* as shown in FIG. 25. Thus, if there were no sealing member 341 as shown in FIGS. 26 and 27, the toner within the toner-replenishing container 301 would rush into the gap g. In reality, however, the sealing member 341 covers this gap g as shown in FIG. 25, preventing the toner from entering the gap g.

Also during this closing step, the sealing member 341 and container shutter 316 are under the constant pressure generated downward (in the drawings) by the resiliency of the packing member 335. Therefore, the portion 341*a* of the sealing member 341 that extends beyond the edge of the sealing member 341, is also pressed upon the container-facing surface of the main assembly shutter 334, not only gaining in sealing performance but also in preventing the toner from adhering to the surface of the projection 334*b* of the main assembly shutter 334.

The state in which main assembly shutter 334 and container shutter 316 have been completely closed is as shown in FIG. 23. In this state, the toner adhesion to the exterior surfaces of the container shutter 316 and toner container 311 is prevented although the toner adheres to the surface of the extension portion 341*a* of the sealing member 341, on the side of the toner-replenishing container 301. The amount of the toner which adheres to the inwardly-facing surface of the aforementioned extension portion 341 a of the sealing member 341, is extremely small, and also, the location at which the toner adheres to the extension portion 341*a* is in the small pocket created between itself and the toner container 311. Therefore, it is very difficult for the toner to come out once it adheres to the extension portion 341*a;* it rarely scatters outward of the pocket.

For a reason which will be described later, the length by which the aforementioned extension portion 341*a* extends is desired to be approximately the same as the width of the projection 334*b* of the main assembly shutter 334. More specifically, it is desired to be set at a value no less than 2 mm and no more than 10 mm, preferably, no less than 4 mm and no more than 8 mm, and ideally, at 6 mm. If the extension portion 341*a* is excessively short, it is unsatisfactory in terms of effectiveness in preventing the toner invasion of the aforementioned gap g, and also, the aforementioned pocket which the sealing member 341 and toner container 311 form is shallow, failing to retain the toner. In addition, it fails to prevent the toner adhesion to the surface of the projection 334*b* of the mainassembly shutter 334.

On the other hand, if the extension portion 341*a* is excessively long, it interferes with the installation or removal of the toner replenishing container 301. For example, it collides with the various portions of the internal surface of the toner replenishing apparatus 100, which is a problem. In addition, the pressure generated by the aforementioned packing member 335 fails to be transmitted to the farthest portion of the extension portion 341*a,* causing the sealing member 341 to lose in sealing performance. Obviously, the pressure can be transmitted to the farthest portion of the extension portion 341*a* of the sealing member by increasing the rigidity of the sealing member 341. However, such a practice reduces the ability of the sealing member 341 to conform to the surface of the main-assembly shutter 334, also causing the sealing member 341 to lose in sealing performance. Further, if the extension portion 342*a* is excessively long, it makes the main-assembly shutter opening 334*d* too small, possible interfering with the passage of the toner.

A case in which the sealing member 341 is not provided is shown in FIGS. 26 and 27. In this case, as the main assembly shutter 334 is moved in the closing direction before the "no toner" light is lit, the gap g between the container shutter 316 and main assembly shutter 334 is exposed to the toner. As a result, the toner invades the gap g, and the outwardly-facing surface of the container shutter 316 is contaminated by the adhesion of the toner which invaded the gap g. Since there is no outlet for the toner which invaded the indentation of the main assembly shutter 334*c,* i.e., the shape between the mutually facing surfaces 334*b*1 of the projections 334*b* of the main-assembly shutter 334, the toner continues to accumulate there. Therefore, unless the indentation 334*c* is cleaned during the maintenance of the image forming apparatus, the contamination of the toner-replenishing container 301 worsens. Further, the toner also adheres to the projection 334*b* of the main-assembly shutter 334, and this toner transfers onto the toner-replenishing container 301, on the surface which opposes the projections 334*b;* in other words, it contaminates the toner-replenishing container 301.

(Sealing Member Design 1 Different from Preceding Design)

In the case of this design, a material low in friction is placed on the surface of the sealing member.

In order to gain in sealing performance, the ratio with which the packing member 335 is compressed is desired to be as high as possible, since the compressive stress of the packing member 335 is proportional to the compression ratio. In other words, when the compression ratio is small, the compressive stress of the packing is also small, and therefore, the sealing performance of the packing member 335 is at an unsatisfactory level. Thus, when the compression ratio is small, the toner leak due to the impact caused a fall or the like of the toner replenishing container. On the other hand, if the compression ratio is excessively increased, the stress of the packing member 335 also becomes excessively high. This improves the packing member 335 in sealing performance, and at the same time, increases load in terms of sliding. As a result, the force required to open or close the container shutter 316 increases.

Thus, in order to improve the sealing performance while reducing, or at least without increasing the force necessary to drive the shutter, a piece of flexible film 342 as a low friction material is pasted to the sealing member 341, on the surface which faces the packing member 335, so that the amount of the frictional resistance between the surfaces of the sealing member 341 and packing member 335 is reduced. More specifically, a flexible film created by coating silicon oil, silicone wax, silicone containing paint, or the like, on a base film, for example, film comprising a single layer of polyester, biaxially stretched polypropylene (OPP), polyamide, polyethylene, or fluorinated resin, or film comprising mixed layers of preceding materials, is used as the material for the flexible film 342.

The thickness of the layer of the silicone oil on the aforementioned flexible film 42 is desired to be in a range of 0.05 μm–2 μm, preferably, 0.1 μm–0.5 μm. If the thickness of the coated layer of silicone oil is excessively thick, the toner in the toner container 311 is negatively affected, whereas if it is excessively thin, the flexible film 342 is not effective to satisfactorily reduce the force necessary to open or close the shutters.

The toner-replenishing container 301 with the above-described structure was installed in the toner-replenishing apparatus 100, and the operation for removing the toner-replenishing container 301 before the "no toner" light is lit was repeated. However, just as in the case of the sealing member illustrated in FIG. 29, (b), there was no sign of contamination traceable to the toner adhesion to the outwardly facing surface of the container shutter 316 and its adjacent areas, and no sign of toner accumulation, proving that the above-described structure improved the sealing performance of the sealing member without increasing the driving force necessary to open or close the container shutter 316.

(Sealing Member Design 2 Different from Preceding Two Designs)

In this version, as the toner-replenishing container 301 is inserted into the toner-replenishing apparatus 100, the extension portion 341*a* of the sealing member 341 rides onto the projection 334*b* of the main assembly shutter 334 from the one of the longitudinal ends of the projection 334*b* of the main assembly shutter 334.

Figure 36:
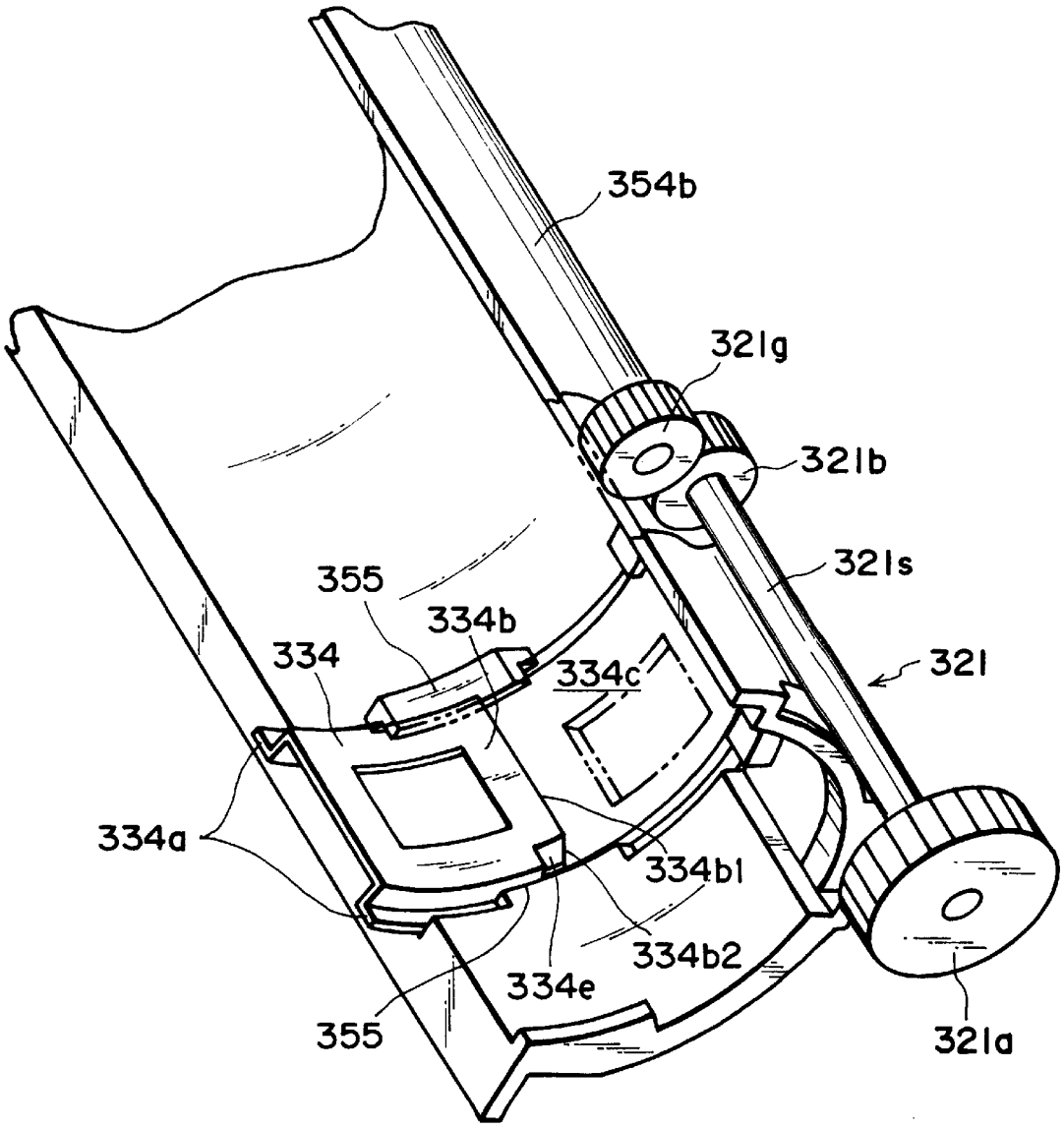
FIG. 36 is a perspective view of the shutter portion and its adjacent areas of the toner-replenishing apparatus.
Figure 48:
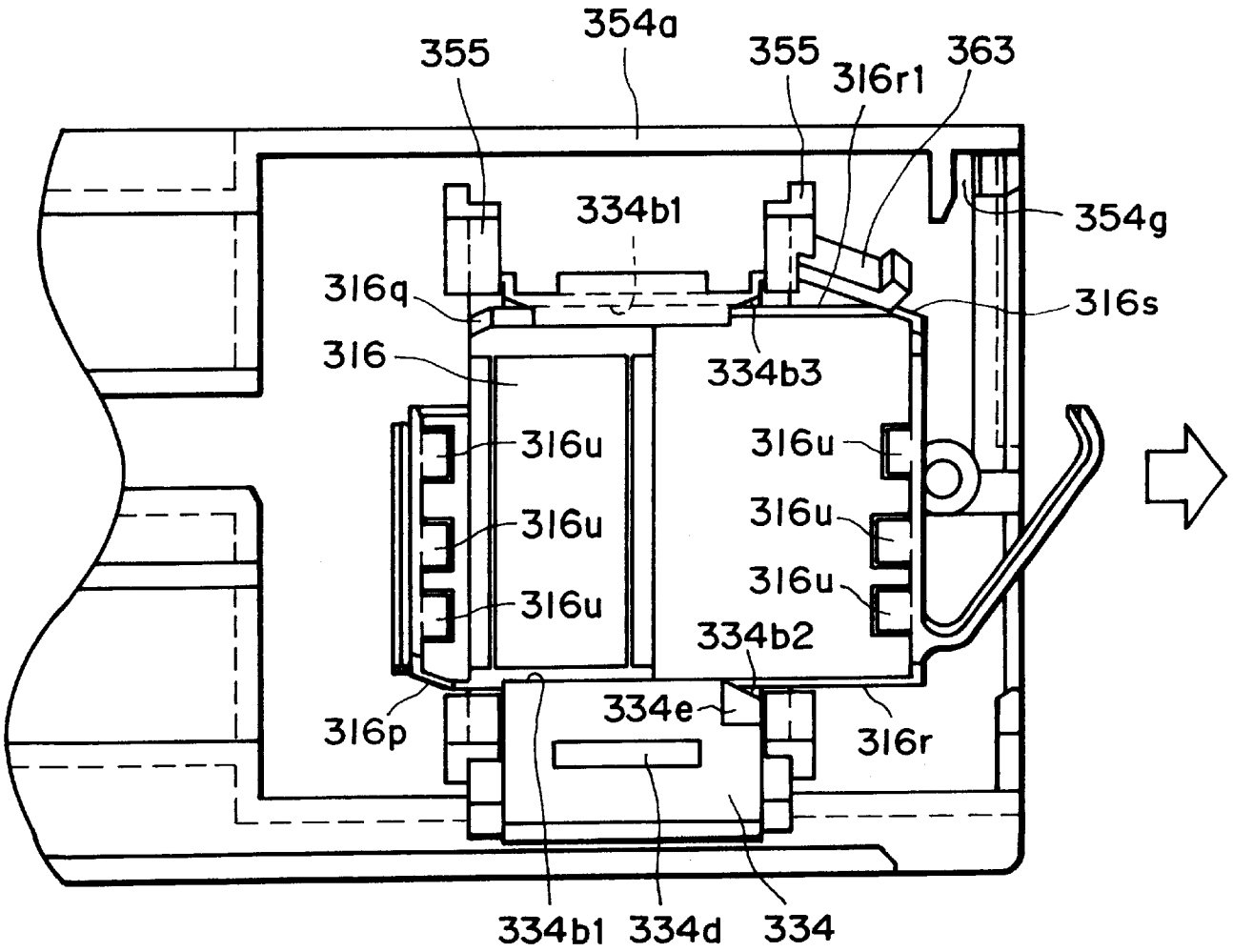
FIG. 48 is a horizontal sectional view of the toner-replenishing apparatus.
Figure 49:
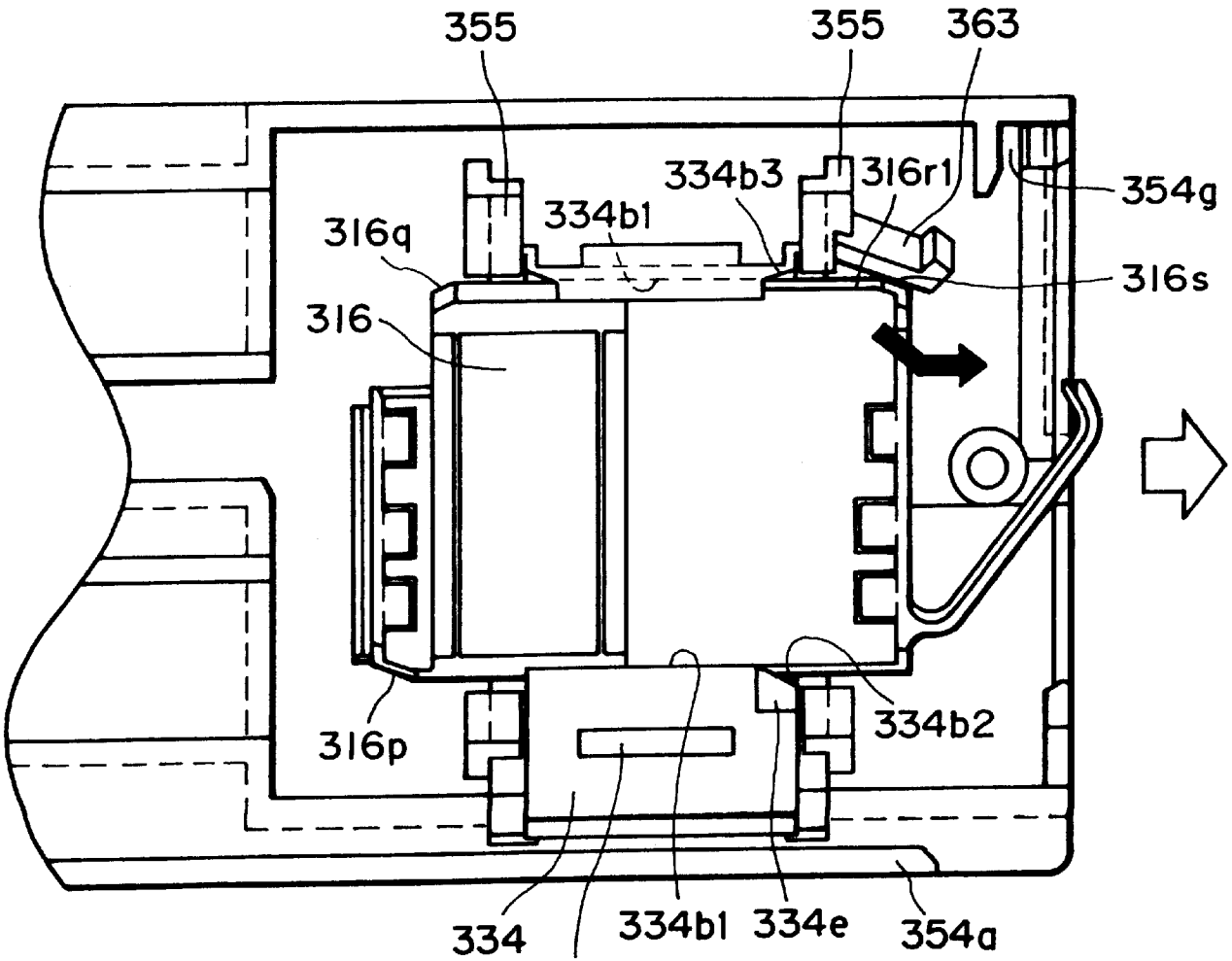
FIG. 49 is a horizontal sectional view of the toner-replenishing apparatus.

Thus, in order to make it easier for the contamination shutter 316 to slide into the indentation 334*c* (space) between the opposing surfaces 334*b*1 of the projections 334*b* of the main-assembly shutter 334, the projection 334*b* of the main-assembly shutter 334 is chamfered at the opposing downstream corners in terms of the inserting direction, i.e., both downstream corners in FIG. 36 (right-hand corner is behind the bottom portion 354*b* of the toner replenishing apparatus main assembly 354), creating the surface 334*b*2, and the corresponding corners of the container shutter 316 are also chamfered, creating surfaces 316*p* and 316*q* (FIGS. 48 and 49).

Further, referring to FIG. 36, the main-assembly shutter 334 is provided with an entrance guide portion 334*c*, which is located at the upstream corner of the projection 334*b* of the main assembly shutter 334 to allow the extension portion 341*a* of the sealing member 341 to smoothly ride onto the projection 334*b*. This entrance guide portion 334*c* is a slanted surface, which is located on the upstream corner of the projection 334*b*, and inclines in the downward and upstream direction from the container facing surface of the projection 334*b*.

The provision of an entrance-guide portion, such as the one described above, is effective in preventing the extension portion 341*a* from being damages at the corners as the extension portion 341*a* of the sealing member 341 rides onto the projection 334*b* of the main assembly shutter 334.

FIGS. 31–35 show the structure for helping the extension portion 341*a* of the sealing member 341 advance farther on the projection 334*b* from the entrance-guide portion 334*e* of the projection 334*b* of the main-assembly shutter 334.

Figure 31:
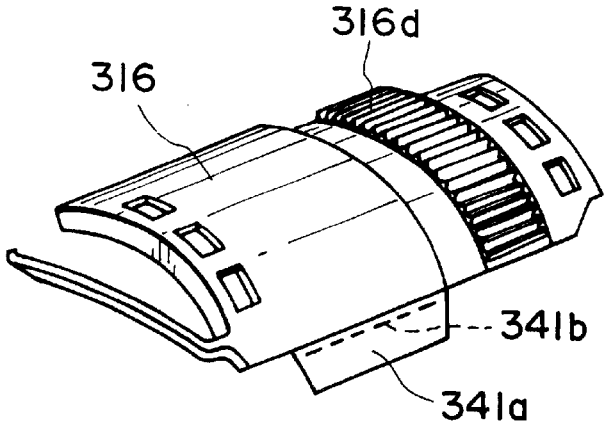
FIG. 31 is a perspective view of the container shutter (perforation).
Figure 34:
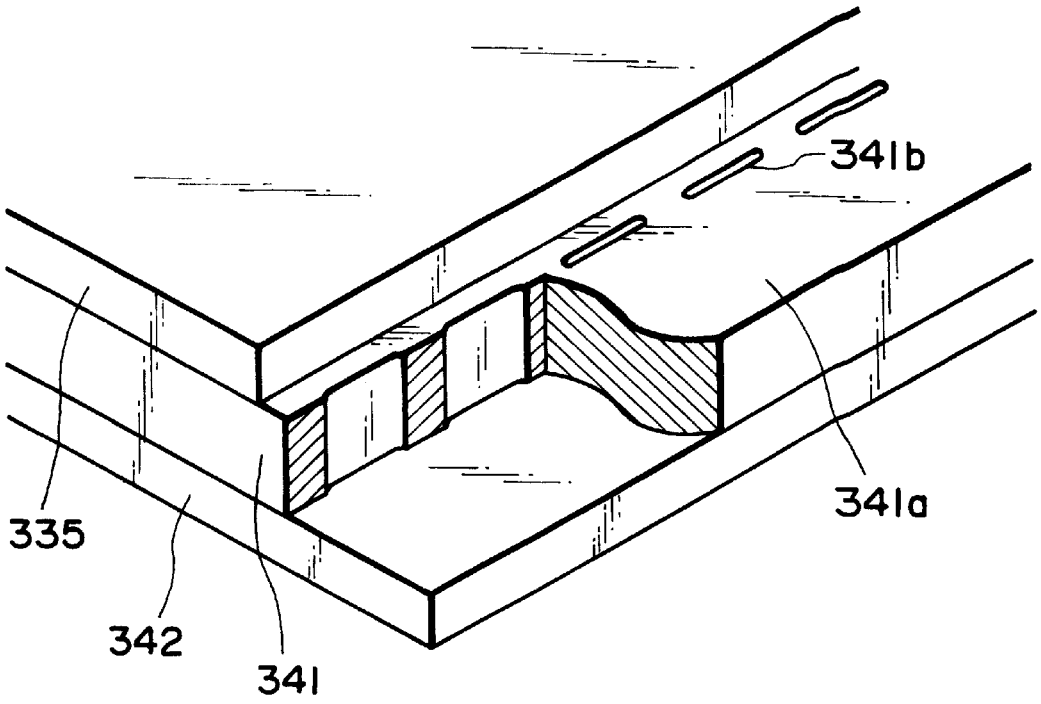
FIG. 34 is a perspective view of the sealing member of the container shutter (perforation).
Figure 35:
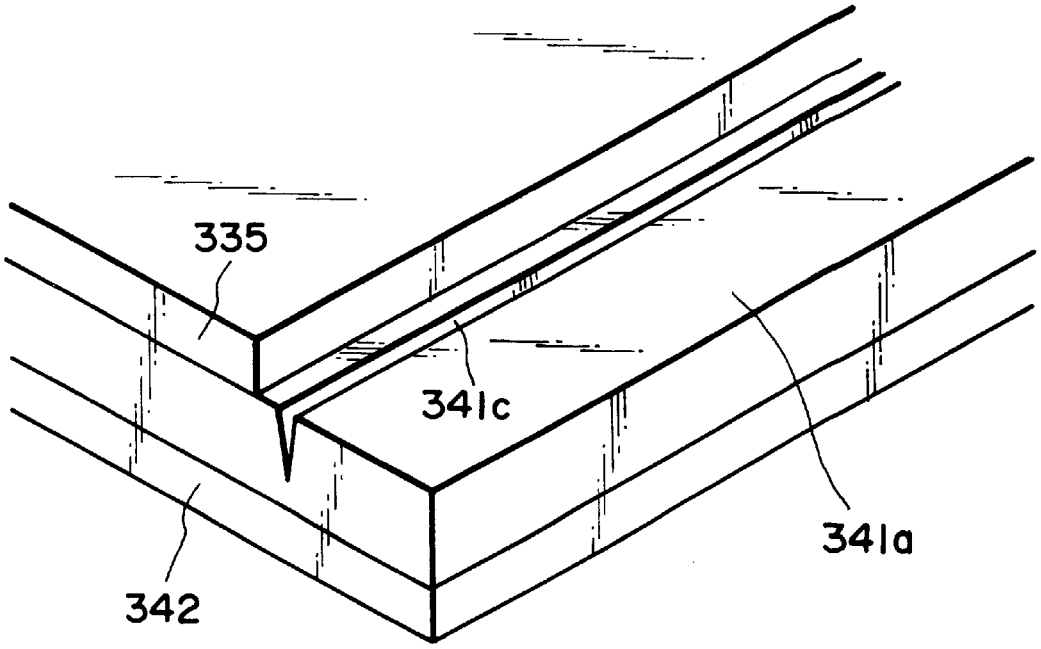
FIG. 35 is a perspective view of the sealing member of the container shutter (groove).

Referring to FIG. 31, the sealing member 341 is provided with a single line of perforation 341*b*, which extends along the base portion of the extension portion 341*a*. FIG. 34 is a perspective view of the sealing member 341 provided with the perforation 341*b*. Referring to FIG. 35, instead of being provided with the perforation 341*b*, the sealing member 341 may be provided with a groove 341*b*, the sealing member 341 may be provided with a groove 341*c* which extends along the extension portion 341*a* of the sealing member 341 in the longitudinal direction. In this embodiment, the groove 341*c* may be V-shaped or U-shaped in cross section.

With the provision of the above arrangement, as the extension portion 341*a* of the sealing member 341 comes in contact with the entrance guide portion 334*e* of the main assembly shutter 334 before it rides onto the projection 334*b* of the main assembly shutter 334, it bends at the perforation or groove, preventing its longitudinal end from being damaged.

Figure 32:
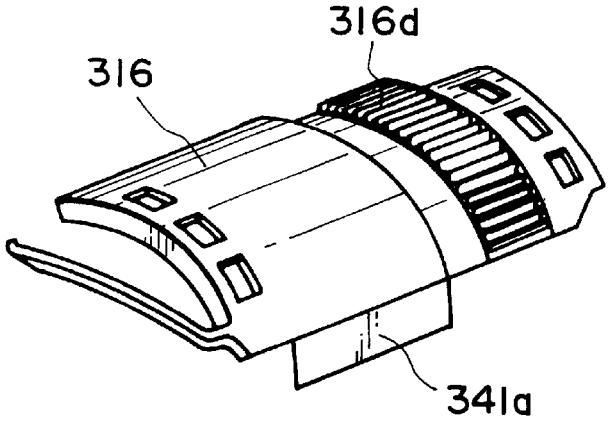
FIG. 32 is a perspective view of the container shutter (bent).
Figure 33:
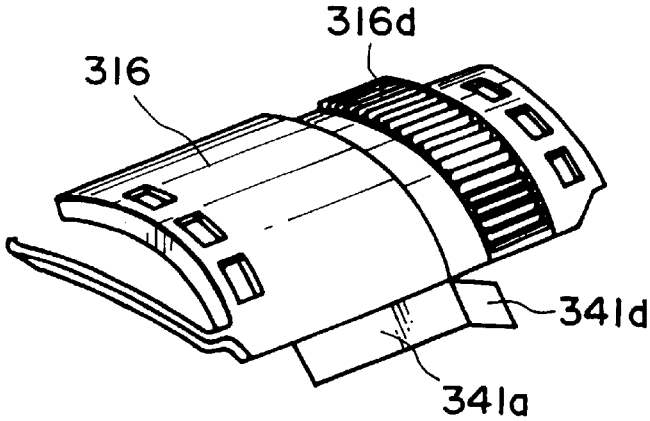
FIG. 33 is a perspective view of the container shutter (projection).

In the preceding description to the sealing member 341, the sealing member 341 inclusive of the extension portion 341*a* was arc-shaped in cross section. However, the extension portion 341*a* of the sealing member 341 may be bent at its base line toward the toner container 311, as shown in FIG. 32. Being bent as described above, the extension portion 341*a* can smoothly ride onto the projection 334*b* of the main-assembly shutter 334 as depicted by the double dot chain line in FIG. 23. Even if the extension portion 341*a* is bent in this manner, when the container shutter 316 and main-assembly shutter 334 open the toner outlet 311*a* and main-assembly shutter opening 334*d*, the extension portion 341*a* is pinched at both longitudinal edges between the packing member 335 and the other projections of the main assembly shutter 334, perpendicular to the projection 334*b*. Therefore, the projection 334*b* and the extension portion 341*a* tightly contact with each other. In the case of the design illustrated in FIG. 32, since the extension portion 341*a* is bent, its tip portion remains firmly in contact with the packing member 335, sliding on the packing member 335, during the opening or closing of the container shutter 316. Therefore, it is liable that the extension portion 341*a* becomes damaged. The design illustrated in FIG. 33 is a design in which the above concern was eliminated. In this design, the extension portion 341*a* is provided with a sub-extension portion 341*d,* which extends at an angle from the downstream edge, in terms of the toner replenishing container 301 installation direction, of the extension portion 341*a*. In this case, extension portion 341*d* is positioned not to contact the packing member 335. Therefore, the aforementioned problems do not occur. In other words, this embodiment is the ideal one.

(Locking Member)

The toner cartridge is provided with a locking member 351 so that the handle 315 is locked to the toner container 311 before the toner-replenishing container 301 is installed into the main assembly 124 of an image forming apparatus, and after the toner-replenishing container 301 has been removed from the apparatus main assembly 124 (FIGS. 16 and 17).

The locking member 351 is rotationally fitted around the first flange 312, more specifically, the locking member engagement portion 312*g* of the first flange portion, that is, the portion immediately next to the end plate 312*b* of the first flange 312. It is also movable in the direction in which the toner-replenishing container 301 is inserted into, or removed from, the toner-replenishing apparatus 100 (direction indicated by an arrow mark in FIG. 16, and also the opposite direction).

Figure 12:
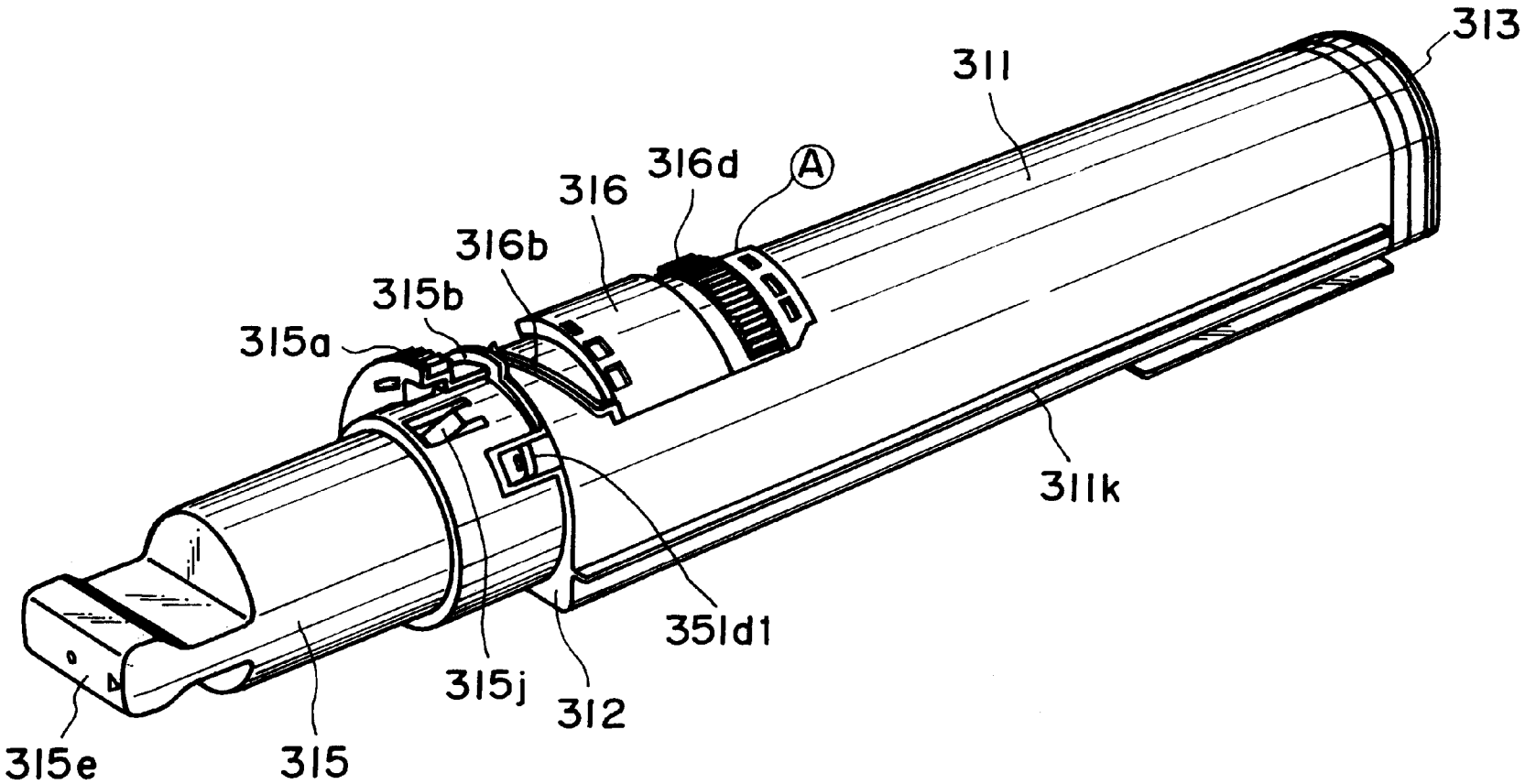
FIG. 12 is a perspective view of the toner replenishing container placed upside down.

The locking member 351 comprises a cylindrical ring portion 351*a,* i.e., the portion which fits around the locking member engagement portion 312*g,* and is provided with a notch 351*b* that faces the aforementioned end plate 312*b*. The notch 351*b* is in engagement with the locking projection 312*h* with which the first flange 312 is provided. The locking member 351 integrally comprises an arm-like springy portion 351*c* that presses upon the end surface 315*i* of the handle 315. The first flange 312 is provided with a circumferential ridge 312*i* which is on the cylindrical portion 312*e,* and circles around the cylindrical portion 312*e*. Further, the handle 315 integrally comprises a stopper 315*j,* which is formed by outwardly bending a portion of the handle 315. The tip of the stopper 315*j* is kept in contact with the ridge 312*i* by the resiliency of the aforementioned springy portion 351*c,* to prevent the handle 315 from slipping off the cylindrical portion 312*e* of the first flange 312 (FIG. 12). Further, the locking member 351 is kept in contact with the end plate 312*b* of the first flange 312 by the resiliency of the springy portion 351*c*.

The springy portion 351*c* is gradually reduced in cross section toward its tip, being enabled to evenly bend across its entire length, to prevent the base portion of the springy portion 351*c* from turning white due to the concentration of the bending stress to the base portion. In other words, when the cross section of the springy portion 351*c* is rectangular, it is made gradually smaller in the width or thickness direction toward the tip. Therefore, the springy portion 351*c* gradually reduces in cross section from its base portion to its tip.

Figure 47:
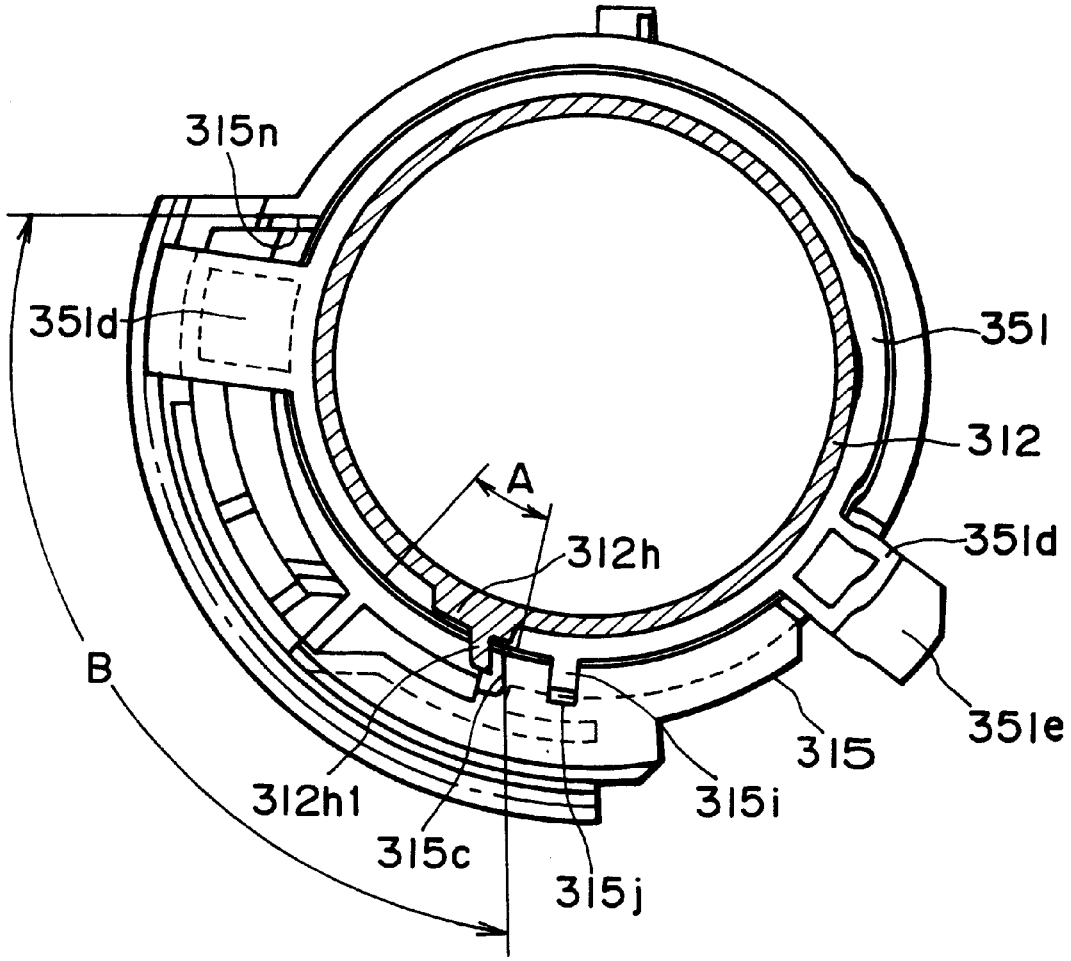
FIG. 47 is a sectional view of the toner-replenishing container, at the handle-locking member position.

A pair of engagement ribs 351*d* provided on the outwardly facing surface of the locking member 351 are enabled to move in the installation-removal direction of the toner replenishing container 301 by being loosely fitted, one for one, in grooves 315*k* and 315*m* which are cut in the handle 315 in the installation-removal direction of the toner replenishing container 301. The engagement rib 351*i* of the ring-like member 351 is engaged in the groove 315*j* of the handle 315. Therefore, the handle 315 and locking member 351 are prevented from moving relative to each other in their circumferential direction, but are allowed, to move relative to each other in their axial direction (FIGS. 46 and 47).

The length, in terms of the installation-removal direction of the toner replenishing container 301, of the locking projection 312*h* provided on the first flange 312 is less than the length of the stroke of the engagement ribs 351*d* through the grooves 315*k* and 315*m,* one for one, ion the installation-removal direction of the toner-replenishing container 301. Further, the length, in terms of the installation-removal direction of the toner-replenishing container 301, of the locking projection 312*h* is less than the length of the stroke of the engagement rib 351*i* of the locking member 351 through the groove 315*j* of the handle 315.

With the provision of the above structure, the notch 351*b* of the locking member 351 is kept engaged with the locking projection 312*h* of the first flange 312 by the resiliency of the springy portion 351*c* of the locking member 351. Therefore, whatever state the toner replenishing container 301 is in, the state in which it is being inserted into the toner-replenishing apparatus 100, the state in which it is being removed from the toner-replenishing apparatus 100, or the state in which it is out of the toner-replenishing apparatus 100, the handle 315 is not allowed to move in its circumferential direction relative to the toner container 311. More specifically, in this embodiment, the handle is allowed to slip in its circumferential direction by six degrees, which is equivalent to the amount of the play between the projection 312*h* provided on the first flange 312 and the notch 351*b* of the ring-like portion 351. It should be noted here that the projection 312*h* of the first flange 312 is provided also as a means for properly aligning the handle 315 relative to the toner-replenishing apparatus 100 in terms of the circumferential direction of the handle 315 when installing the toner container 311 into the toner-replenishing apparatus 100. This subject will be described later.

The locking member 351 is provided with a latch 351*c,* which is a thin piece of projection and projects outward in the radial direction from the engagement rib 351*d* which is adjacent to the springy member. The latch 351*e* prevents the toner replenishing container 301 from coming out of the main assembly 354.

(Function of Locking Member)

Next, the function of the locking member 351 will be described. As the toner-replenishing container 301 is inserted into the toner-replenishing apparatus 100 by engaging the guide portion 311*k* of the toner replenishing container 301 between the projections 354*d* of the toner-replenishing-apparatus main assembly 354, the container shutter 316 and main-assembly shutter 334 engage with each other. While the container shutter 316 engages with the main-assembly shutter 334, the driving-force-receiving engaging portion 316*d* of the container shutter 316 partially meshes with the driving-force-transmitting engaging portion 321*g,* and immediately thereafter, the driving-force-transmitting engaging portion 315*a* of the handle 315 partially meshes with the driving-force-receiving engaging portion 321*a*. After the container shutter 316 partially engages with the main-assembly shutter 334, the aforementioned extension portion 341*a* of the sealing member 341 rides onto the projection 334*b* past the entrance portion 334*e* of the main-assembly shutter 334.

Figure 42:
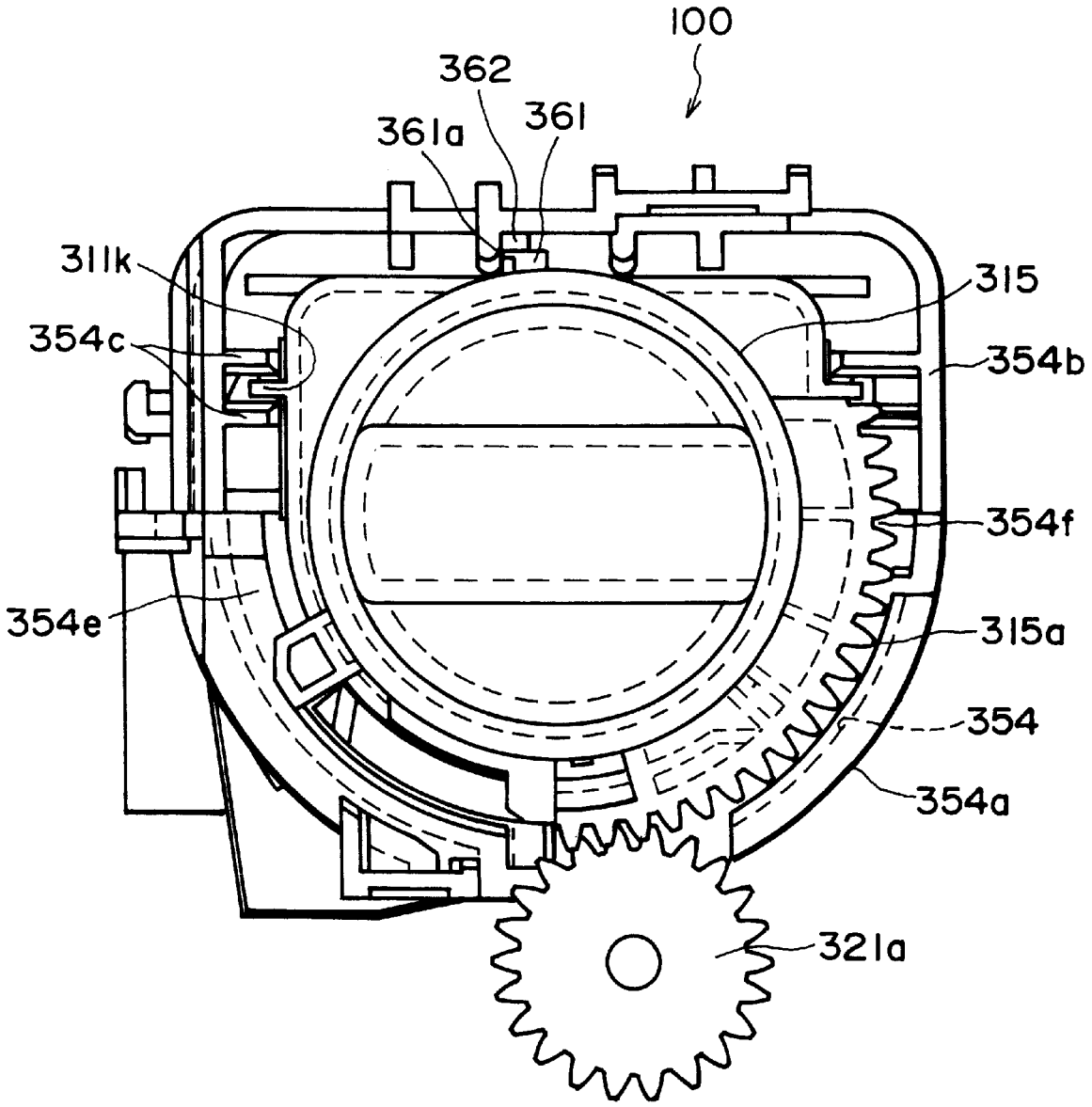
FIG. 42 is a sectional view of the toner-replenishing apparatus in which the toner-replenishing container has been installed, and describes the operation for installing the latter into the former.
Figure 43:
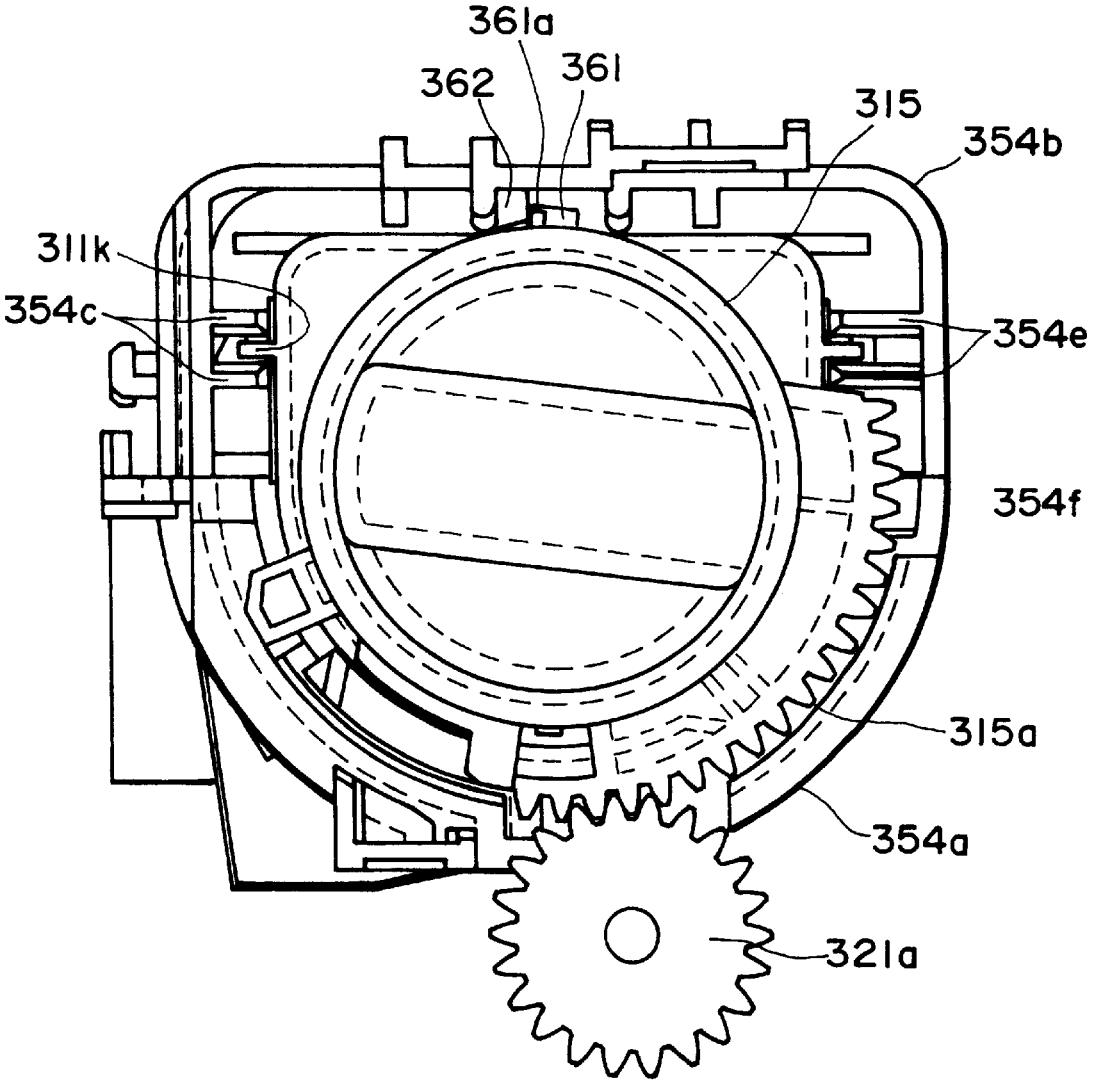
FIG. 43 is a sectional view of the toner-replenishing apparatus in which the toner-replenishing container has been installed, and describes the operation for installing the latter into the former.
Figure 44:
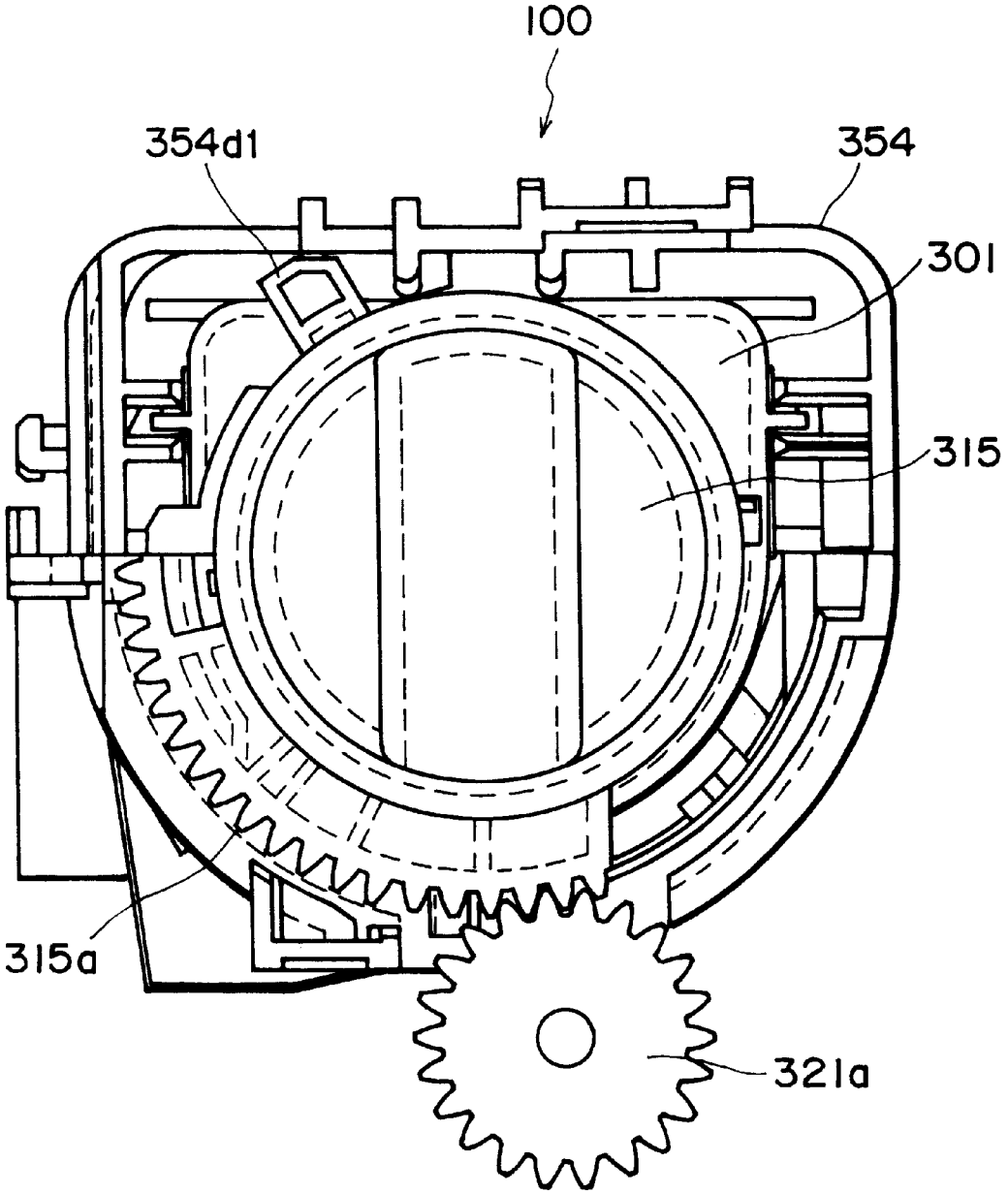
FIG. 44 is a sectional view of the toner-replenishing apparatus in which the toner-replenishing container has been installed, and describes the operation for installing the latter into the former.

Then, as the handle 315 is pushed in the installing direction, the projection 351*d*1 provided on the engagement rib 351*d* comes in contact with the striking surface 354*e* of the toner-replenishing-apparatus main assembly 354, and at the same time, the latch 351*e* comes in contact with the contact surface 354*f,* as shown in FIG. 17 (FIGS. 46 and 42).

Then, as the handle 315 is pushed in further, the handle 315, first flange 312, toner container 311, second flange 313, and the like, advance together in the same direction indicated by the arrow mark in FIG. 16, and causes the locking projection 312*h* of the first flange 312 to move out of the notch 351*b* as shown in FIG. 17.

In this state, the handle 315 can be rotated clockwise as seen from the upstream side in terms of the toner-replenishing container 301 installing direction (arrow direction in FIG. 17). Then, as the handle 315 is rotated, the locking member 351 rotates together with the handle 315, and immediately, the latch 351*e* engages into the groove 354*g* integrally provided in the strike surface 354*f* of the bottom portion 354*a* of the toner-replenishing apparatus main assembly 354 (FIGS. 48 and 49). The groove 354*g* is an ark-like groove which extends in the circumferential direction on the cylindrical wall of the bottom portion 354*a* of the toner-replenishing apparatus main assembly 354. After engaging into the groove 354*g,* the latch 351*e* remains in the groove 354*g* when the toner outlet 311*a* and main-assembly shutter 334 are opened or closed. Therefore, while the toner-supplying operation is carried out after the installation of the toner-replenishing apparatus 301 into the toner-replenishing apparatus 100, the toner-replenishing container 301 cannot be simply pulled out of the toner-replenishing apparatus 100. In other words, the toner-replenishing container 301 can be removed from the toner-replenishing apparatus 100 only when the container shutter 316 and main-assembly shutter 334 are closed, because the latch 351*e* is allowed to come out of the arc-like groove only when the container shutter 316 and main assembly shutter 334 are closed.

Regarding this locking mechanism, if the number of the lock releasing projection is only one, moment and/or deformation occurs to the locking member 351, preventing the locking member 351 from smoothly sliding. Further, even if the number of the lock-releasing projection is plural, if they are unevenly distributed, the same problem occurs. Therefore, it is desired that a plurality of lock-releasing projections are distributed in the circumferential direction with as even as possible intervals. In this embodiment, two projections are provided, being apart from each other by approximately 180 deg. In this embodiment, the latch 351*e* functions also as a lock releasing projection, the angle formed by the radial line connecting the projection 351*d*1 and the center of the locking member 351 and the radial line connecting the latch 351*e* and the center of the locking member 351 is approximately 150 deg.

Next, referring to FIG. 47, the lock-releasing timing of the locking member 351 will be described. The locking projection 312*h* for regulating the angle the locking member rotates is provided with a projection 312*h*1, which projects from the outwardly-facing surface of the locking projection 312*h* in the radial direction of the locking member 351, and is enabled to engage with the handle 315. The angle B through which the handle 315 rotates from the position at which the projection 312*h* is engaged in the notch 351*b* to the position at which the projection 312*h*1 contacts one of the groove walls 315*n* of the groove 315*m* of the engagement rib. is approximately 90 deg. As stated before, the groove 315 is the groove in which the engagement rib 351*d* (on the side where the latch 351*e* is located) of the handle 315. As for the relationship between the notch 351*b* of the locking member 351 and the locking projection 312*h,* the notch 351*b* is made wide enough in terms of its central angle A so that a play of 6 deg. is afforded for the handle 315 in terms of its circumferential direction.

In order to exchange the toner-replenishing container 301 with a fresh one after the toner in the toner-replenishing container 301 was depleted, the handle 315 must be turned to its original position by turning it in the direction opposite to the direction in which the handle 351 is turned during the installation of the toner-replenishing container 301 (counterclockwise as seen from the upstream side in terms of the direction in which the toner replenishing container 301 is inserted into the toner replenishing apparatus 100). With this action, the latch 351*e* becomes disengaged from the arc-shaped groove 351*e,* and the locking member 351 slides back, on the locking-member engagement portion 312*g,* also to its original position, i.e., the position at which the locking projection 312*h* remains engaged in the notch 351*b* of the ring portion 351*a* of the locking member 351, due to the resiliency of the spring portion 351*c.*

As stated before, because the locking member 351 is under the pressure generated by the springy portion 351*c* in the direction of the toner container 311, it slides in the direction to cause the aforementioned locking projection 312*h* and the notch 351*b* of the locking member 351 to engage with each other, and lock the handle 351.

(Toner Replenishing Operation)

Next, a toner-replenishing operation which employs a toner-replenishing container in this embodiment will be described in general terms.

(1) Installation of Tone Replenishing Container 301

First, the lid 121 with which the apparatus main assembly 124 is provided is opened by 90 deg. toward an operator. Then, the guide portion 311*k* of the toner-replenishing container 301 is engaged into the groove 354*h* (FIG. 20) between the projections 354*c* of the toner-replenishing apparatus 100. Then, the toner-replenishing container 301 is inserted into the toner-replenishing apparatus 100 from the side where the coupling 326*a* is provided. With this action, first, the container shutter 316 of the toner-replenishing container 301 and the main assembly shutter 334 within the toner-replenishing apparatus 100 engage with each other. Next, the driving-force-transmitting engaging portion 321*g* and the driving-force-receiving engaging portion 316*d* of the container shutter 316 engage with each other. Lastly, the driving-force-receiving engaging portion 321*a* on the toner-replenishing apparatus 100 side and the driving-force-transmitting engaging portion 315*a* of the handle 315 engage with each other.

(2) Positioning of Toner-Replenishing Container/Toner Replenishment

With the toner-replenishing container 301 being in the toner-replenishing apparatus 100, as an operator manually rotates the handle 315 by 90 deg. in the clockwise direction, the rotational driving force, i.e., the force applied by the operator, is transmitted from the driving-force-transmitting engaging portion 315*a* of the handle 315 to the driving force-transmitting member 321 through the driving force-receiving engaging portion 321*a* of the toner-replenishing apparatus 100. Then, this force is further transmitted from the driving-force transmitting engaging portion 321*g* to the driving-force-receiving engaging portion 316*d* of the container shutter 316. By the driving force transmitted in the above-described manner, the container shutter 316 is slid in the circumferential direction of the toner container 311 while engaging with the shutter-supporting member 311*e* of the toner container 311. During this sliding movement of the container shutter 316, the main-assembly shutter 334 moves with the container shutter 316. Therefore, the toner outlet 311*a* of the toner container 311, the opening 334*d* of the main-assembly shutter 334, and the toner inlet 333 in the toner-replenishing apparatus 100, are all opened at the same time. Then, toner replenishment is started by rotating the toner-conveying member 329 through the coupling 326*a* which receives the driving force from the coupling 344 of the apparatus main assembly 124.

During the above described operation, the toner container 311 does not rotate. Therefore, the toner-replenishing container 301 does not rotate with the handle 315; it remains fixed in the toner replenishing apparatus 100.

(3) Removal of Toner-Replenishing Container

An operator rotates the handle 315 by 90 deg. in the counterclockwise direction. With this action, a driving force different in direction from the driving force applied during the installation (2) of the toner cartridge is transmitted in the same order as in the installation of the toner-replenishing container. As a result, the container shutter 316 closes the toner outlet 311*a,* and the main-assembly shutter 334 closes the opening 334*d* of the main-assembly shutter 334*d* and the toner inlet 333, to complete the toner replenishment sequence.

The toner-replenishing container 301 is installed into the toner-replenishing apparatus 100 from the coupling 326*a* side. This requires that the engaging portion 316*d* of the container shutter 316 passes by the engaging portion 321*a* of the apparatus main assembly 124, and engages with the engaging portion 321*g,* i.e., the inward one, of the apparatus main assembly 124. Therefore, the diameter of the theoretical circle which connects the tips of the teeth of the engaging portion 316*d* in the form of a segment gear is desired to be smaller than the diameter of the theoretical circle that connects the bases of the teeth of the engaging portion 315*a* in the form of a segment gear.

With the provision of the above-described structure, a toner container is not required to move during the toner-replenishing sequence. Therefore, there is no restriction regarding the shape of a toner container. Therefore, a shape which offers the highest spatial efficiency to a toner container may be employed as the shape for a toner container. In addition, a shutter and a handle are made into two separate components. Therefore, it is unnecessary for a toner outlet to be next to a handle. Therefore, more latitude can be afforded in designing a toner replenishing container.

Further, in the case of the toner-replenishing container in this embodiment, the driving force applied to the handle is transmitted to the driving-force-receiving engaging portion of the shutter through a plurality of engaging portions; the engaging portion of the handle, the engaging portion of the driving-force transmitting member, and the engaging portion of the shutter. Therefore it is possible to more freely design these engaging portions in terms of engagement ratio (gear ratio).

Thus, when the distance the shutter is slid to be opened or closed is long, the angle by which the handle must be rotated can be reduced by increasing the engagement ratio (gear ratio) of the handle, and when the torque required to open or close the shutter is high, the torque required to operate (rotate) the handle can be reduced by reducing the engagement ratio (gear ratio) of the handle.

Also in this embodiment, the angle by which the handle is rotated to open or close the shutter is made to be 90 deg., so that when installing the toner-replenishing container into the toner-replenishing apparatus, the thick end 315*e* is vertically positioned, and after the toner is discharged by rotating the handle clockwise by 90 deg., the thick end 315*e* of the handle 315 is horizontally positioned. This arrangement makes it easier for an operator to operate the toner-replenishing container, and also to recognize the state of the toner-replenishing container 301. For operational efficiency and convenience, the angle by which the handle 315 is rotated to open or close the shutter is desired to be in a range of 60–120 deg.

(Toner-Stirring-Conveying Apparatus)

The toner-replenishing apparatus 100 is provided with the toner-stirring-conveying apparatus 345. Referring to FIGS. 20 and 21, the toner-replenishing apparatus 100 is also provided with the case 348, which is fixed to the toner replenishing apparatus main assembly 354. The case 348 is approximately the same as the toner-replenishing apparatus 100 in the longitudinal dimension. In the case 348, the stirring screws 346 and 347 are disposed, being supported by the case 348 so that they can be rotationally driven.

The stirring screws 346 and 347 are separated by a partition wall 348*a* which divides the internal space of the case 348 into two chambers 348A and 348B, which are connected to each other through the hole provided in the partition wall 348*a* on the side opposite to the toner outlet 333, and in which the stirring screws 346 and 347 are disposed, respectively, the stirring screw 346 being diagonally above the stirring screw 347. The case 348 is provided with a toner outlet 348*b,* which is located at the same longitudinal end as the toner outlet 333, and leads to the developing apparatus 201.

With the provision of the above structural arrangement, as the toner is supplied from the toner outlet 333, the rotating toner-stirring screw 346 conveys the toner, while stirring, through the chamber 348A in the longitudinal direction from the toner outlet 333 side to the opposite side, causing the toner to fall into the chamber 348B through the opening (unillustrated) provided in the partition wall 348*a*. The toner-stirring screw 347, i.e., the one at the bottom, conveys, while stirring, the toner in the direction opposite to the toner-conveying direction of the toner-stirring screw 346. As a result, the toner is supplied into the developing apparatus 201 through the toner outlet 348B.

(Precise Positioning Means)

If cost is spared in producing a toner-replenishing container and components related thereto, in other words, if highly precise components are not used of the production of a toner-replenishing container and the related components, it is inevitable that the drive train, i.e., the driving-force transmitting junction from the rotatable handle to the shutter, suffers from an excessive amount of play and/or deformation which results in, for example, the gear backlash or the like. With the presence of such a large amount of play and/or deformation, the output stroke of the drive train does not correspond to the input stroke one to one. Therefore, there occurs sometimes such a condition that after the shutter is opened, it fails to come back all the way to its original position. If the toner-replenishing container, the shutter of which is in this condition, is removed once from the apparatus main assembly, and reinstalled into the apparatus main assembly, the distance between the final position of the toner replenishing container after the closing stroke, and the original position becomes greater than that in the previous installation. In other words, the distance continues to increase with the repetition of the installation and removal.

In the case of the above-described design, according to which the main-assembly shutter and container shutter are integrally engaged with each other, shutter misalignment such as the one described above makes it impossible to remove the toner-replenishing container from the apparatus main assembly, or to install a fresh-toner replenishing container (shutter is at its original position) into the apparatus main assembly, which is a serious problem.

This problem can be solved by providing a toner-replenishing container and the related structure of the apparatus main assembly with such a feature that requires that when installing a toner-replenishing container, the handle is rotated in the opening direction of the shutter by a predetermined angle, in addition to the theoretically necessary angle, before the handle and shutter begin to engage with the driving train gears on the apparatus main assembly side, and when removing the toner-replenishing container, the handle is rotated in the closing direction of the shutter by the aforementioned predetermined angle, in addition to the theoretically necessary angle. This feature compensates for the additional length of stroke which the gear backlash or the like resulting from the excessive play requires, assuring that the shutters are returned to their original positions.

Next, a means for providing the above described feature will be described in detail.

Figure 50:
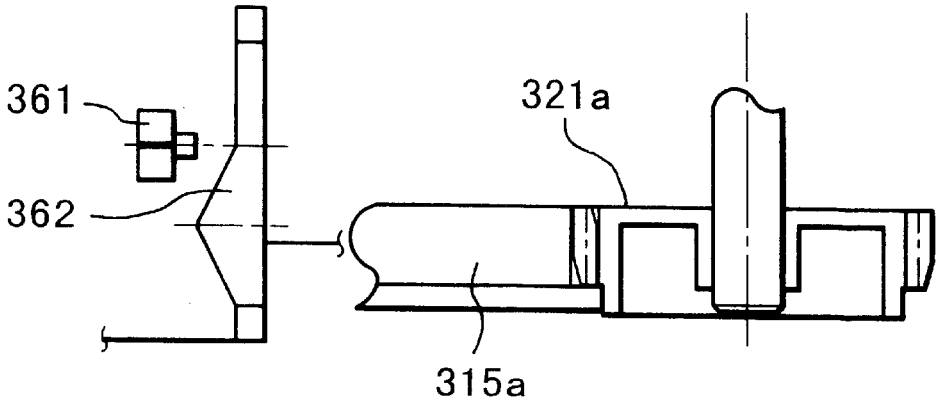
FIG. 50 is a schematic drawing which shows the function of a shutter-positioning means.
Figure 51:
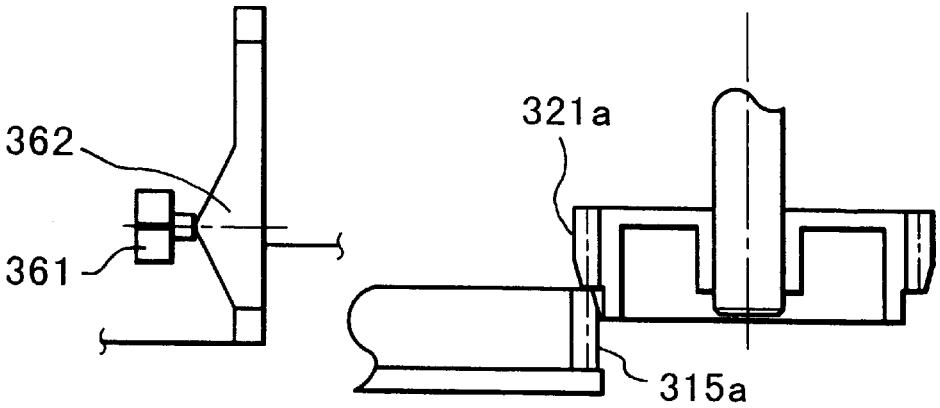
FIG. 51 is a schematic drawing which shows the function of the shutter-positioning means.
Figure 52:
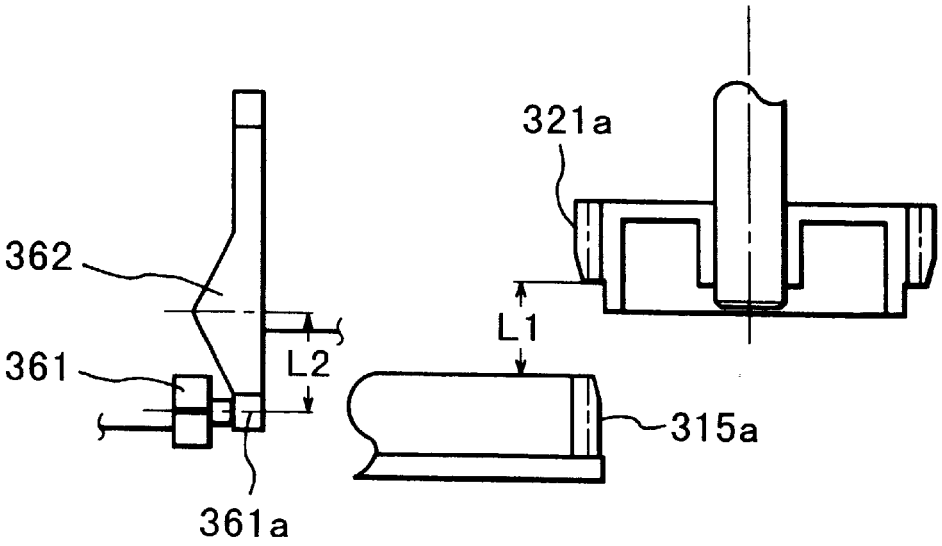
FIG. 52 is a schematic drawing which shows the function of the shutter-positioning means.

Referring to FIGS. 10, 11, 42 and 43, the handle 315 is provided with a handle projection 361, which is located on the outwardly facing surface of the handle 315. Referring to FIGS. 50–52, which are a schematic plan of the handle projection 361 and its adjacent areas as seen from above, the handle projection 361 is shaped like a cam follower, and its portion with a contact surface 361*a* is narrow in the vertical direction. It is positioned to come in contact with the main assembly projection 362 provided on the inwardly-facing surface of the top plate of the bottom portion 354*b* of the toner-replenishing apparatus main assembly 354. The projections 361 and 362 work in combination as a follower and a cam, respectively.

The cam portion of the main assembly projection 362 is angled in profile. The lift of this cam surface is just enough to make the center angle of the cam portion of the main assembly projection 362, that is, the angle formed by the line connecting the highest point of the cam surface and the center of the toner replenishing apparatus main assembly 354 (center of the semicylindrical bottom portion 354*a*), and the line connecting the base of the cam surface and the center of the toner replenishing apparatus main assembly 354, large enough to compensate for the play in the rotational direction between the toner-replenishing container 301 and toner-replenishing apparatus 100. This center angle is no less than 6 deg. In this embodiment, it is 6 deg.

Next, the handle projection 361 and main assembly projection 362 will be described in positional relationship and function. Referring to FIGS. 42 and 52, as the toner-replenishing container 301 is inserted into the toner-replenishing apparatus 100, the handle projection 361 reaches a point at which it comes in contact with the main assembly projection 362, on the cam surface, at the point with no lift. In this state, the driving-force-transmitting engaging portion 315*a* of the handle 315 and the driving-force-receiving engaging portion 321*a* on the main assembly side are apart from each other by a distance L1, which is equal to a distance L2 by which the handle projection 361 in this state must be moved to receive the highest lift.

As the toner-replenishing container 301 is further inserted into the toner-replenishing apparatus 100 from the point illustrated in FIGS. 42 and 52, the handle projection 361 slides on the main assembly projection 362 while rotating the handle 315. By the time the handle projection 361 slides to the cam crest of the main assembly projection 362, the handle 315 is rotated by 6 deg. The tooth tips of the engaging portion 315*a* of the handle 315 come in contact with the counterparts of the engaging portion 321*a* of the toner-replenishing apparatus 100 at the same time the handle projection 361 reaches the cam crest of the main assembly projection 362. The tooth tips of the engaging portion 316*d* of the container shutter 316 come in contact with the counterparts of the engaging portion 321*g* on the main-assembly side slightly before the contact between the engaging portions 315*a* and 321*a* by their tooth tips. In other words, the engagement of the engaging portion 316*d* of the container shutter 316 with the engaging portion 321*g* on the main-assembly side occurs slightly ahead of the engagement of the engaging portion 315*a* of the handle 315 with the engaging portion 321*a* of the toner-replenishing apparatus 100.

Referring to FIG. 50, as the toner replenishing container 301 is further inserted into the toner-replenishing apparatus 100, the driving-force-transmitting engaging portion 315*a* of the handle 315 and the driving-force-receiving engaging portion 321*a* of the toner-replenishing apparatus 100 mesh with each other. On the other hand, the driving-force-receiving engaging portion 316*d* of the container shutter 316 meshes with the driving-force-transmitting engaging portion 321*g* illustrated in FIG. 19, across the entire ranges of their teeth. Therefore, while the toner-replenishing container 301 moves from the position illustrated in FIG. 51 to the position illustrated in FIG. 50, the handle 315 does not rotate, and the handle projection 361 remains at the position that corresponds to the cam cost of the main-assembly projection 362.

As the handle projection 361 is displaced by the main-assembly projection 362 as described above, the handle 315 rotates by 6 deg. Therefore, a certain amount of play is provided between the mutually-facing surfaces of the handle 315 and first flange 312. More specifically, referring to FIGS. 16 and 17, a play large enough to allow the handle 315 to rotate by 6 deg. is provided in the circumferential direction of the handle 315 between the side surfaces of the notch 351*b* of the locking member 351, and the locking projection 312*h* of the first flange 312, and also between the surfaces of the grooves 315*k* and 315*m*, and the corresponding engagement ribs 315*d* of the first flange 312.

Further in order to make the container shutter 316 engage with the main-assembly shutter 334 at a predetermined position before the handle 315 is rotated by the handle projection 361 and main-assembly projection 362, the bottom portion 354*a* of the toner-replenishing apparatus main assembly 354 is provided with a positioning projection 363, which is located on the inwardly-facing surface of the bottom portion 354*a*, and against which the end surface of the container shutter 361, on the leading side in terms of the installing direction of the toner-replenishing container 301, slides, as shown in FIGS. 48 and 49. This projection 363 has a cam surface which is angled in profile, and the position of the cam crest of this projection 363 corresponds to the timing with which one of the mutually facing surfaces 334*b*1 of the indentation of the main-assembly shutter 334, in which the container shutter 316 fits, comes to a predetermined point.

As the toner-replenishing container 301 is inserted into the toner-replenishing apparatus 100, the chamfer surface 316*q* of the container shutter 316 comes in contact with the projection 363. As a result, the container shutter 316 is controlled in its positional relationship relative to the main assembly shutter 334 in the circumferential direction of the toner-replenishing container 301. Then, as the toner-replenishing container 301 is further inserted into the toner-replenishing apparatus 100, the longitudinal edge 316*r*1 of the container shutter 316, connected to the chamfer surface 316*q*, slides against the projection 363 while the container shutter 316 fits into the indentation of the main-assembly shutter 334. During this movement of the container shutter 316, the chamber surface 316*p* of the container shutter 316, on the opposite side of the container shutter 316, comes in contact with the chamfer surface 334*b*2 located at the corner of the projection 334*b*, on the corresponding side, of the main-assembly shutter 334, also controlling the container shutter 316 in its positional relationship relative to the main assembly shutter 334. As the toner-replenishing container 301 is further inserted, the chamfer surface 316*q* engages with the chamfer surface 334*b*3 of the main assembly shutter 334, and thereafter, the container shutter 316 advances into the indentation (space) between the mutually-facing surfaces 334*b*1 of the projections 334*b* of the main assembly shutter 334. Then, as the container shutter 316 advances into the indentation of the main assembly shutter 334 to a point illustrated in FIG. 48, the engaging portions 315*a* and 316*d* on the toner-replenishing container 301 side begin to mesh with the engaging portions 321*a* and 321*g* on the toner-replenishing apparatus 100 side. As the corresponding engaging portions mesh with each other, the positional relationship between the container shutter 316 and main assembly shutter 334 becomes as shown in FIG. 49. In this state, the chamfer surface 316*s* at the upstream end, in terms of the advancing direction of the container shutter 316 relative to the main assembly shutter 334, of the longitudinal edge 316*r* on the container shutter 316 side has separated from the projection 363.

During the above described process, the resistance against the movement of the container shutter 316 for opening or closing the toner outlet of the toner container 311 is large enough in comparison to the resistance against the opening or closing of the main assembly shutter 334, because the container shutter 316 is under the pressure generated by the packing member 335. Therefore, the projection 363 regulates the position of the container shutter 316, and the container shutter 316 regulates the position of the main assembly shutter 334.

With the provision of the above-described structure and its functions, the positions of the main-assembly shutter 334 and container shutter 316 are always the same after their engagement. In this state, as a user rotates the handle 315 by 84 deg. in the clockwise direction as seen from the upstream side of the direction in which the toner-replenishing container 301 is inserted in the toner-replenishing apparatus 100, both shutters 316 and 334 rotate 50 deg. in their opening direction; they fully open.

When removing the toner-replenishing container 301 from the toner-replenishing apparatus 100, a user is required to rotate the handle 315 by 90 deg. in the counterclockwise direction, i.e., the direction opposite to the aforementioned direction. As the handle 315 is rotated, the both shutters 316 and 334 rotate by 50 deg. in their closing direction to their original position.

As described above, the relations among the rotational angle of the handle 315 during the opening of the shutters 315 and 334, the rotational angle of the handle 315 during the closing of the shutters 315 and 334, the rotational angles of the shutters 316 and 334 during the closing of the shutters 316 and 334, and the rotational angles of the shutters 316 and 334 during the closing of the shutters 316 and 334, do not exactly correspond. This discrepancy occur because a margin of 6 deg. is guilt into the structure in order to compensate for the play generated by the rotation of the toner-replenishing container relative to the main assembly of the toner-replenishing apparatus, which is caused by the gear backlash, deformation or bending of the handle, shutters, and shafts, and the like, so that the shutters are returned to the original positions.

Also, when pulling the toner-replenishing container 301 out of the toner replenishing apparatus 100, the handle 315 is pre-rotated by 6 deg. in the opening direction, as when installing the toner-replenishing container 301, by the engagement of the handle projection 316 and the main-assembly projection 362, to prepare the toner-replenishing container 301 for the next usage. Should an attempt be made to pull out the toner-replenishing container 301 without rotating the handle 315 by 90 deg. in the counterclockwise direction (for example, rotating by only 80 deg.), it is possible that the container shutter 316 and main assembly shutter 334 might not return to their original positions. In the case of this embodiment, however, as the toner-replenishing container 301 is pulled, the chamfer surface 316*s* of the container shutter 316 engages with the projection 363 of the toner-replenishing apparatus 100, and forces the container shutter 316 and main-assembly shutter 334 back to their original positions. Therefore, the aforementioned inconvenience can be avoided.

While the invention has been described with reference to the structures disclosed herein, it is not confined to the details set forth and this application is intended to cover such modifications or changes as may come within the purposes of the improvements or the scope of the following claims.

What is claimed is:

1. A toner replenishing container which is detachably mountable to a main assembly of a toner replenishing apparatus, said toner replenishing container comprising:

a container body, having an opening for supplying toner into said main assembly, for containing toner;

an opening and closing member, slidable relative to said container body for opening and closing the opening, wherein said opening and closing member is slidable in a first direction to open the opening;

wherein said opening and closing member is slidable relative to said container body in a second direction, crossing said first direction and when said opening and closing member is at a closing position for closing the opening, said opening and closing member is prevented from sliding in the first direction before sliding in the second direction.

2. A container according to claim 1, wherein said first and second directions are substantially orthogonal to each other.

3. A container according to claim 1, wherein said second direction is parallel to a direction along which said toner replenishing container is mounted to the main assembly.

4. A container according to claim 3, wherein said opening and closing member is slid in the second direction in association with mounting of said toner replenishing container to the main assembly.

5. A container according to claim 4, wherein said opening and closing member is provided with an abutment for abutting the main assembly such that when said container is mounted to the main assembly, said opening and closing member slides in the second direction.

6. A container according to claim 3, wherein said container body is provided with an arcuate portion at least a part of a length thereof, and said arcuate portion is extended in the first direction, and said second direction is parallel to a direction of the length.

7. A container according to claim 1, wherein said opening and closing member is prevented from sliding in the first direction before completion of the sliding in the second direction.

8. A container according to claim 1, wherein said container body is provided with first and second guides, which are opposed to each other, for guiding said opening and closing member in the first direction, and wherein the first guide is provided with a stopper for abutting said opening and closing member to stop sliding of said opening and closing member in the first direction, and said opening and closing member is released from abutment to the stopper by sliding motion in the second direction.

9. A container according to claim 1, further comprising an elastic portion for urging said opening and closing member in a direction opposite from the second direction.

10. A container according to claim 9, wherein said elastic portion is integral with said opening and closing member.

11. A container according to claim 1, wherein said opening and closing member is provided with an engaging portion, extending in the second direction, for engagement with a guiding portion for guiding said container when said container is mounted to said main assembly.

12. A container according to claim 1, further comprising a rotatable member, rotatable relative to said main-assembly, for transmitting a rotating force therefrom to a transmission member provided on the main assembly and a force receiving portion for receiving a rotational force from said transmission member, wherein said opening and closing member is slid in the first direction by the rotational force received by said receiving portion.

13. A container according to claim 12, wherein said rotatable member is provided with a grip to which an operator can impart a rotational force.

14. A container according to claim 13, further comprising an elastic portion for urging said opening and closing member in a direction opposite from the second direction.

15. A container according to claim 14, wherein said grip is provided with a contact portion at which said grip is urged by said elastic portion.

16. A toner replenishing apparatus comprising:

a toner replenishing container, which is detachably mountable to a main assembly of said toner replenishing apparatus, said toner replenishing container including:

a container body, having an opening for supplying toner into said main assembly, for containing toner;

an opening and closing member, slidable relative to said container body for opening the opening, wherein said opening and closing member is slidable in a first direction to open the opening;

wherein said opening and closing member is slidable relative to said container body in a second direction crossing said first direction, and when said opening and closing member is at a closing position for closing the opening, said opening and closing member is prevented from sliding in the first direction before sliding in the second direction; and said toner replenishing apparatus further comprising:

an abutment for abutting said opening and closing member such that said opening and closing member is slidable in the second direction, when said container is mounted to the main assembly.

17. An apparatus according to claim 16, wherein the main assembly includes a slidable member slidable in the second direction to open said opening, and wherein said slidable member of the main assembly is provided with an engaging portion for engagement with said opening and closing member of said container when said container is mounted to the main assembly, wherein said slidable member and said opening and closing member are permitted to slide in the first direction.

18. An apparatus according to claim 16, wherein said first and second directions are substantially orthogonal to each other.

19. An apparatus according to claim 16, wherein said container body is provided with an arcuate portion at least a part of a length thereof, and said arcuate portion extends in the first direction, and said second direction is parallel to a direction of the length.

20. An apparatus according to claim 16, wherein said opening and closing member is prevented from sliding in the first direction before completion of the sliding in the second direction.

21. An apparatus according to claim 16, wherein said container body is provided with first and second guides, which are opposed to each other, for guiding said opening and closing member in the first direction, and wherein the first guide is provided with a stopper for abutting said opening and closing member to stop sliding of said opening and closing member in the first direction, and said opening and closing member is released from abutment to the stopper by sliding motion in the second direction.

22. An apparatus according to claim 16, further comprising an elastic portion for urging said opening and closing member in a direction opposite from the second direction.

23. An apparatus according to claim 22, wherein said elastic portion is integral with said opening and closing member.

24. An apparatus according to claim 16, wherein said opening and closing member is provided with an engaging portion, extending in the second direction, for engagement with a guiding portion for guiding said container when said container is mounted to said main assembly.

25. An apparatus according to claim 16, further comprising a rotatable member, rotatable relative to said container body, for transmitting a rotating force therefrom to a transmission member provided on the main assembly and a force receiving portion for receiving a rotational force from said transmission member, wherein said opening and closing member is slid in the first direction by the rotational force received by said receiving portion.

26. An apparatus according to claim 25, wherein said rotatable member is provided with a grip to which an operator can impart a rotational force.

27. An apparatus according to claim 26, further comprising an elastic portion for urging said opening and closing member in a direction opposite from the second direction.

28. An apparatus according to claim 27, wherein said grip is provided with a contact portion at which said grip is urged by said elastic portion.

* * * * *

UNITED STATES PATENT AND TRADEMARK OFFICE

CERTIFICATE OF CORRECTION

PATENT NO. : 6,292,644 B1
DATED : September 18, 2001
INVENTOR(S) : Tatsuya Goto et al.

It is certified that error appears in the above-identified patent and that said Letters Patent is hereby corrected as shown below:

Title page,
Item [57], ABSTRACT,
Line 7, "is" (second occurrence) should be deleted.

Column 2,
Line 11, "m ore" should read -- more --.

Column 7,
Line 50, "stepped" should read -- the stepped --.

Column 12,
Line 53, "section" should read -- section is --.

Column 13,
Line 58, "312*a*," should read -- 312*e*, --; and
Line 65, "drive-force" should read -- driving-force --.

Column 14,
Line 40, "32*b*" should read -- 321*b* --; and
Line 46, "driving force." should read -- driving-force --.

Column 17,
Line 12, "driving force" should read -- driving-force --;
Line 19, "316*f*1" should read -- 316*f*1 --;
Line 45, "adjacencies," should read -- adjacent areas, --; and
Line 46, "adjacencies," should read -- adjacent areas, --.

Column 18,
Line 14, "adjacencies," should read -- adjacent areas, --.

Column 20,
Line 19, "toner replenishing" should read -- toner-replenishing --.

Column 21,
Line 14, "bordened" should read -- bordered --; and
Line 20, "the" (second occurrence) should read -- of the --.

UNITED STATES PATENT AND TRADEMARK OFFICE

CERTIFICATE OF CORRECTION

PATENT NO. : 6,292,644 B1
DATED : September 18, 2001
INVENTOR(S) : Tatsuya Goto et al.

It is certified that error appears in the above-identified patent and that said Letters Patent is hereby corrected as shown below:

Column 24,
Line 7, "341 *a*" should read -- 341*a* --;
Line 27, "mainassembly" should read -- main-assembly --; and
Line 45, "possible" should read -- possibly --.

Column 28,
Line 4, "toner replenishing" should read -- toner-replenishing --; and
Line 7, "ion" should read -- in --.

Column 29,
Line 44, "lock releasing" should read -- lock-releasing --.

Column 30,
Line 9, "toner replenishing" should read -- toner-replenishing --.

Column 31,
Line 9, "toner replenishing" should read -- toner-replenishing --; and
Line 42, "toner replenishing" should read -- toner-replenishing --.

Column 34,
Line 12, "toner replenishing" should read -- toner-replenishing --.

Column 36,
Line 2, "toner replenishing" should read -- toner-replenishing --.

Signed and Sealed this

Eighteenth Day of June, 2002

*Attest:*

*Attesting Officer*

JAMES E. ROGAN
*Director of the United States Patent and Trademark Office*